United States Patent [19]

Yamada et al.

[11] Patent Number: 5,004,669

[45] Date of Patent: Apr. 2, 1991

[54] LIGHT-SENSITIVE SILVER HALIDE PHOTOGRAPHIC MATERIAL

[75] Inventors: Taketoshi Yamada; Takeshi Habu; Yasuhiko Takamuki, all of Hino, Japan

[73] Assignee: Konica Corporation, Tokyo, Japan

[21] Appl. No.: 427,694

[22] Filed: Oct. 27, 1989

[30] Foreign Application Priority Data

| | | | |
|---|---|---|---|
| Oct. 31, 1988 | [JP] | Japan | 63-276552 |
| Oct. 31, 1988 | [JP] | Japan | 63-276560 |
| Dec. 27, 1988 | [JP] | Japan | 63-332038 |
| Dec. 28, 1988 | [JP] | Japan | 63-330854 |
| Dec. 28, 1988 | [JP] | Japan | 63-330863 |

[51] Int. Cl.[5] ..... G03C 1/06; G03C 1/84

[52] U.S. Cl. ..... 430/264; 430/510; 430/531; 430/527; 430/531; 430/532; 430/627; 430/628; 430/937

[58] Field of Search ..... 430/527, 536, 510, 531, 430/627, 628, 937, 264, 532

[56] References Cited

U.S. PATENT DOCUMENTS

| | | | |
|---|---|---|---|
| 3,617,286 | 11/1971 | Kamayama et al. | 430/514 |
| 4,070,189 | 1/1978 | Kelley et al. | 430/527 |
| 4,252,885 | 2/1981 | McGrail et al. | 430/532 |
| 4,363,871 | 12/1982 | Shibue et al. | 430/527 |
| 4,388,402 | 6/1983 | Mukunoki et al. | 430/527 |
| 4,416,980 | 11/1983 | Fujiwhara | 430/264 |
| 4,605,609 | 8/1986 | Okazaki et al. | 430/232 |
| 4,873,173 | 10/1989 | Sasaoka et al. | 430/264 |
| 4,891,308 | 1/1990 | Cho | 430/527 |

FOREIGN PATENT DOCUMENTS

| | | |
|---|---|---|
| 0219010 | 4/1987 | European Pat. Off. . |
| 0258443 | 3/1988 | European Pat. Off. . |
| 2488700 | 2/1982 | France . |
| 2001078 | 1/1979 | United Kingdom . |

*Primary Examiner*—Charles L. Bowers, Jr.
*Assistant Examiner*—Thorl Chea
*Attorney, Agent, or Firm*—Finnegan, Henderson, Farabow, Garrett, and Dunner

[57] ABSTRACT

Disclosed is a light-sensitive silver halide photographic material comprising a transparent support and provided thereon a silver halide emulsion layer, wherein the support is subjected to corona discharge treatment on its surface opposite to the side on which the emulsion layer is provided, and is provided thereon with a subbing layer containing a latex polymer, a non-gelatin layer containing a conductive polymer, and a gelatin layer containing a conductive polymer and a backing dye, in this order. The light-sensitive silver halide photographic material obtained by this invention can be handled in a roomlight environment when used as a light-sensitive material particularly in the field of printing plate making or the like, has a superior antistatic ability and a high sensitivity, and yet can obtain a photographic image with a high contrast, and also can stably obtain a halftone with a high quality and less fog.

26 Claims, No Drawings

LIGHT-SENSITIVE SILVER HALIDE PHOTOGRAPHIC MATERIAL

BACKGROUND OF THE INVENTION

This invention relates to a light-sensitive silver halide photographic material. More particularly, it relates to a light-sensitive material used in photographing in the field of printing plate making, a scanner light-sensitive material, a contact light-sensitive material, and a facsimile light-sensitive material. It further relates to a light-sensitive silver halide photographic material that can be handled in a roomlight environment when used as a light-sensitive material particularly in the field of printing plate making or the like. From another aspect, this invention relates to a light-sensitive silver halide photographic material having a superior antistatic ability, that may cause less fog, has a high sensitivity, and yet can obtain a photographic image with a high contrast, and also can stably obtain a halftone with a high quality.

Light-sensitive silver halide photographic materials used in recent years in the field of printing plate making tend to be electrostatically charged in the course they are handled. In particular, in dry winter seasons, the charges caused by static electricity may reach as high as several kV, resulting in easy attraction of dust, and has caused generation of pin holes. It has had the problem of electrically shocking human bodies. To cope with these, countermeasures have been taken such that an earth is fitted, environmental humidity is increased, or light-sensitive silver halide photographic materials are made to contain various antistatic agents. These countermeasures, however, are not so satisfactory that, particularly in the case of conventional antistatic agents, their effect may turn almost lost after light-sensitive silver halide photographic materials have been processed through developing, fixing, washing and drying. Thus, it has been ernestly sought to provide a plate making light-sensitive material that can be kept antistatic even after the processing.

The light-sensitive silver halide photographic materials tend to be electrostatically charged particularly at low humidity as in the winter. It is particularly important to take the antistatic countermeasure when a high-sensitive photographic emulsion is coated at a high speed or a high-sensitive light-sensitive material is exposed to light through an automatic printer, as done in recent years.

As another problem in the conventional light-sensitive silver halide photographic materials, static marks may appear as a result of the discharge that occurs once the light-sensitive materials are electrostatically charged, or foreign matters such as dust may be attracted to cause generation of pinholes, resulting in an extreme deterioration of quality, and the repairment of which may bring about a serious lowering of operability. For this reason, commonly used in the light-sensitive silver halide photographic materials are antistatic agents. Recently used are fluorine-containing surface active agents, cationic surface active agents, amphoteric surface active agents, surface active agents or polymeric compounds containing a polyethylene oxide group, and polymers having in the molecule a sulfonic acid or phosphoric acid group.

In particular, frequently employed is charge arrangement adjustment using a fluorine-containing surface active agent, or conductivity improvement using a conductive polymer. For example, a technique in which an ionic polymer having a dissociation group in the polymer backbone chain is used is disclosed in Japanese Unexamined Patent Publications No. 91165/1974 and No. 121523/1974.

These conventional techniques, however, may bring about a great deterioration of antistatic abilities as a result of development processing. This is presumably because the antistatic abilities are lost after light-sensitive materials have gone through the developing step, acidic fixing step, and washing or the like step. Hence, the problem of the generation of pinholes due to attraction of dust may occur when a film having been processed is further used in printing as in printing light-sensitive materials.

Turning the viewpoint to the processing of light-sensitive silver halide photographic materials in a darkroom, in the field of printing plate making, a technique to make it possible to carry out under roomlight conditions the film making that has been hitherto carried out in a darkroom, i.e., the operation of the so-called contact step, has been sought in recent years for the purposes of labor-saving and improvement in a rationalized work environment, and thus improvements have been made in light-sensitive materials and in equipment such as printers.

The light-sensitive materials that can be handled under roomlight conditions include light-sensitive silver halide photographic materials having sensitivity to light of ultraviolet-rich light sources as exemplified by an ultrahigh-pressure mercury lamp, a metal halide light sources, a xenon lamp and a halogen lamp. These light-sensitive silver halide photographic materials can be handled under ordinary fluorescent lamps of as bright as 100 to 300 lux, or under fluorescent lamps for exclusive use, having a smaller amount of ultraviolet rays.

These light-sensitive materials have such an advantage, but, on the other hand have the disadvantage that the difficulties called pinholes tend to be generated in a black image obtained after the development processing.

The pinholes herein mentioned refer to the phenomenon that a blank area of not larger than about 30 $\mu$m is made in a black image, and so named after its round or indefinite form which looks like a hole pierced with a pin.

As contact films used for duplicating an image from a fine-halftone image, no image reproduction with fidelity can be obtained if the film itself has an abnormal black area. To cope with this, the pinholes generated must be subjected to opaquing (i.e., an operation to stop up a hole to make image retouch), resulting in an extremely poor operating efficiency.

From such existing conditions, it has been strongly sought to provide a roomlight film that may cause the pinholes with difficulty.

Problems relating to special uses of light-sensitive silver halide photographic materials will be discussed below. In the field of the light-sensitive silver halide photographic material, a light-sensitive material feasible for obtaining a high-contrast image is often used depending on uses. For example, a photographic image with a high contrast is commonly used to form characters or halftone-dotted photographic images in the process of photographic plate making, or to form fine line images in the process of ultra-precision photographic plate making. A certain type of light-sensitive silver halide photographic materials used therefor are known to be capable of forming a photographic image with a very high contrast.

As having been conventionally done, a light-sensitive material comprising a silver chlorobromide emulsion having an average grain size of, for example, 0.2 μm, having a narrow grains size distribution, with a uniform grain shape, and also having a high silver bromide content (at least 50 mol %) is processed using an alkaline hydroquinone developing solution having a low sulfite ion concentration. An image, e.g., a halftone image or fine line image, with a high contrast, high sharpness and high resolution can be thus obtained.

The light-sensitive silver halide photographic material of this type is known as a lith type light-sensitive material.

The process of photographic plate making comprises the step of converting an original with a continuous tone into a halftone image, in other words, the step of converting changes in density in the continuous tone of an original into aggregation of halftone dots having areas proportional to the density.

For this purpose, using the above lith type light-sensitive material, the original is photographed through a cross-line screen or a contact screen, followed by development processing to form a halftone image Thus, the light-sensitive silver halide photographic material containing the silver halide emulsion comprising fine grains also having uniform grain size and grain form is used. Even when, however, the light-sensitive silver halide photographic material of this type is used, the dot quality and so forth are poorer when the processing is carried out using an ordinary black-and-white developing solution than when the developing was carried out using the lith type developing solution. For this reason, the processing is carried out using a developing solution called a lith developer which is low in sulfite ion concentration and uses hydroquinone single agent as a developing agent. Since, however, the lith developer, which is susceptible to automatic oxidation, has a very poor preservativity, it is sought to the utmost to provide a controlling method of constantly maintaining the quality of development even when the lith developer is continually used, and great efforts have been made so that the preservativity of this developing solution can be improved.

As a technique for such improvement, an automatic processor for photographic plate making commonly widely employs a system, so-called two-part separate replenishing system, in which separate replenishing solutions comprising a replenishing solution that compensates for what has deteriorated in the activity as a result of development processing (i.e., replenishment of processing fatigue) and a replenishing solution that compensates for what has undergone oxidation deterioration with time (i.e., replenishment of fatigue with time) are used to carry out replenishment. The above method, however, is required to control the balance of replenishment of the two solutions, and has the problem that the system must be made complicated in respect of apparatus and also in respect of operation.

On the other hand, a method is known in which processing is carried out using a developing solution having a high sulfite ion concentration to obtain a high-contrast image.

The above method employs a light-sensitive silver halide photographic material containing a hydrazine compound.

According to this method, sulfite ion concentration can be maintained at a high level in the developing solution, and processing can be carried out in the state that the preservativity has been enhanced.

However, the developing solution used for the light-sensitive silver halide photographic material containing a hydrazine compound requires to have a relatively high pH in order to obtain a high contrast, therefore tending to generate fog. In order to restrain this fog, various organic restrainers must be contained in a high concentration, so that there is the problem of sacrificing the sensitivity. For this reason, it is urgently sought to provide a light-sensitive silver halide photographic material that can obtain a high-contrast image, and also may generate less fog and has a high sensitivity.

SUMMARY OF THE INVENTION

This invention was made taking account of the above circumstances. A first object thereof is to provide a light-sensitive silver halide photographic material that may generate no pinholes under exposure using a selected light source.

A second object of this invention is to provide a light-sensitive silver halide photographic material that can give a high-contrast photographic performance, and has superior line-image photographing, scanner-setting and contact performances.

A third object of this invention is to provide a light-sensitive silver halide photographic material that may generate no deterioration in the antistatic ability even after development processing.

A fourth object of this invention is to provide a light-sensitive silver halide photographic material having been improved in plate-making contact performance such as superimposition quality.

A fifth object of this invention is to provide a light-sensitive silver halide photographic material that may generate less fog, has a high sensitivity, and yet can obtain an image with a high contrast, and also can obtain halftone dots with a high quality without relying on the size of dot areas.

The above first and second objects of this invention can be achieved by a light-sensitive silver halide photographic material comprising a transparent support and provided thereon a light-sensitive silver halide emulsion layer, wherein said support is subjected to corona discharge treatment on its surface opposite to the side on which said emulsion layer is provided, and is provided thereon with a subbing layer (a first layer) containing a latex polymer, a non-gelatin layer (a second layer) containing a conductive polymer, and a gelatin layer (a third layer) containing a conductive polymer and a backing dye, in this order.

The above third object of this invention can be achieved by a light-sensitive silver halide photographic material, wherein;

the above conductive polymer contained in the non-gelatin layer is a water-soluble polymer having a repeating unit represented by the following Formula (I); and the above gelatin layer containing the conductive polymer and backing dye is further incorporated with a compound capable of binding with a calcium ion and/or a magnesium ion. (Hereinafter "the first preferred embodiment of this invention.)

Formula (I)

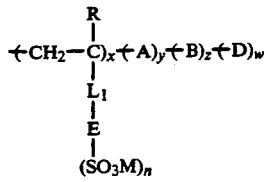

wherein R represents a hydrogen atom, a halogen atom, or an alkyl group; A, B and D each represent a monomer unit different from each other, copolymerized with copolymerizable ethylenically unsaturated monomers containing a carboxyl group or an ester derivative thereof or a halogen atom; x is 10 to 100 mol %, y is 0 to 90 mol % z is 0 to 20 mol %, and w is 0 to 10 mol %; E represents a mere bonding group, or a divalent bonding group constituted of any of a carbon atom, a nitrogen atom, a sulfur atom, an oxygen and a phosphorus atom; $L_1$ represents a benzene ring, or a heterocyclic ring; M represents a hydrogen atom, an ammonium cation, or an alkali metal ion; and n is 1 or 2.

The above third object of this invention can also be achieved by a light-sensitive silver halide photographic material, wherein;

the above light-sensitive silver halide emulsion layer contains a hydrazine compound or a tetrazolium compound;

the conductive polymer contained in the above gelatin layer is the water-soluble polymer having a repeating unit represented by the above Formula (I); and at least one layer of the gelatin layer is hardened with a hardening agent represented by the following Formula (II). (Hereinafter "the second preferred embodiment of this invention).

Formula (II)

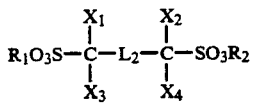

wherein $R_1$ and $R_2$ each represent an alkyl group having 1 to 4 carbon atom, and may different from each other; $X_1$, $X_2$, $X_3$ and $X_4$ each represents a hydrogen atom, an alkyl group having 1 to 3 carbon atoms, or a halogen atom, and may be different from each other; and $L_2$ represents a mere bonding group, or an alkylene group or alkyleneoxy group having 1 to 4 carbon atoms.

The above fourth object of this invention can be achieved by a light-sensitive silver halide photographic material, wherein;

the above light-sensitive silver halide emulsion layer contains a hydrazine compound or a tetrazolium compound;

the conductive polymer contained in the gelatin layer and non-gelatin layer is a conductive polymer having on a heterocyclic ring at least one sulfonic acid group or substituted alkylsulfonic acid group; and the above non-gelatin layer contains a fluorine-containing surface active agent. (Hereinafter "the third preferred embodiment of this invention.)

The fifth object of this invention can be achieved by a light-sensitive silver halide photographic material containing a compound represented by the following Formula (III) and a hydrazine compound in combination in the above light-sensitive silver halide emulsion layer.

Formula (III)

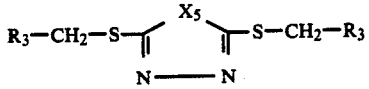

wherein $R_3$ represents a carboxylic acid group or sulfonic acid group that may be substituted, and $X_5$ represents a sulfur atom or an oxygen atom.

According to the present embodiment, the compound represented by Formula (III) is incorporated into the light-sensitive silver halide photographic material containing a hydrazine compound. Thus, advancement has been brought on a light-sensitive material that may cause less fog, has a high sensitivity, and yet can obtain an image with a high contrast and a high halftone quality.

According to this invention, antistatic properties of the light-sensitive material can be improved as an incidental effect.

DESCRIPTION OF THE PREFERRED EMBODIMENT

As the latex polymer used in this invention, the polymers disclosed in Japanese Unexamined Patent Publication No. 19941/1984 may preferably be used. Useful latex polymers, however, are those mainly composed of an acrylic alkyl ester. In this invention, the latex polymer may be contained in an amount of from 0.01 to 5 g, and preferably from 0.05 to 1 g, per 1 $m^2$ of the light-sensitive material.

Examples of the latex polymer of this invention may include the copolymers of Formulas LP-1 to LP-15 which have the recurring units shown below. However, this invention is by no means limited thereto.

LP - 1

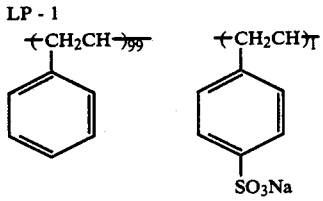

LP - 2

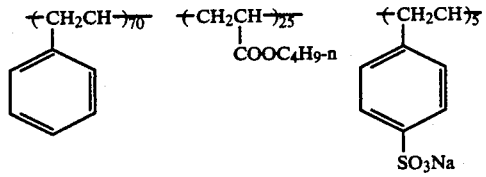

LP - 3

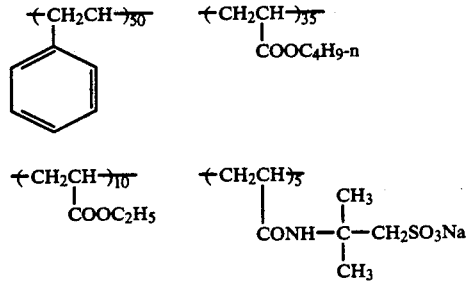

-continued
LP - 4
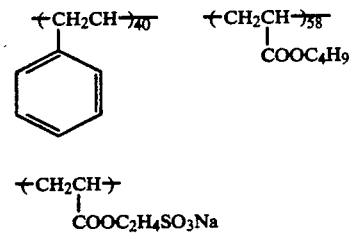
LP - 5
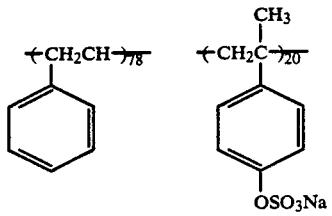
LP - 6
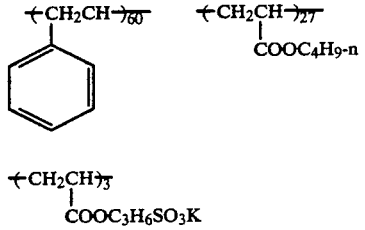
LP - 7
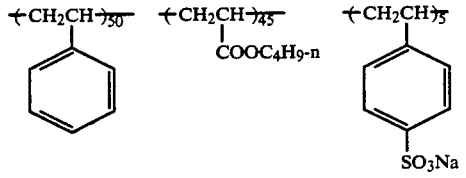
LP - 8
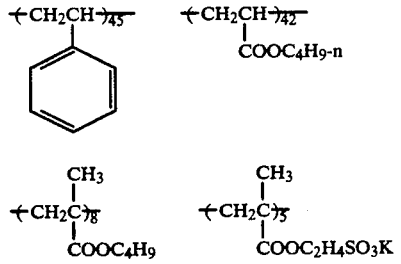
LP - 9
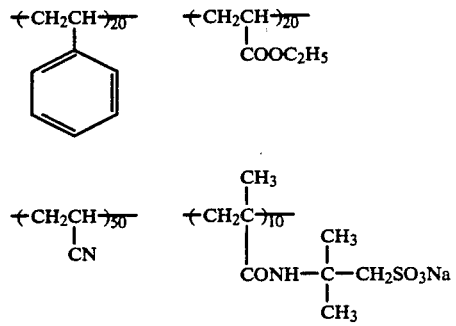
LP - 10
-continued
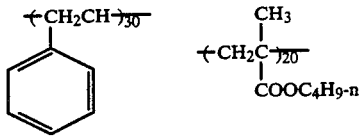
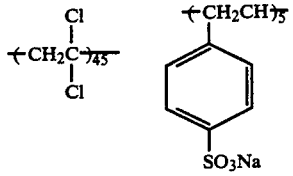
LP - 11
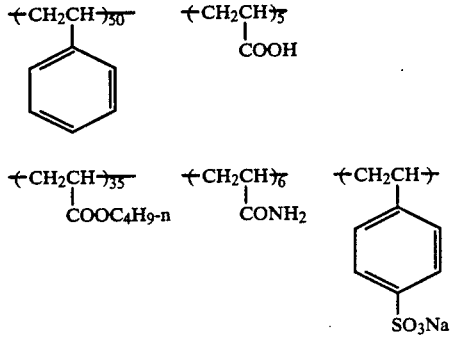
LP - 12
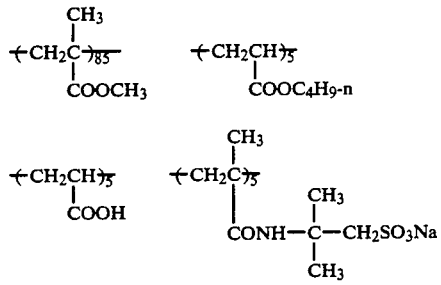
LP - 13
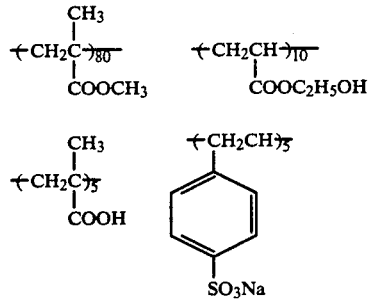
LP - 14
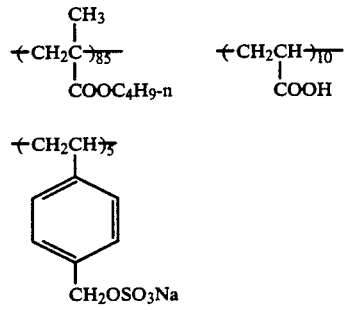

-continued

LP - 15

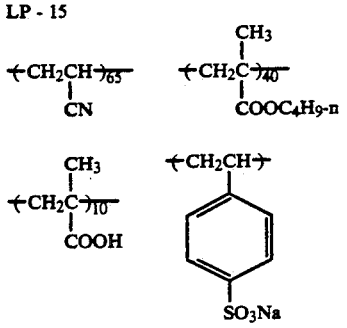

The conductive polymer contained in the above gelatin layer and non-gelatin layer may the same or different, but the following conductive polymers may preferably be used in each layer.

The conductive polymer contained in the non-gelatin layer used in this invention, i.e., an upper subbing layer containing no gelatin is preferably a conductive copolymer (i) having either of a sulfonic acid group and a sulfuric acid ester group and (ii) further having at least one group selected from a hydroxyl group, an amino group, an active methylene group and a sulfinic acid group.

The conductive polymer contained in the gelatin layer used in this invention is a conductive polymer having at least one sulfonic acid or substituted alkylsulfonic acid group or a sulfuric acid ester group on an aromatic or heterocyclic ring, and may preferably be those having a molecular weight ranging from 5,000 to 1,000,000. Preferred examples of the aromatic ring of this invention include a benzene ring and a naphthalene ring. Conductive polymers more preferably used are those not only containing the sulfonic acid group but also having a hydroxyalkyl acrylate component.

Preferred examples of the heterocyclic ring of the conductive polymer used in this invention may include a pyridine ring, a pyrrolidine ring, a carbazole ring, a pyrrole ring, a thiophene ring, a furan ring, and an indole ring. The sulfonic acid group may include an alkylsulfonic acid group or substituted alkylsulfonic acid group having 1 to 16 carbon atoms.

The bonding group for these sulfonic acid group and heterocyclic group may be any of those belonging to divalent bonding groups constituted of any of a carbon atom, a nitrogen atom, a sulfur atom, an oxygen atom and a phosphorus atom. The conductive polymer used in this invention may be contained in an amount of from 0.01 to 5 g, and preferably from 0.05 to 1 g, per 1 $m^2$ of the light-sensitive material in both the gelatin layer and the non-gelatin layer.

Homopolymers, copolymers and terpolymers are listed below as typical examples of the conductive polymer contained in the gelatin layer and non-gelatin layer of this invention, but by no means limited to these.

(1)

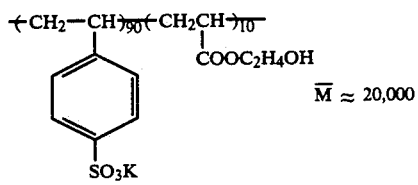

$\overline{M} \approx 20{,}000$ (2)

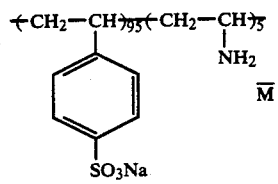

$\overline{M} \approx 200{,}000$ (3)

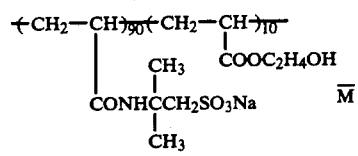

$\overline{M} \approx 300{,}000$ (4)

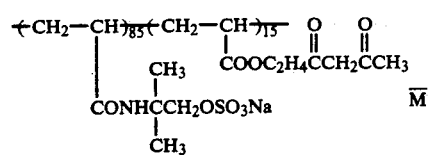

$\overline{M} \approx 500{,}000$ (5)

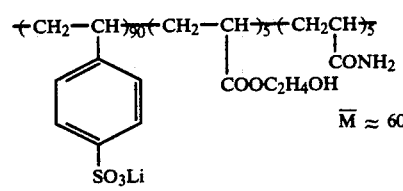

$\overline{M} \approx 600{,}000$

-continued
(6)
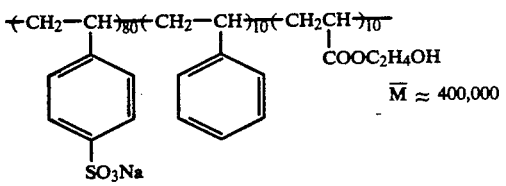
$\overline{M} \approx 400{,}000$
(7)
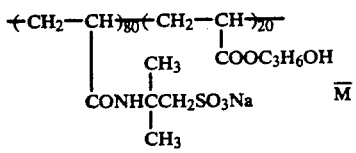
$\overline{M} \approx 600{,}000$
(8)
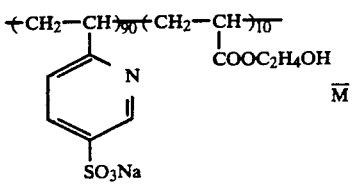
$\overline{M} \approx 150{,}000$
(9)
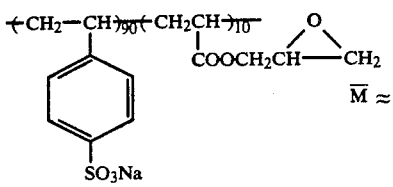
$\overline{M} \approx 70{,}000$
(10)
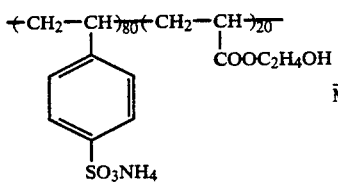
$\overline{M} \approx 500{,}000$
(11)
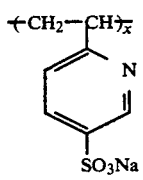
$\overline{M} \approx 100{,}000$
(12)
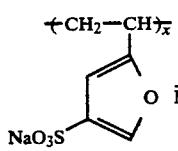
$\overline{M} \approx 200{,}000$
(13)
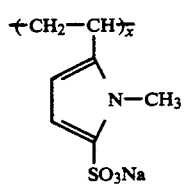
$\overline{M} \approx 200{,}000$
(14)
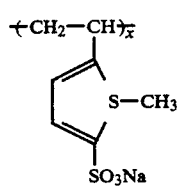
$\overline{M} \approx 150{,}000$ -continued
(15)
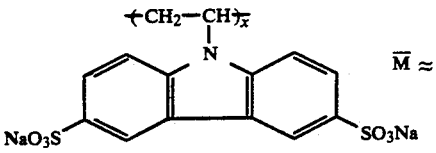
$\overline{M} \approx 300{,}000$
(16)
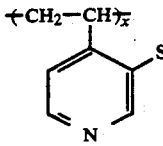
$\overline{M} \approx 280{,}000$
(17)
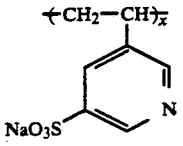
$\overline{M} \approx 450{,}000$
(18)
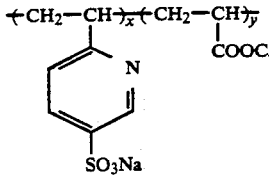
x:y = 60:40
$\overline{M} \approx 800{,}000$
(19)
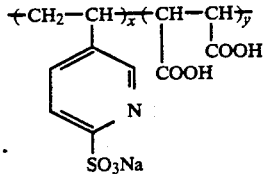
x:y = 70:30
$\overline{M} \approx 650{,}000$
(20)
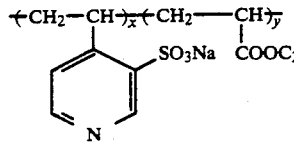
x:y = 80:20
$\overline{M} \approx 500{,}000$
(21)
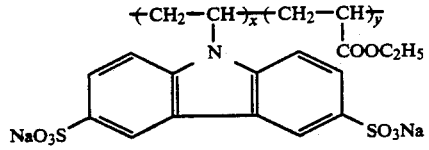
x:y = 75:25
$\overline{M} \approx 400{,}000$
(22)
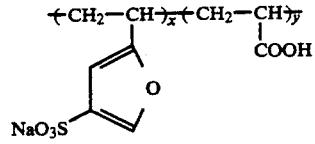
x:y = 80:20
$\overline{M} = 600{,}000$
(23)
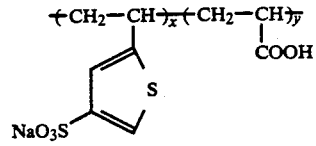
x:y = 90:10
$\overline{M} \approx 400{,}000$
(24)
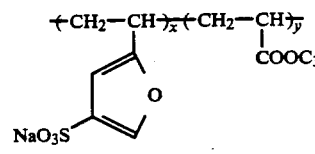
x:y = 55:45
$\overline{M} \approx 320{,}000$ -continued
(25)
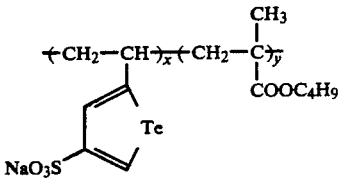
x:y = 90:10
$\overline{M} \approx 600{,}000$
(26)
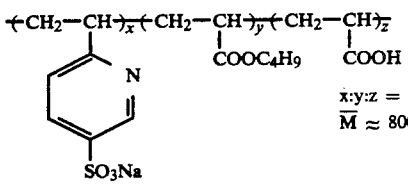
x:y:z = 80:10:10
$\overline{M} \approx 800{,}000$
(27)
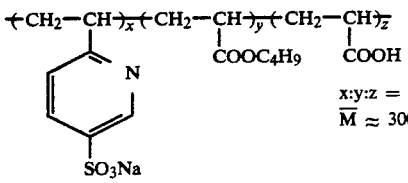
x:y:z = 70:25:5
$\overline{M} \approx 300{,}000$
(28)
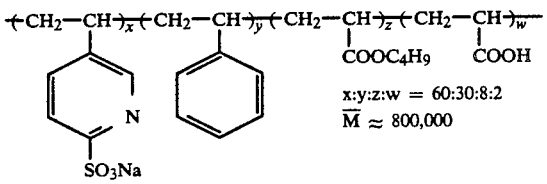
x:y:z:w = 60:30:8:2
$\overline{M} \approx 800{,}000$
(29)
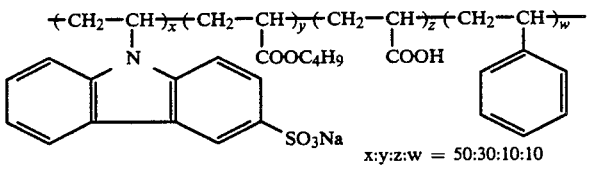
x:y:z:w = 50:30:10:10
$\overline{M} \approx 600{,}000$
(30)
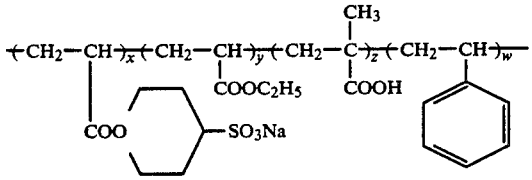
x:y:z:w = 40:30:20:10
$\overline{M} \approx 500{,}000$
(31)
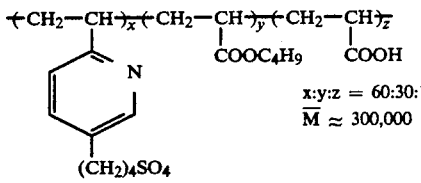
x:y:z = 60:30:10
$\overline{M} \approx 300{,}000$
(32)
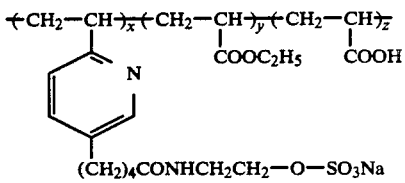
x:y:z = 40:30:30
$\overline{M} \approx 500{,}000$ -continued (33)

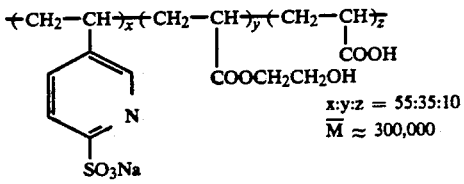

x:y:z = 55:35:10
$\overline{M} \approx 300,000$ (34)

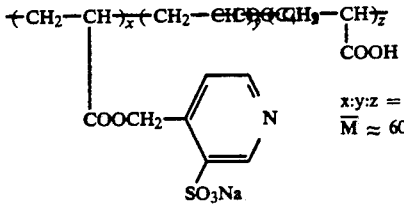

x:y:z = 50:30:20
$\overline{M} \approx 600,000$ (35)

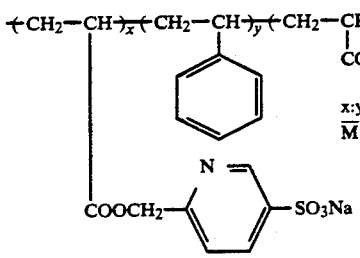

x:y:z = 60:30:10
$\overline{M} \approx 600,000$ (36)

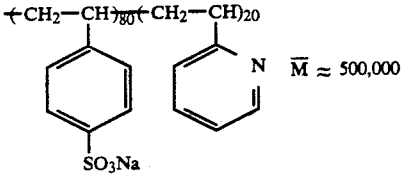

$\overline{M} \approx 500,000$ (37)

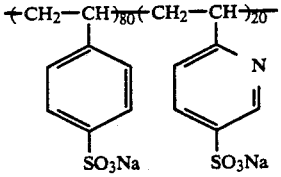

$\overline{M} \approx 600,000$ (38)

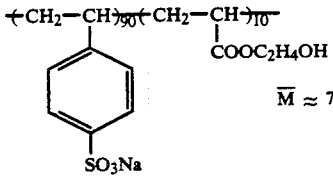

$\overline{M} \approx 700,000$ (39)

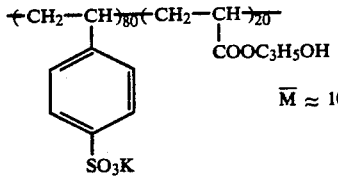

$\overline{M} \approx 10,000$ (40)

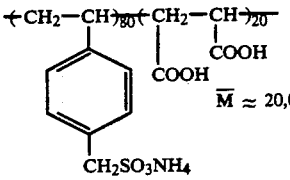

$\overline{M} \approx 20,000$

The light-sensitive silver halide photographic material used in this invention is provided by coating on a transparent support. The transparent support comprises polyethylene terephthalate or cellulose triacetate so prepared as to transmit substantially 90% or more of visible light.

These transparent supports are prepared according to the methods well known to those skilled in the art. In some instances, however, they may be subjected to bluing with the addition of a dye in a small amount that may not substantially obstruct the transmission of light.

The support used in this invention is subjected to corona discharge treatment, and thereafter provided by coating with a subbing layer containing the latex polymer. In the corona discharge treatment, an energy value of from 1 mW to 1 kW/m$^2$·min may particularly preferably be applied. Also particularly preferably the corona discharge treatment should be again carried out after the latex subbing layer has been provided.

The light-sensitive silver halide photographic material used in this invention may preferably contain a hydrazine compound and/or a tetrazolium compound.

The hydrazine compound used in this invention may preferably be a compound represented by the following Formula (IV).

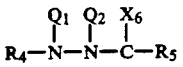

Formula (IV)

In the formula, $R_4$ represents a monovalent organic residual group; $R_5$ represents a hydrogen atom or a monovalent organic residual group; $Q_1$ and $Q_2$ each represent a hydrogen atom, an alkylsulfonyl group (including a group having a substituent), an arylsulfonyl group (including a group having a substituent); and $X_6$ represents an oxygen atom or a sulfur atom. Of the compound represented by Formula (IV), more preferred is a compound wherein $X_6$ is an oxygen atom and also $R_5$ is a hydrogen atom.

The monovalent organic residual group represented by the above $R_4$ and $R_5$ includes an aromatic residual group, a heterocyclic residual group and an aliphatic residual group.

The aromatic residual group includes a phenyl group and a naphthyl group, these of which may have a substituent as exemplified by an alkyl group, an alkoxy group, an acylhydrazino group, a dialkylamino group, an alkoxycarbonyl group, a cyano group, a carboxyl group, a nitro group, an alkylthio group, a hydroxy group, a sulfonyl group, a carbamoyl group, a halogen atom, an acylamino group, a sulfonamido group, a urea group, and a thiourea group. Examples of those having the substituent include a 4-methylphenyl group, 4-ethylphenyl group, 4-oxyethylphenyl group, 4-dodecylphenyl group, 4-carboxyphenyl group, 4-diethylaminophenyl group, 4-octylaminophenyl group, 4-benzylaminophenyl group, 4-acetoamido-2-methylphenyl group, 4-(3-ethylthioureido)phenyl group, 4-[2-(2,4-di-tert-butylphenoxy)butylamido]phenyl group, etc.

The heterocyclic residual group includes a single ring or condensed ring of 5 or 6 members, having at least one of an oxygen atom, a nitrogen atom, a sulfur atom and a selenium atom, these of which may have a substituent. It specifically includes, for example, residual groups of a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

These heterocyclic rings may be substituted with an alkyl group having 1 to 4 carbon atoms, such as a methyl group and an ethyl group, an alkoxy group having 1 to 4 carbon atoms, such as a methoxy group and an ethoxy group, an aryl group having 6 to 18 carbon atoms, such as a phenyl group, a halogen atom such as chlorine and bromine, an alkoxycarbonyl group, a cyano group, or an amino group.

The aliphatic residual group includes a straight-chain or branched alkyl group and a cycloalkyl group, these of which may have a substituent, and an alkenyl group and an alkynyl group.

The straight-chain or branched alkyl group includes, for example, an alkyl group having 1 to 18 carbon atoms, and preferably 1 to 8 carbon atoms, specifically including, for example, a methyl group, an ethyl group, an isobutyl group, and a 1-octyl group.

The cycloalkyl group includes, for example, those having 3 to 10 carbon atoms, specifically including, for example, a cyclopropyl group, a cyclohexyl group, and an adamantyl group. The substituent for the alkyl group or cycloalkyl group includes an alkoxy group (as exemplified by a methoxy group, an ethoxy group, a propoxy group, and a butoxy group), an alkoxycarbonyl group, a carbamoyl group, a hydroxyl group, an alkylthio group, an amido group, an acyloxy group, a cyano group, a sulfonyl group, a halogen atom (as exemplified by chlorine, bromine, fluorine, and iodine), an aryl group (as exemplified by a phenyl group, a halogen-substituted phenyl group, and an alkyl-substituted phenyl group). Examples of those having the substituent may include a 3-methoxypropyl group, an ethoxycarbonylmethyl group, a 4-chlorocyclohexyl group, a benzyl group, a p-methylbenzyl group, and a p-chlorobenzyl group. The alkenyl group may include, for example, an allyl group, and the alkynyl group, for example, a propargyl group.

Preferred examples of the hydrazine compound used in this invention are shown below, but this invention is by no means limited by these.

(IV-1); 1-Formyl-2-{4-[2-(2,4-di-tert-butylphenoxy) butylamido]phenyl}hydrazine
(IV-2): 1-Formyl-2-(4-diethylaminophenyl)hydrazine
(IV-3): 1-Formyl-2-(p-tolyl)hydrazine
(IV-4): 1-Formyl-2-(4-ethylphenyl)hydrazine
(IV-5): 1-Formyl-2-(4-acetamido-2-methylphenyl) hydrazine
(IV-6): 1-Formyl-2-(4-oxyethylphenyl)hydrazine
(IV-7): 1-Formyl-2-(4-N,N-dihydroxyethylaminophenyl) hydrazine
(IV-8): 1-Formyl-2-[4-(3-ethylthioureido)phenyl]hydrazine
(IV-9): 1-Thioformyl-2-{4-[2-(2,4-di-tert-butylphenoxy) butylamido]phenyl}hydrazine
(IV-10): 1-Formyl-2-(4-benzylaminophenyl)hydrazine
(IV-11): 1-Formyl-2-(4-octylaminophenyl)hydrazine
(IV-12): 1-Formyl-2-(4-dodecylphenyl)hydrazine
(IV-13): 1-Acetyl-2-{4-[2-(2,4-di-tert-butylphenoxy) butylamido]phenyl}hydrazine
(IV-14): 4-Carboxyphenylhydrazine
(IV-15): 1-Acetyl-1-(4-methylphenylsulfonyl)-2-phenylhydrazine
(IV-16): 1-Ethoxycarbonyl-1-(4-methylphenylsulfonyl)-2-phenylhydrazine
(IV-17): 1-Formyl-2-(4-hydroxyphenyl)-2-(4-methylphenylsulfonyl)-hydrazine
(IV-18): 1-(4-Acetoxyphenyl)-2-formyl-1-(4-methylphenylsulfonyl)-hydrazine (IV-19): 1-Formyl-2-(4-hexanoxyphenyl)-2-(4-methylphenylsulfonyl)-hydrazine (IV-20): 1-Formyl-2-[4-tetrahydro-2H-pyran-2-yloxy)-phenyl]-2-(4-methylphenylsulfonyl)-hydrazine (IV-21): 1-Formyl-2-[4-(3-hexylureidophenyl)]-2-(4-methylphenylsulfonyl-hydrazine (IV-22): 1-Formyl-2-(4-methylphenylsulfonyl)-2-[4-phenoxythiocarbonylamino-phenyl)]-hydrazine (IV-23): 1-(4-ethoxythiocarbonylaminophenyl)-2-formyl-1-(4-methylphenylsulfonyl)-hydrazine (IV-24): 1-Formyl-2-(4-methylphenylsulfonyl)-2-[4-(3-methyl-3-phenyl-2-thioureido)-phenyl)]-hydrazine (IV-25): 1-{{4-{3-[4-(2,4-bis-t-amylphenoxy)-butyl-]ureido}-phenyl}}-2-formyl-1-(4-methylphenylsulfonyl)-hydrazine (IV-26)

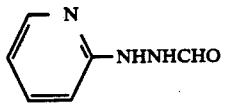

(IV-27)

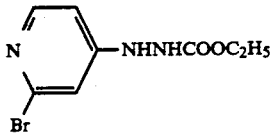

(IV-28)

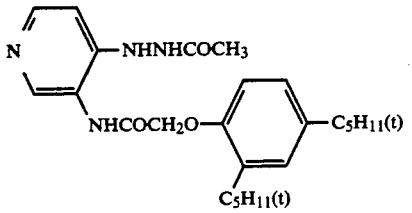

(IV-29)

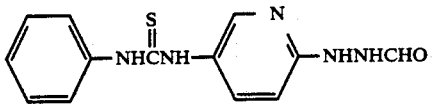

(IV-30)

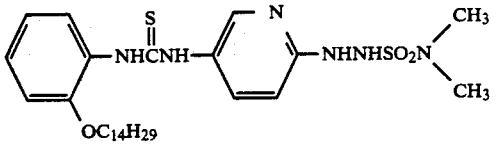

(IV-31)

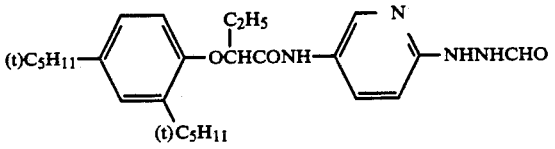

(IV-32)

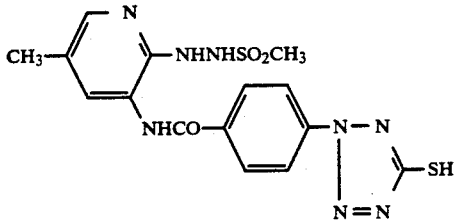

(IV-33)

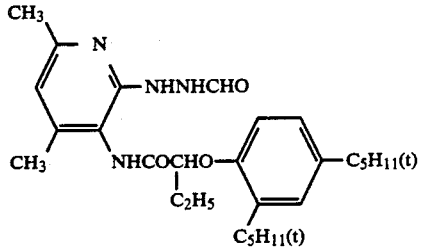

-continued
(IV-34)
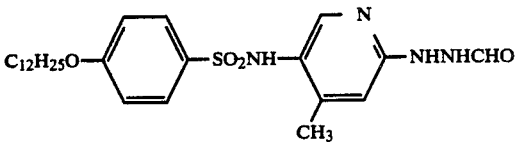
(IV-35)
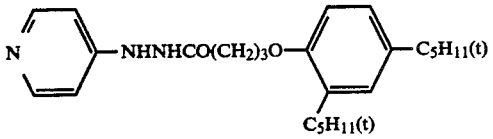
(IV-36)
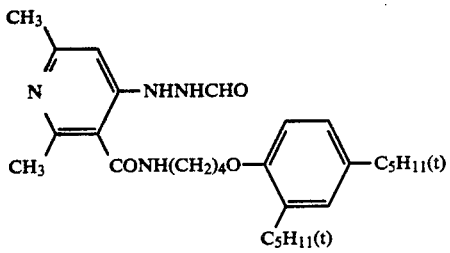
(IV-37)
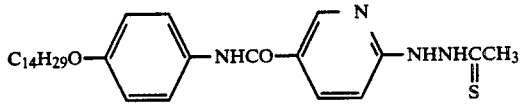
(IV-38)
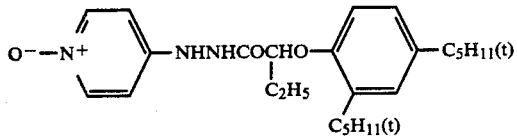
(IV-39)
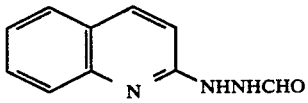
(IV-40)
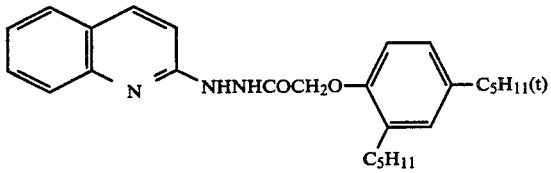
(IV-41)
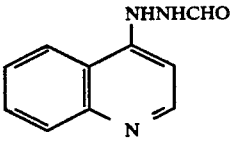
(IV-42)
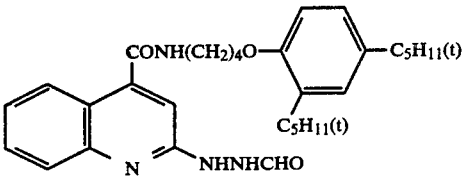
(IV-43)
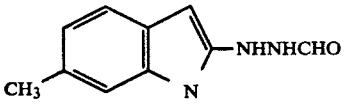

-continued
(IV-44)
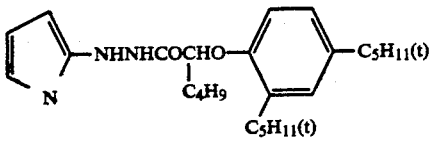
(IV-45)
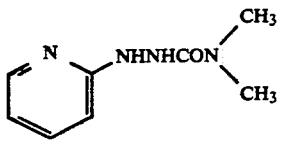
(IV-46)
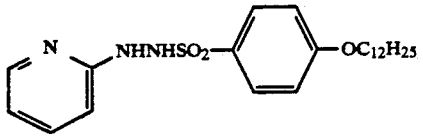
(IV-47)
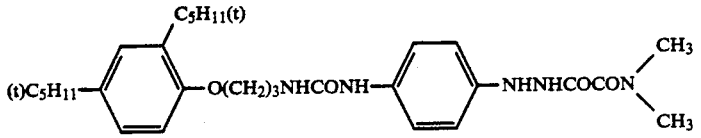
(IV-48)
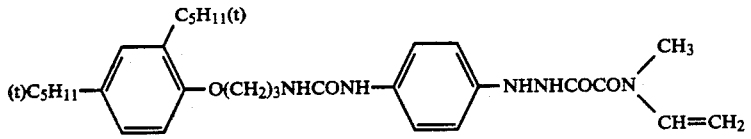
(IV-49)
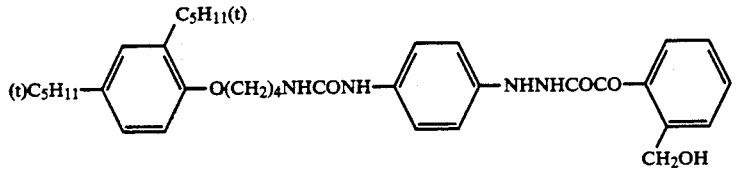
(IV-50)
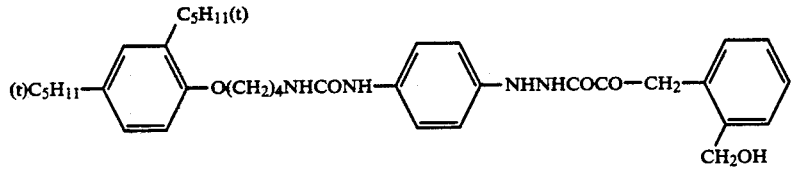
(IV-51)
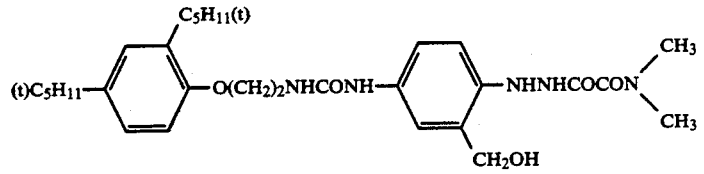
(IV-52)
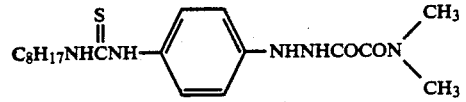
(IV-53)
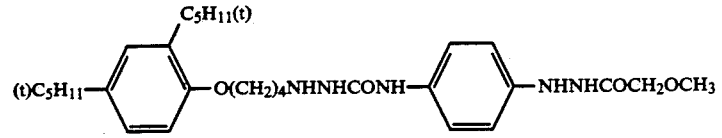

-continued
(IV-54)
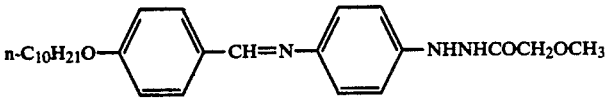
(IV-55)
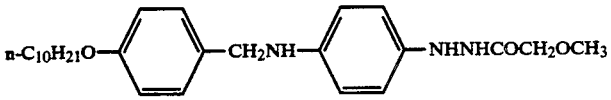
(IV-56)
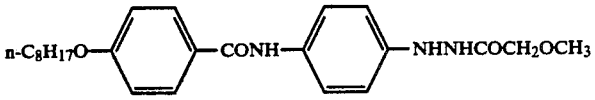
(IV-57)
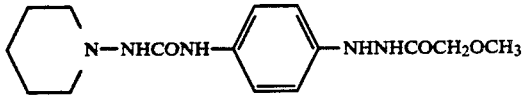
(IV-58)
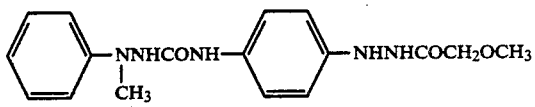
(IV-59)
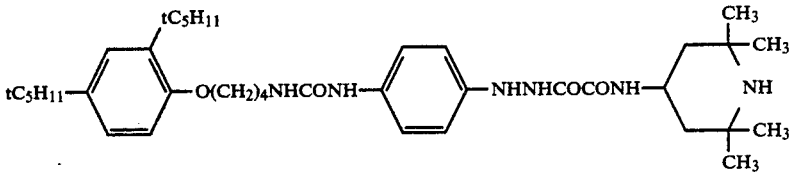
(IV-60)
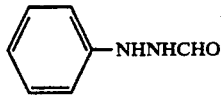
(IV-61)
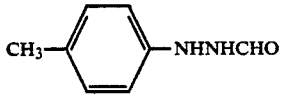
(IV-62)
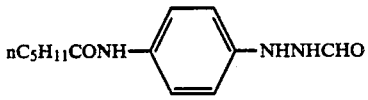
(IV-63)
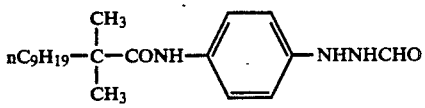
(IV-64)
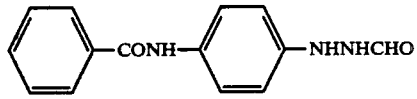
(IV-65)
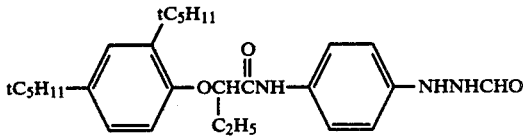
(IV-66)
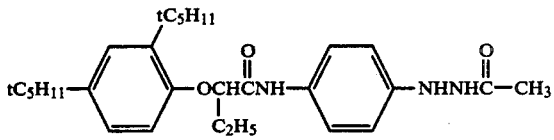

-continued (IV-67)

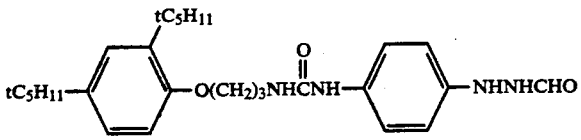

(IV-68)

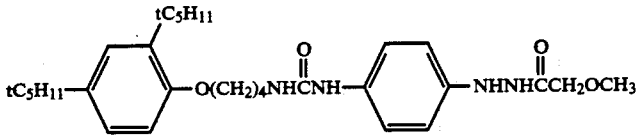

(IV-69)

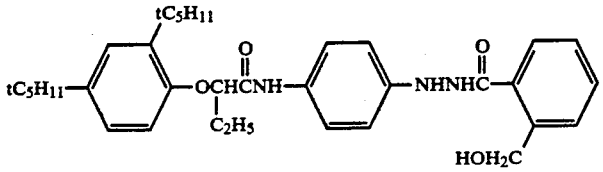

(IV-70)

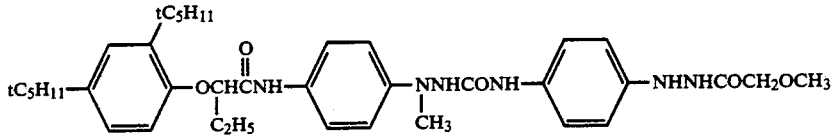

(IV-71)

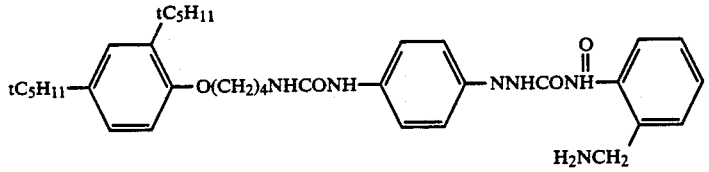

The position(s) in which the hydrazine compound represented by Formula (IV) is added is/are the silver halide emulsion layer and/or a non-light-sensitive layer present on the side on which the silver halide emulsion layer is provided on the support, and preferably the silver halide emulsion layer and/or a lower layer thereof. The compound may preferably be added in an amount of from $10^{-5}$ to $10^{-1}$ mol per mol of silver halide, and more preferably from $10^{-4}$ to $10^{-2}$ mol per mol of silver halide.

The tetrazolium compound used in this invention will be described below.

The tetrazolium compound can be represented by the following Formula (Va), (Vb) or (Vc).

Formula (Va)

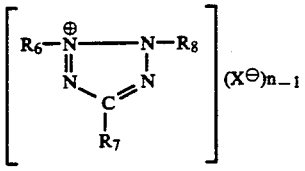

Formula (Vb)

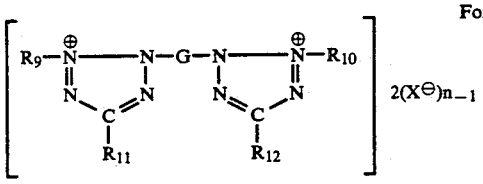

-continued

Formula (Vc)

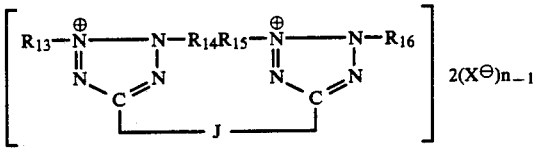

In the formulas, $R_6$, $R_8$, $R_9$, $R_{10}$, $R_{13}$, $R_{14}$, $R_{15}$ and $R_{16}$ each represent a group selected from an alkyl group as exemplified by a methyl group, an ethyl group, a propyl group and a dodecyl group, an alkenyl group as exemplified by a vinyl group, an allyl group and a propenyl group, an aryl group as exemplified by a phenyl group, a tolyl group, a hydroxyphenyl group, a carboxyphenyl group, an aminophenyl group, a mercaptophenyl group, α-naphthyl group, β-naphthyl group, a hydroxynaphthyl group, a carboxynaphthyl group and an aminonaphthyl group, and a heterocyclic group as exemplified by a thiazolyl group, a benzothiazolyl group, an oxazolyl group, a pyrimidinyl group and a pyridyl group. These may all be the groups that form a metal chelate or complex.

$R_7$, $R_{11}$ and $R_{12}$ each represent a group selected from an allyl group, a phenyl group which may have a substituent, a naphthyl group which may have a substituent, a heterocyclic group, an alkyl group as exemplified by a methyl group, an ethyl group, a propyl group, a butyl group, a mercaptomethyl group and a mercaptoethyl group, a hydroxyl group, a carboxyl group or a salt thereof, an alkoxycarbonyl group as exemplified by a methoxycarbonyl group and an ethoxycarbonyl group, an amino group as exemplified by an amino group, an ethylamino group and an anilino group, a mercapto group, a nitro group, and a hydrogen atom; G represents a divalent aromatic group; J represents a group selected from an alkylene group, an allylene group and an aralkylene group; $X^{\ominus}$ represents an anion; and n represents an integer of 1 or 2, provided that n is 1 when the compound forms an internal salt. Examples of the tetrazolium compound represented by the above Formula (Va), (Vb) or (Vc) are shown below. This invention, however, is by no means limited only to these.

(V-1): 2-(Benzothiazol-2-yl)-3-phenyl-5-dodecyl-2H-tetrazolium
(V-2): 2,3-Diphenyl-5-(4-t-octyloxyphenyl)-2H-tetrazolium
(V-3): 2,3,5-Triphenyl-2H-tetrazolium
(V-4): 2,3,5-Tri(p-carboxyethylphenyl)-2H-tetrazolium
(V-5): 2-(Benzothiazol-2-yl)3-phenyl-5-(o-chlorophenyl)-2H-tetrazolium
(V-6): 2,3-Diphenyl-2H-tetrazolium
(V-7): 2,3-Diphenyl-5-methyl-2H-tetrazolium
(V-8): 3-(p-Hydroxyphenyl)-5-methyl-2-phenyl-2H-tetrazolium
(V-9): 2,3-Diphenyl-5-ethyl-2H-tetrazolium
(V-10): 2,3-Diphenyl-5-n-hexyl-2H-tetrazolium
(V-11): 5-Cyano-2,3-diphenyl-2H-tetrazolium
(V-12): 2-(Benzothiazol-2-yl)-5-phenyl-3-(4-tolyl)-2H-tetrazolium
(V-13): 2-(Benzothiazol-2-yl)-5-(4-chlorophenyl)-3-(4-nitrophenyl)-2H-tetrazolium
(V-14): 5-Ethoxycarbonyl-2,3-di(3-nitrophenyl)-2H-tetrazolium
(V-15): 5-Acetyl-2,3-di(p-ethoxyphenyl)-2H-tetrazolium
(V-16): 2,5-Diphenyl-3-(p-tolyl)-2H-tetrazolium
(V-17): 2,5-Diphenyl-3-(p-iodophenyl)-2H-tetrazolium
(V-18): 2,3-Diphenyl-5-(p-diphenyl)-2H-tetrazolium
(V-19): 5-(p-Bromophenyl)-2-phenyl-3-(2,4,6-trichlorophenyl)-2H-tetrazolium
(V-20): 3-(p-Hydroxyphenyl)-5-(p-nitrophenyl)-2-phenyl-2H-tetrazolium
(V-21): 5-(3,4-dimethoxyphenyl)-3-(2-ethoxyphenyl)-2-(4-methoxyphenyl)-2H-tetrazolium
(V-22): 5-(4-cyanophenyl)-2,3-diphenyl-2H-tetrazolium
(V-23): 3-(p-acetamidophenyl)-2,5-diphenyl-2H-tetrazolium
(V-24): 5-Acetyl-2,3-diphenyl-2H-tetrazolium
(V-25): 5-(Furan-2-yl)-2,3-diphenyl-2H-tetrazolium
(V-26): 5-(Thiophen-2-yl)-2,3-diphenyl-2H-tetrazolium
(V-27) 2,3-Diphenyl-5-(pyrido-4-yl)-2H-tetrazolium
(V-28): 2,3-Diphenyl-5-(quinol-2-yl)-2H-tetrazolium
(V-29): 2,3-Diphenyl-5-(benzoxazol-2-yl)-2H-tetrazolium
(V-30): 2,3,5-Tri(p-ethylphenyl)-2H-tetrazolium
(V-31): 2,3,5-Tri(p-allylphenyl)-2H-tetrazolium
(V-32): 2,3,5-Tri(p-hydroxyethyloxyethoxyphenyl)-2H-tetrazolium
(V-33): 2,3,5-Tri(p-dodecylphenyl)-2H-tetrazolium
(V-34): 2,3,5-Tri(p-benzylphenyl)-2H-tetrazolium The anionic moiety represented by $X^{\ominus}$, in the above Formulas (Va) to (Vc) may include a halogen ion as exemplified by $Cl^{\ominus}$, $Br^{\ominus}$, or $I^{\ominus}$. The above examples are listed as chloride ions.

The tetrazolium compound used in this invention may be used alone or may be used in combination of two or more kinds at any desired proportion.

A preferred embodiment of this invention includes an embodiment in which the tetrazolium compound according to this invention is added in the silver halide emulsion layer. In another preferred embodiment of this invention, the tetrazolium compound is added in a non-light-sensitive hydrophilic colloid layer directly adjacent (or contiguous) to the silver halide emulsion layer, or in a non-light-sensitive hydrophilic colloid layer adjacent to the silver halide emulsion layer, interposing an intermediate layer.

In still another embodiment, the tetrazolium compound according to this invention may be incorporated into the light-sensitive material by dissolving the compound in a suitable solvent as exemplified by alcohols such as methanol and ethanol, ethers, or esters, and then directly coating the resulting solution on the part that may serve as the outermost layer on the silver halide emulsion layer side of the light-sensitive material according to the overcoat method.

The tetrazolium compound according to this invention may preferably be used in an amount ranging from $1\times10^{6}$ to 10 moles, and particularly preferably from $2\times10^{-4}$ to $2\times10^{-1}$ mole, per mol of the silver halide contained in the light-sensitive material of this invention.

The first preferred embodiment of this invention will be described below in detail.

The water-soluble polymer used in this embodiment has a repeating unit represented by the following Formula (I).

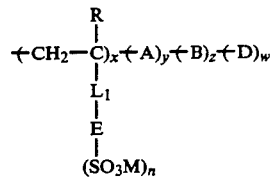

Formula (I)

In the formula, R represents a hydrogen atom, a halogen atom, or an alkyl group; A, B and D each represent a monomer unit different from each other, copolymerized with copolymerizable ethylenically unsaturated monomers containing a carboxyl group or an ester derivative thereof or a halogen atom; x is 10 to 100 mol %, y is 0 to 90 mol %, z is 0 to 20 mol %, and w is 0 to 10 mol %.

E represents a mere bonding group, or a divalent bonding group constituted of any of a carbon atom, a nitrogen atom, a sulfur atom, an oxygen and a phosphorus atom; L represents a benzene ring, or a heterocyclic ring; and M represents a hydrogen atom, an ammonium cation, or an alkali metal ion. n is 1 or 2.

The molecular weight may preferably range from 5,000 to 1,000,000, and particularly preferably 10,000 to 500,000. Preferred examples of the heterocyclic ring in this invention include a pyridine ring, a pyrrolidine ring, a carbazole ring, a pyrrole ring, a thiophene ring, a furan ring, and an indole ring.

These polymers are commercially available or can be synthesized by polymerizing monomers according to a conventional method. Examples of the compound represented by Formula (I) are shown below.

I-1

Homopolymer

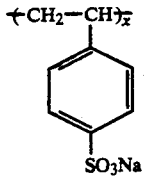

$\overline{M} \approx 600{,}000$

I-2

Homopolymer

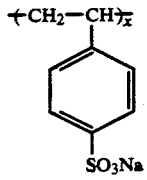

$\overline{M} \approx 700{,}000$

I-3

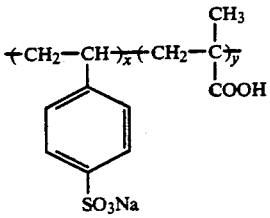

x:y = 98.5:1.5
$\overline{M} \approx 750{,}000$

I-4

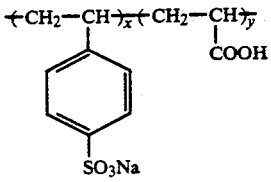

x:y = 97:3
$\overline{M} \approx 800{,}000$

I-5

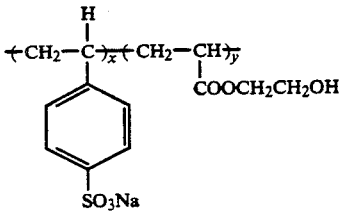

x:y = 90:10
$\overline{M} \approx 950{,}000$

I-6

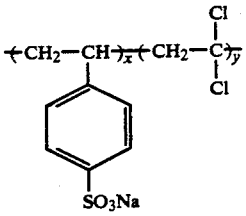

x:y = 97:3
$\overline{M} \approx 300{,}000$

I-7

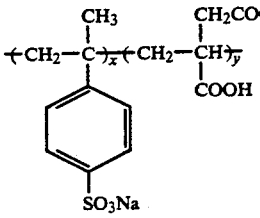

x:y = 98:2
$\overline{M} \approx 200{,}000$

-continued

I-8

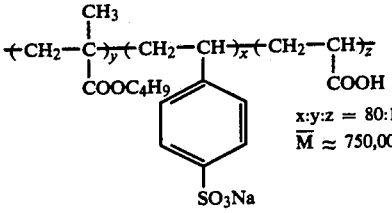

x:y:z = 80:19:1
$\overline{M} \approx 750{,}000$

I-9

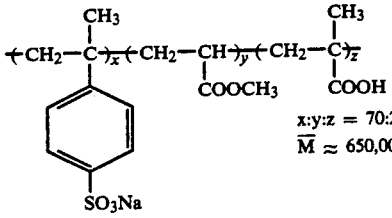

x:y:z = 70:28:2
$\overline{M} \approx 650{,}000$

I-10

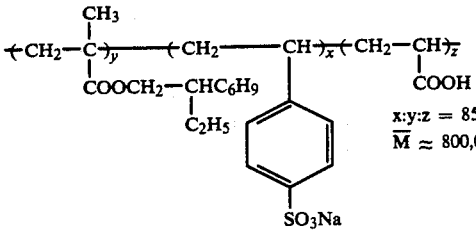

x:y:z = 85:13:2
$\overline{M} \approx 800{,}000$

I-11

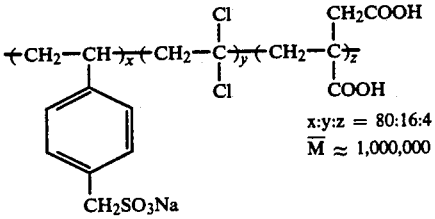

x:y:z = 80:16:4
$\overline{M} \approx 1{,}000{,}000$

I-12

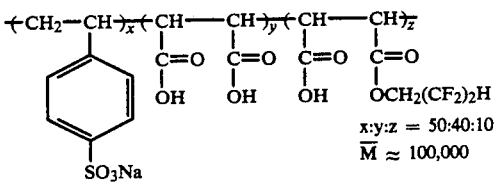

x:y:z = 50:40:10
$\overline{M} \approx 100{,}000$

I-13

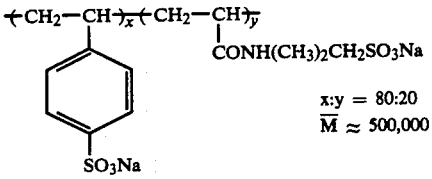

x:y = 80:20
$\overline{M} \approx 500{,}000$

I-14

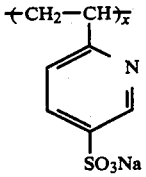

$\overline{M} \approx 100{,}000$

I-15

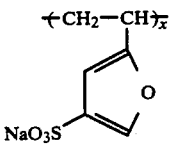

$\overline{M} \approx 200{,}000$

-continued

I-16

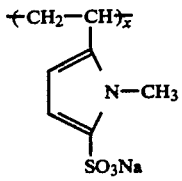

$\overline{M} \approx 200,000$

I-17

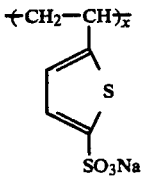

$\overline{M} \approx 150,000$

I-18

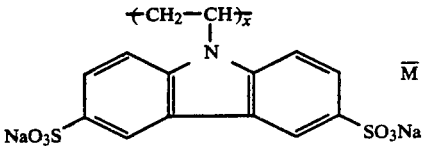

$\overline{M} \approx 300,000$

I-19

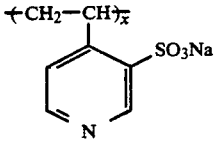

$\overline{M} \approx 280,000$

I-20

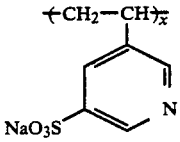

$\overline{M} \approx 450,000$

I-21

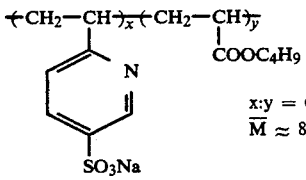

x:y = 60:40
$\overline{M} \approx 800,000$

I-22

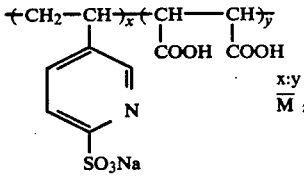

x:y = 70:30
$\overline{M} \approx 650,000$

I-23

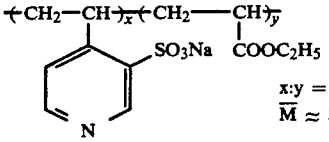

x:y = 80:20
$\overline{M} \approx 500,000$

I-24

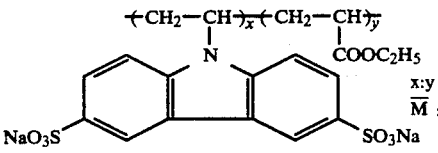

x:y = 75:25
$\overline{M} \approx 400,000$

-continued

I-25

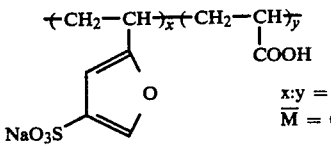

x:y = 80:20
$\overline{M} = 600,000$

I-26

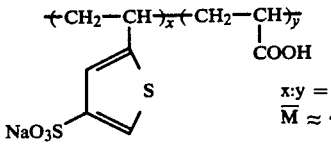

x:y = 90:10
$\overline{M} \approx 400,000$

I-27

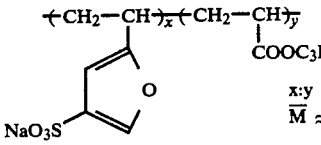

x:y = 55:45
$\overline{M} \approx 320,000$

I-28

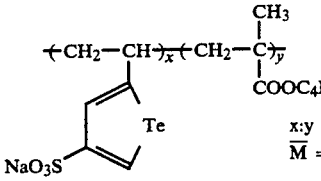

x:y = 90:10
$\overline{M} = 600,000$

I-29

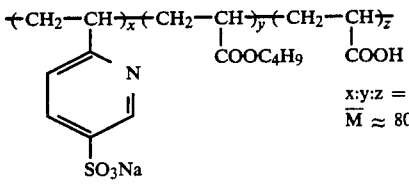

x:y:z = 80:10:10
$\overline{M} \approx 800,000$

I-30

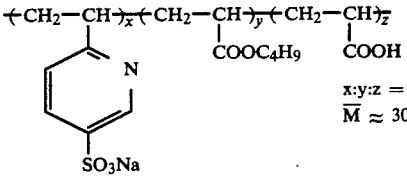

x:y:z = 70:25:5
$\overline{M} \approx 300,000$

I-31

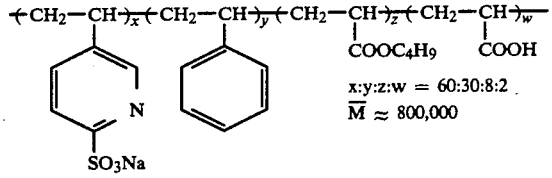

x:y:z:w = 60:30:8:2
$\overline{M} \approx 800,000$

I-32

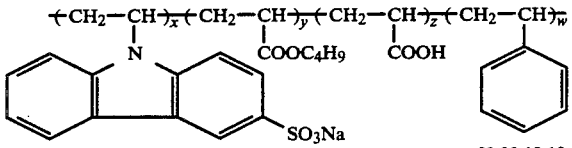

x:y:z:w = 50:30:10:10
$\overline{M} \approx 600,000$

I-33

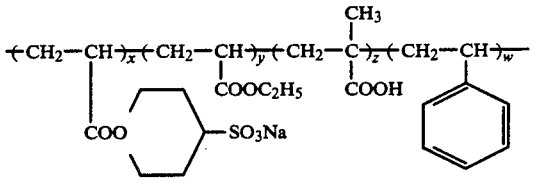

x:y:z:w = 40:30:20:10
$\overline{M} \approx 500,000$

-continued

I-34

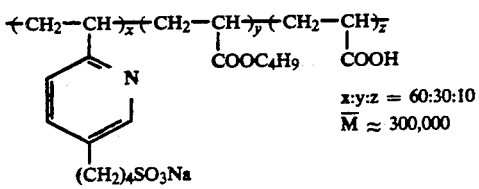

x:y:z = 60:30:10
$\overline{M} \approx 300,000$

I-35

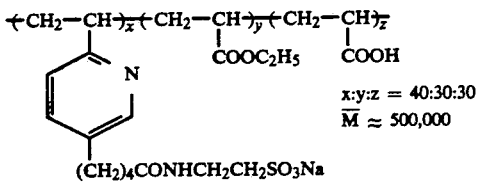

x:y:z = 40:30:30
$\overline{M} \approx 500,000$

I-36

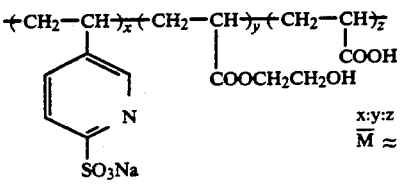

x:y:z = 55:35:10
$\overline{M} \approx 300,000$

I-37

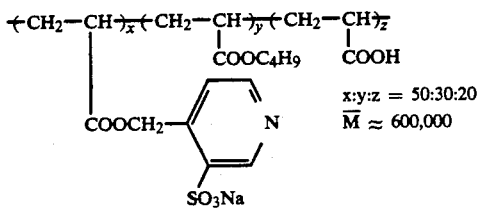

x:y:z = 50:30:20
$\overline{M} \approx 600,000$

I-38

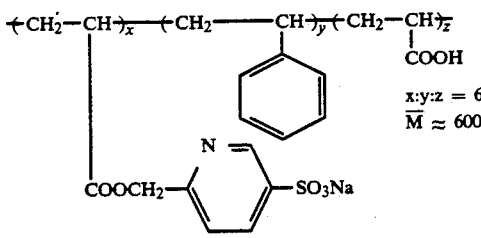

x:y:z = 60:30:10
$\overline{M} \approx 600,000$

In the above compounds (I-1) to (I-38), x, y and w each represent mol % of the monomer component, and $\overline{M}$ represents an average molecular weight. (In the present specification, the average molecular weight refers to the number-average molecular weight.)

These polymers are commercially available or can be synthesized by polymerizing monomers according to a conventional method. These compounds may preferably be added in an amount of from 0.01 g to 5 g/m$^2$, and particularly preferably from 0.05 g to 1 g/m$^2$ of the light-sensitive material.

These compounds, using alone or as a mixture with various types of a hydrophilic binder or hydrophobic binder, can be formed into a layer. Particularly advantageously used as the hydrophilic binder is gelatin or polyacrylamide. Other binders include colloidal albumin, cellulose acetate, cellulose nitrate, polyvinyl alcohol, hydrolyzed polyvinyl acetate, and phthalated gelatin. The hydrophobic binder includes polymers having a molecular weight of from 5,000 to 1,000,000 or more, including a styrene/butyl acrylate/acrylic acid terpolymer, a butyl acrylate/acrylonitrile/acrylic acid terpolymer, and a methyl methacrylate/ethyl acrylate/acrylic acid terpolymer.

Next, the compound capable of binding with a calcium ion and/or a magnesium ion may be any of the compounds capable of forming a complex with the calcium ion and/or magnesium ion, and there are no particular limitations. It includes all the compounds, so-called complexing agents, which are added in developing solutions and fixing solutions. Particularly preferred are those which may be dissolved out with difficulty during processing, including a polymer of hydrolyzed maleic anhydride, as disclosed in Japanese Unexamined Patent Publication No. 165057/1984, and a cyclodextrin polymer as disclosed in Japanese Unexamined Patent Publication No. 276050/1988. These compounds may preferably be added in an amount of from $10^{-2}$ to 10 g/m$^2$, and particularly preferably from $10^{-1}$ to 5 g/m$^2$ of the light-sensitive material.

The backing dyes or dyes used for the backing layer of this invention may preferably include, for example, those represented by the following Formulas (X-a) to (X-j).

Formula (X-a)

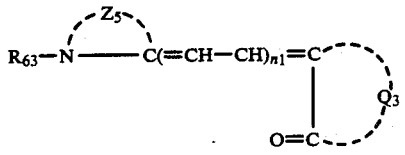

Formula (X-b)

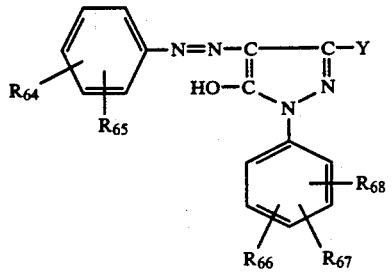

-continued
Formula (X-c)
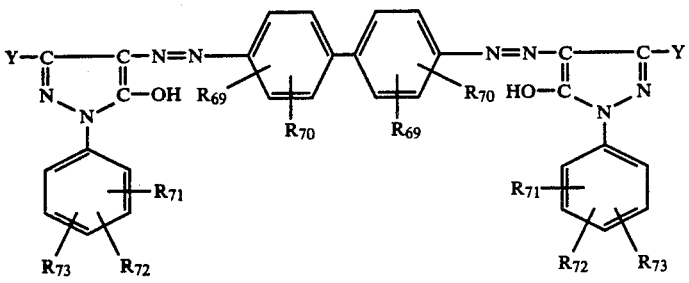
Formula (X-d)
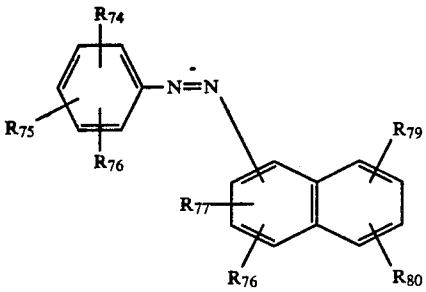
Formula (X-e)
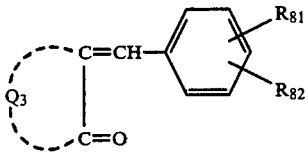
Formula (X-f)
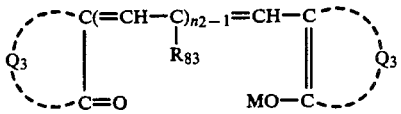
Formula (X-g)
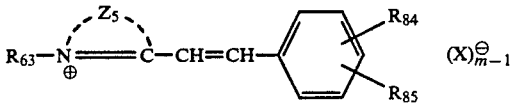
Formula (X-h)
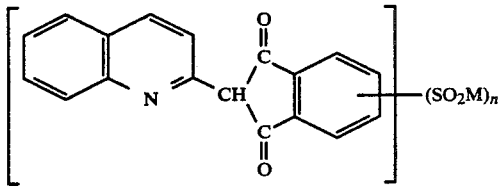
Formula (X-i)
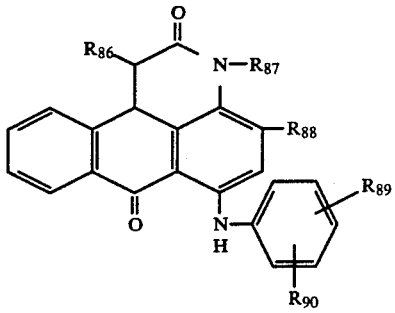

-continued

Formula (X-j)

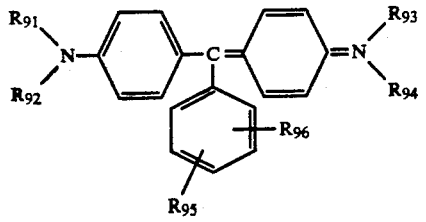

In the formula $Z_5$ represents a non-metal atom group necessary for completing a heterocyclic nucleus of benzthiazole, naphthothiazole or benzoxazole.

$Q_3$ represents an atom group necessary for completing pyrazolone, barbitalic acid, thiobarbitalic acid or 3-oxythionaphthene.

$R_{63}$ represents a substituted or unsubstituted alkyl group.

$R_{81}$, $R_{82}$, $R_{84}$ and $R_{85}$ each represent a hydrogen atom, an alkoxy group, a dialkylamino group or a sulfonic acid. $R_{83}$ represents a hydrogen atom or a halogen atom.

$R_{64}$, $R_{65}$, $R_{66}$, $R_{67}$, $R_{68}$, $R_{69}$, $R_{70}$, $R_{71}$, $R_{72}$, $R_{73}$, $R_{74}$, $R_{75}$, $R_{76}$, $R_{77}$, $R_{78}$, $R_{79}$, $R_{80}$, $R_{81}$ and $R_{82}$ each represent a hydrogen atom, a chlorine atom, an alkyl group, a hydroxyl group, an alkoxy group, an amino group, an acylamino group, a carboxyl group or a sulfone group, provided that $R_{75}$ and $R_{76}$ may combine each other to form a benzene ring.

$R_{86}$ represents a hydrogen atom, an acyl group or an alkoxycarbonyl group, $R_{87}$ represents a hydrogen atom or an alkyl group, $R_{88}$, $R_{89}$ and $R_{90}$, each represent a hydrogen atom, an alkyl group or a sulfone group, $R_{91}$, $R_{92}$, $R_{93}$ and $R_{94}$ each represent a hydrogen atom, a substituted or unsubstituted alkyl group, or a substituted or unsubstituted phenyl group.

M represents a hydrogen atom, a sodium atom or a potassium atom. X is an anion, m, $n_1$ and $n_2$ each represent 1 or 2, with proviso that X forms an internal salt when m is 1.

Y represents an alkyl group or a carboxyl group.

The backing dye of this invention should preferably contain a sulfonic acid group.

The specific dyes are exemplified hereinbelow, but this invention is by no means limited thereto.

(X-1)

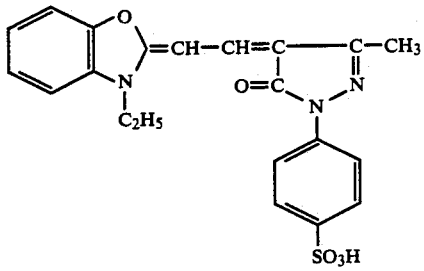

(X-2)

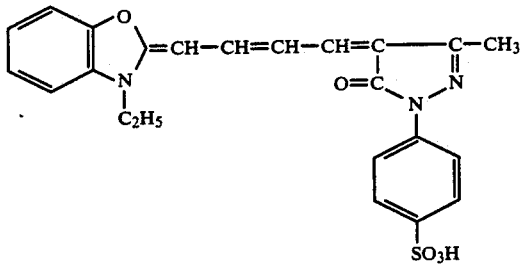

(X-3)

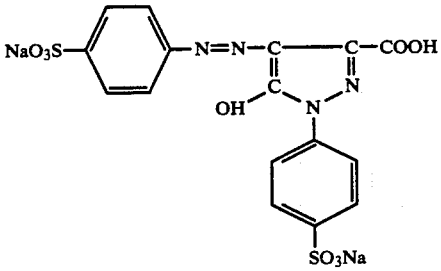

-continued
(X-4)
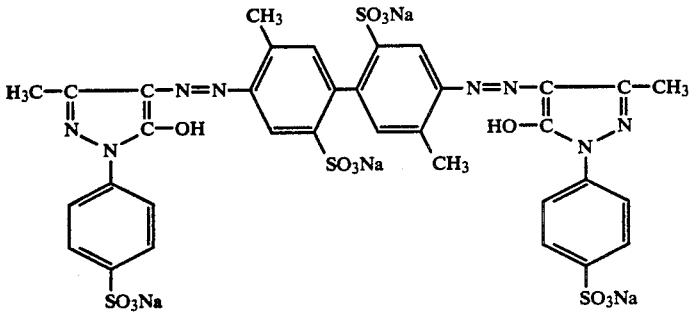
(X-5)
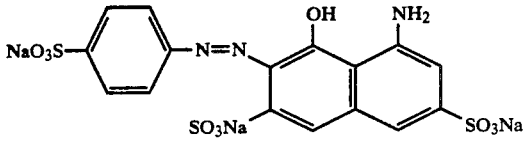
(X-6)
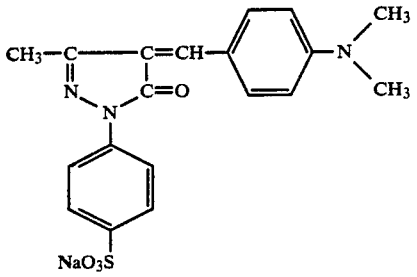
(X-7)
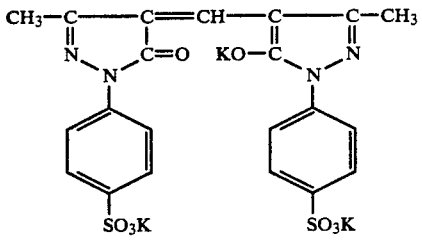
(X-8)
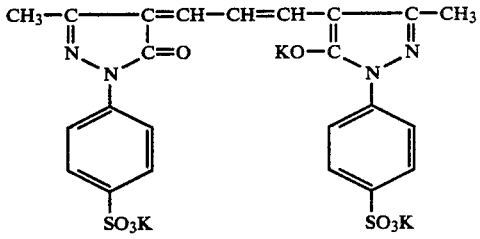
(X-9)
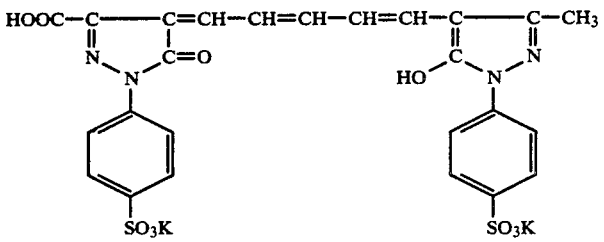

-continued (X-10)

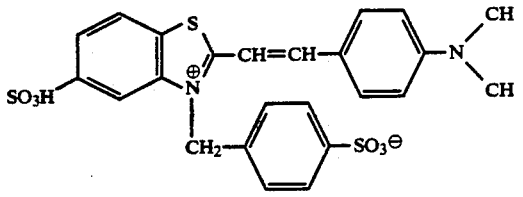

(X-11)

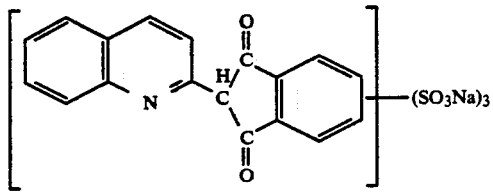

(X-12)

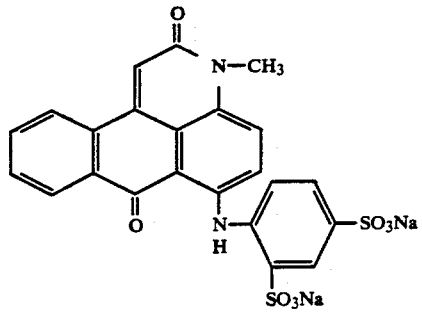

(X-13)

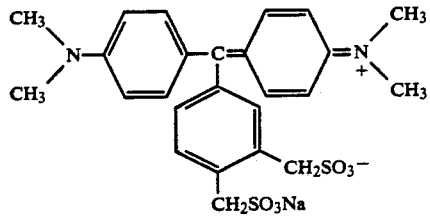

(X-14)

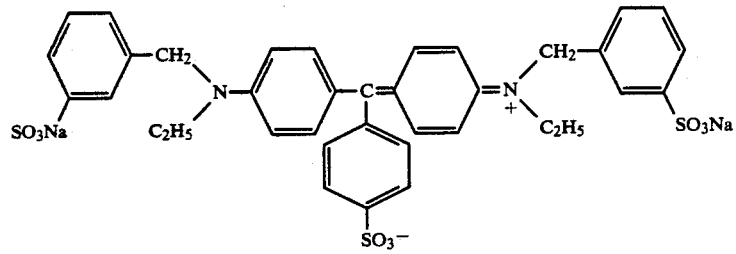

As the backing layer containing the dye of this invention, preferred is a layer comprised of a non-light-sensitive protective colloid.

The non-light-sensitive layer is provided on the opposite side of the light-sensitive layer on the support, or between the light-sensitive layer and the support, but may occasionally be provided on the both of them, wherein the both non-light-sensitive layer is controlled so that the both layers totally have a light adsorption property mentioned above. The amount of the dye of this invention should preferably be from 0.01 g to 5 g, more preferably 0.05 g to 1 g per $m^2$ of the light-sensitive material.

The second preferred embodiment of this invention will be described below. The water-soluble polymer of Formula (I) and the hydrazine compound have been already described in the above, and hence the descriptions thereon are not repeated here.

The compound of Formula (II) will be described below. Formula (II)

Formula (II)

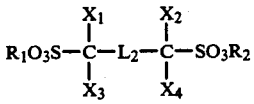

$R^1$ and $R_2$ each represent an alkyl group having 1 to 4 carbon atoms, and may different from each other. $X_1$, $X_2$, $X_3$ and $X_4$ each represents a hydrogen atom, an alkyl group having 1 to 3 carbon atoms, or a halogen atom, and may be different from each other. $L_2$ represents a mere bonding group, or an alkylene group or alkyleneoxy group having 1 to 4 carbon atoms.

Specific compounds are exemplified below.

II-1: $CH_3O_3S\text{-}CH_2\text{-}CH_2\text{-}SO_3CH_3$

II-2; $CH_3O_3S\text{-}CH_2\text{-}(CH_2)_2\text{-}CH_2SO_3CH_3$

II-3: $CH_3O_3S\text{-}CH_2\text{-}(CH_2)\text{-}O\text{-}(CH_2)_2\text{-}CH_2\text{-}SO_3CH_3$ II-4: $CH_3O_3S-\overset{Cl}{\overset{|}{CH}}-(CH_2)_4-\overset{Cl}{\overset{|}{CH}}-SO_3CH_3$ II-5: $CH_3O_3S-\overset{C_2H_5}{\overset{|}{CH}}-(CH_2)_4-CH_2SO_3CH_3$ These compounds can be synthesized making reference to the description in the specification of U.S. Pat. No. 2,726,162.

This compound may preferably be added in an amount of from $1\times10^{-3}$ to $10^2$ g/m$^2$, and particularly preferably from $1\times10^{-2}$ to 10 g/m$^2$ of the light-sensitive material.

The tetrazolium compound has been already described in the above, among which, however, a triphenyl tetrazolium compound represented by the following formula is preferred in this embodiment.

Formula (Vd)

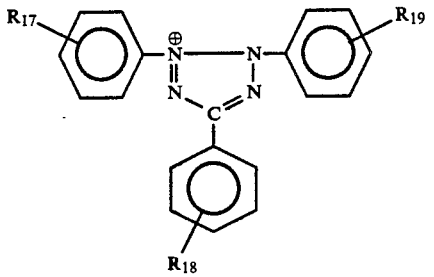

In this invention, the substituents $R_{17}$, $R_{18}$ and $R_{19}$ of the phenyl groups in the triphenyltetrazolium compound represented by the above Formula (Vd) may preferably be each a hydrogen atom or a group whose Hammett's sigma value ($\sigma P$), which shows the degree of electron attraction, is negative or positive. Particularly preferred are those in which it is negative.

The Hammett's sigma value in the phenyl substitution can be seen in a number of publications, as exemplified by C. Hansch et al's reports set out in Journal of Medical Chemistry, Vol. 20, p.304, 1977. Particularly preferred groups having the negative sigma value include, for example, a methyl group ($\sigma P = -0.17$; hereinafter all indicate the oP value), an ethyl group (−0.15), a cyclopropyl group (−0.21), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), and a pentoxy group (−0.34). These are all useful as the substituents for the compound of Formula (Vd) of this invention.

Examples of the compound of Formula (vd) used in this invention are listed below, but the compound of this invention is by no means limited to these.

(Exemplary Compounds)

Vd-1

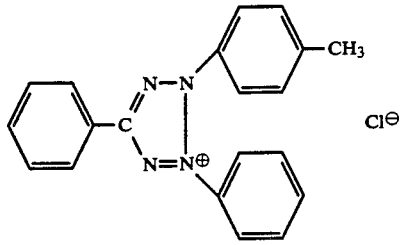

Vd-2

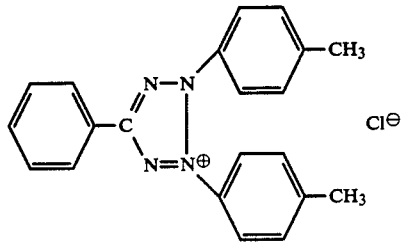

Vd-3

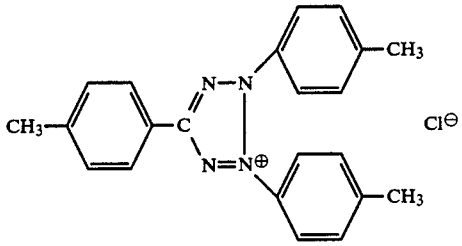

Vd-4

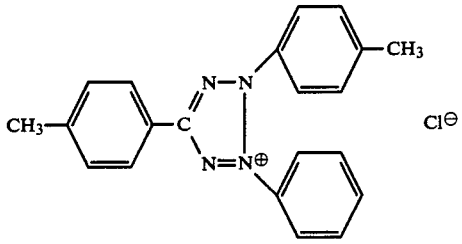

Vd-5

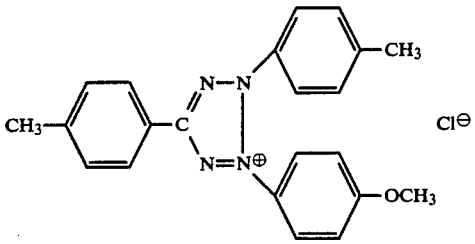

Vd-6

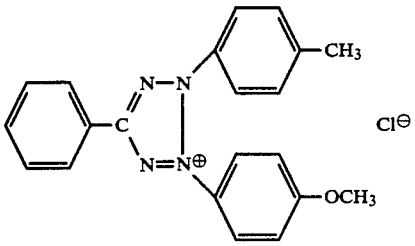

-continued
(Exemplary Compounds)
Vd-7
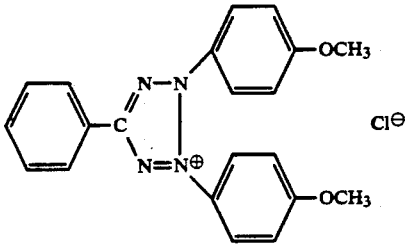
Vd-8
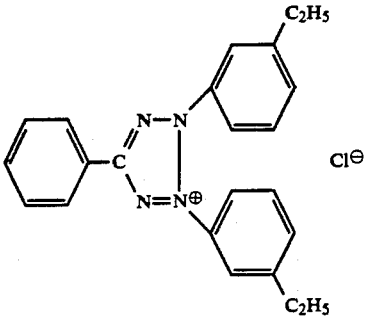
Vd-9
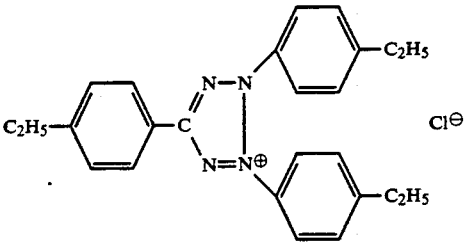
Vd-10
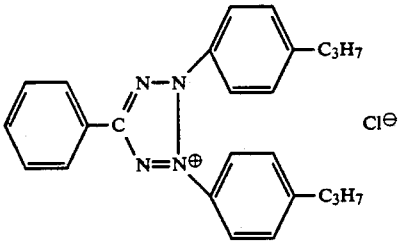
Vd-11
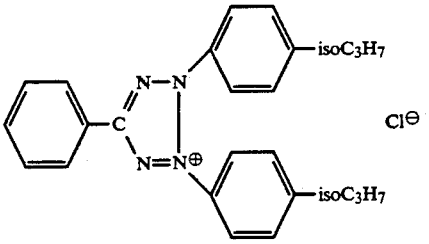
Vd-12
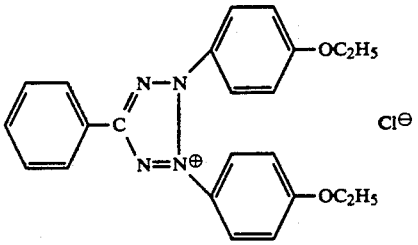
-continued
(Exemplary Compounds)
Vd-13
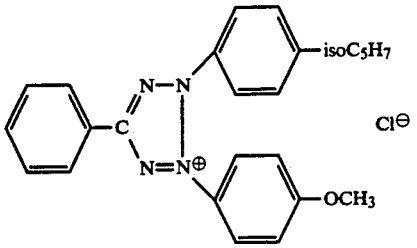
Vd-14
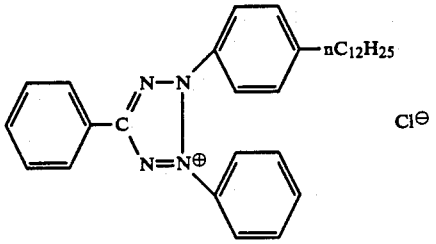
Vd-15
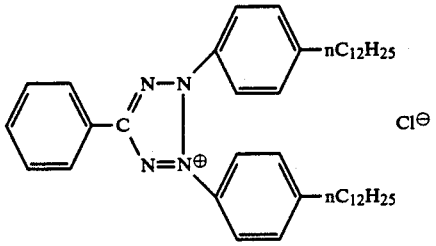
Vd-16
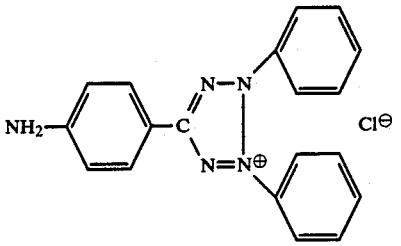
Vd-17
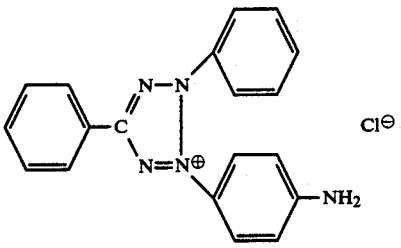
Vd-18
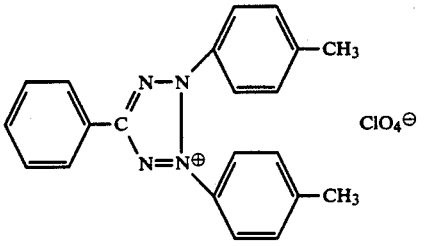

The tetrazolium compound used in this invention can be readily synthesized according to the method described in Chemical Reviews, Vol. 55, pp.335–483.

The tetrazolium compound used in this invention may preferably be used in the range of not less than about 1 mg and not more than about 10 g, and more preferably not less than about 10 mg and not more than about 2 g, per mol of the silver halide contained in the light-sensitive silver halide photographic material of this invention.

The tetrazolium compound used in this invention can obtain more desired performance even when used alone, but by no means causes deterioration of the desired performance even when plural compounds are used in combination at any proportion.

A more preferred embodiment of this invention includes an embodiment in which the tetrazolium compound according to this invention is added in the silver halide emulsion layer. In another preferred embodiment of this invention, the tetrazolium compound is added in a hydrophilic colloid layer directly adjacent (or contiguous) to the silver halide emulsion layer, or in a hydrophilic colloid layer adjacent to the silver halide emulsion layer, interposing an intermediate layer.

In still another embodiment, the tetrazolium compound according to this invention may be incorporated into the light-sensitive material by dissolving the compound in a suitable solvent as exemplified by alcohols such as methanol and ethanol, ethers, or esters, and then directly coating the resulting solution on the part that may serve as the outermost layer on the silver halide emulsion layer side of the light-sensitive material according to the overcoat method.

The third preferred embodiment of this invention will be described below. The hydrazine compound and the tetrazolium compound have been already described in the above, and hence the descriptions thereon are not repeated here.

The conductive polymer used in this embodiment, having on a heterocyclic ring at least one sulfonic acid group or substituted alkylsulfonic acid group may preferably include those having a molecular weight ranging from 5,000 to 1,000,000.

Preferred examples of the heterocyclic ring of the conductive polymer used in this embodiment may include a pyridine ring, a pyrrolidine ring, a carbazole ring, a pyrrole ring, a thiophene ring, a furan ring, and an indole ring. The sulfonic acid group may include an alkylsulfonic acid group or substituted alkylsulfonic acid group having 1 to 16 carbon atoms.

The bonding group for these sulfonic acid group and heterocyclic group may be any of those belonging to divalent bonding groups constituted of any of a carbon atom, a nitrogen atom, a sulfur atom, an oxygen atom and a phosphorus atom.

Homopolymers, copolymers and terpolymers which are typical examples of the conductive polymer used in this embodiment overlap with the exemplary compounds (1) to (40) previously described, and the descriptions are omitted here. The examples, however, are by no means limited to these.

A medium in which the monomers capable of forming the conductive polymer used in the above embodiment are polymerized, includes an aqueous solution, as well as an alcohol such as methanol or ethanol, a hydrophilic colloidal solution matrix such as a gelatin solution, and a high-boiling solvent such as sodium tricresyl phosphate or liquid paraffin. In these mediums, an electron conjugated polymer may be formed using a polymerization initiator, and the resulting solution can be used as a solution for addition of compounds by coating.

These compounds may preferably be added in an amount of from $10^{-9}$ to $10^{5}$ mg/m$^2$, and particularly preferably from $10^{-2}$ to $10^{4}$ mg/m$^2$ of the light-sensitive material.

The conductive polymer used in this embodiment can be readily synthesized using a monomer capable of forming a polymer, which can be obtained as a commercial product.

The surface active agent containing fluorine, used in this embodiment, can be represented by the following Formula (VIa), (VIb), (VIc), (VId) or (VIe).

Formula (VIa)

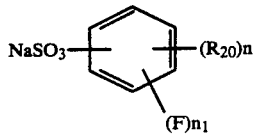

In the formula, $R_{20}$ represents an alkyl group having 1 to 32 carbon atoms, as exemplified by a methyl group, an ethyl group, a propyl group, a hexyl group, a nonyl group, a dodecyl group and a hexadecyl group. These groups are substituted with at least one fluorine atom. n represents an integer of 1 to 3, and n represents an integer of 0 to 4.

Formula (VIb)

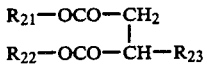

Formula (VIc)

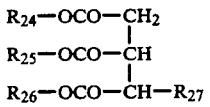

In the formulas, $R_{21}$, $R_{22}$, $R_{24}$, $R_{25}$ and $R_{26}$ each represent a straight-chain or branched alkyl group having 1 to 32 carbon atoms, as exemplified by a methyl group, an ethyl group, a butyl group, an isobutyl group, a pentyl group, a hexyl group, an octyl group, a nonyl group, a decyl group, a dodecyl group and an octadecyl group. It may also be an alkyl group that forms a ring. These groups are substituted with at least one fluorine atom. Alternatively, $R_{21}$, $R_{22}$, $R_{24}$, $R_{25}$ and $R_{26}$ each represents an aryl group as exemplified by a phenyl group and a naphthyl group. These aryl groups are substituted with at least one fluorine atom or a group substituted with at least one fluorine atom. $R_{23}$ and $R_{27}$ each represent an acid radical such as carboxylate group, a sulfonate group or a phosphoric acid group.

Formula (VId)

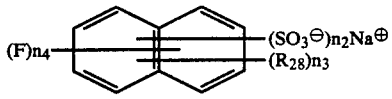

In the formula, $R_{28}$ represents a saturated or unsaturated straight-chain or branched alkyl group having 1 to 32 carbon atoms. As the saturated alkyl group, it represents, for example, a methyl group, an ethyl group, a butyl group, an isobutyl group, a hexyl group, a dodecyl group, or an octadecylgroup. As the unsaturated alkyl group, it represents, for example, an allyl group, a butenyl group, or an octenyl group. These saturated or unsaturated alkyl groups are substituted with at least one fluorine atom. $n_2$ and $n_3$ each represent an integer of 1 to 3. $n_4$ represents an integer of 0 to 6.

Formula (VIe)

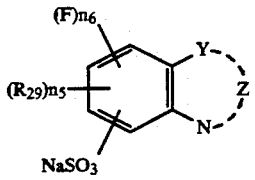

In the formula, Y represents a sulfur atom, a selenium atom, an oxygen atom, a nitrogen atom, or a group of

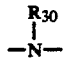

(wherein $R_{30}$ represents a hydrogen atom, or an alkyl group having 1 to 3 carbon atoms, as exemplified by a methyl group and an ethyl group); and $R_{29}$ represents a group having the same definition as the group represented by $R_{20}$ in the above Formula (VIa), or an aryl group (as exemplified by a phenyl group and a naphthyl group) substituted with at least one fluorine atom. Z represents a group of atoms necessary for completing a heterocyclic ring of 5 or 6 members. Examples of these include a thiazole ring, a selenazole ring, an oxazole ring, an imidazole ring, a pyrazole ring, a triazole ring, a tetrazole ring, a pyrimidine ring, and a triazine ring.

The above heterocyclic ring may further have a substituent such as an alkyl group or an aryl group, and these substituents may be substituted with a fluorine atom.

Examples of the fluorine-containing surface active agents represented by the above Formulas (VIa) to (VIe) are shown below, but the compounds usable in this invention are by no means limited to these.

(VI-1)

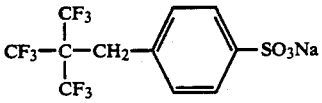

(VI-2)

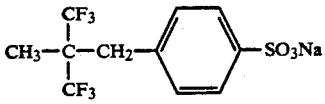

(VI-3)

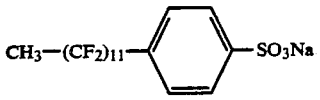

(VI-4)

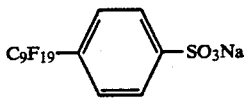

(VI-5)

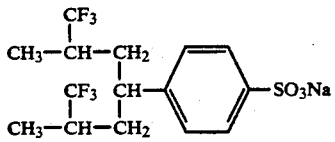

-continued (VI-6)

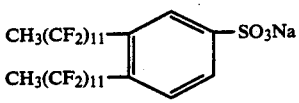

(VI-7)

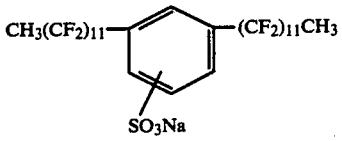

(VI-8)

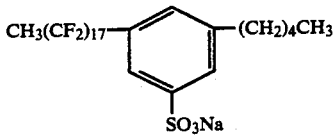

(VI-9)

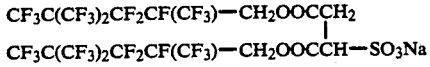

(VI-10)

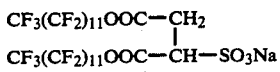

(VI-11)

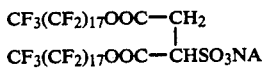

(VI-12)

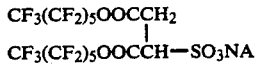

(VI-13)

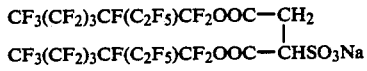

(VI-14)

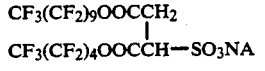

(VI-15)

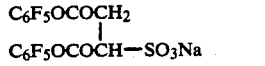

(VI-16)

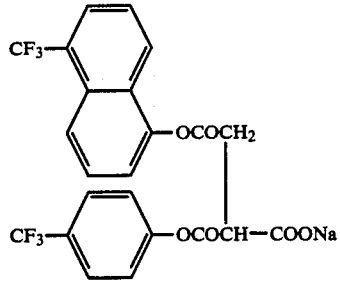

(VI-17)

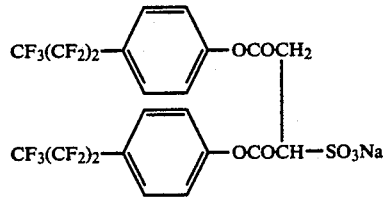

-continued (VI-18)

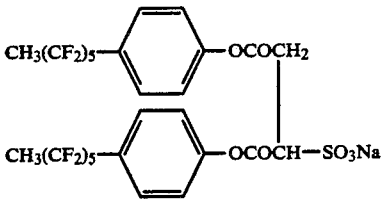

(VI-19)

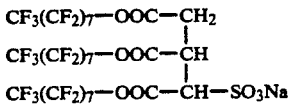

(VI-20)

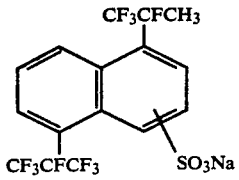

(VI-21)

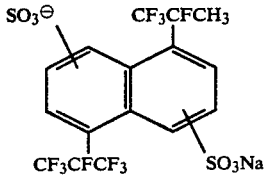

(VI-22)

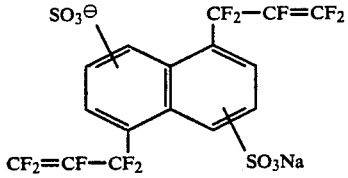

(VI-23)

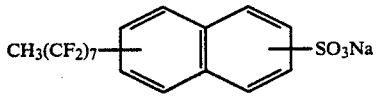

(VI-24)

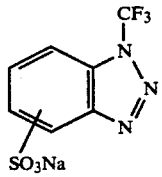

(VI-25)

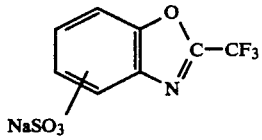

(VI-26)

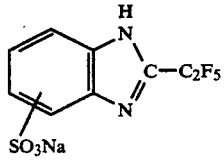

$H-(CF_2)_6CH_2-O-CH_2CH_2-SO_3Na$ (VI-27)

$H(CF_2)_8CH_2-O-CH_2CH_2-SO_3Na$ (VI-28)

$C_6F_5CH-OCH_2CH_2-SO_3Na$ (VI-29)

-continued $NaO_3SCH-COOCH_2(CF_2CF_2)_3H$ (VI-30)
$\quad | \quad CH_2COOC_5H_{11}(iso)$ $NaO_3S-CH-COOCH_2(CF_2CF_2)_3H$ (VI-31)
$\quad | \quad CH_2-COOCH_2CHC_4H_9$
$\quad\quad\quad\quad\quad\quad | \quad C_2H_5$ $NaO_3S-CH-COOCH_2(CF_2CF_2)_3H$ (VI-32)
$\quad | \quad CH_2COOCH_2-$ H $NaO_3S-CH-COOCH_2(CF_2CF_2)_4H$ (VI-33)
$\quad | \quad CH_2COOC_3H_7(n)$ $NaO_3S-CH-COOCH_7(CF_2CF_2)_7H$ (VI-34)
$\quad | \quad CH_2COOCH_3$ $NaO_3S-CHCOOCH_2CF_2CF_2H$ (VI-35)
$\quad | \quad CH_2COOC_{10}H_{21}(n)$ $NaO_3S-CH-COO(CF_2CF_2)_2H$ (VI-36)
$\quad | \quad CH_2COOCH_2CH_2-$ $NaO_3S-CH-COOCH_2(CF_2CF_2)_2H$ (VI-37)
$\quad | \quad CH_2COOC_9H_{19}(iso)$ $NaO_3S-CHCOOCH_2(CF_2CF_2)_2H$ (VI-38)
$\quad | \quad CH_2COOC_6H_{13}(n)$ $NaO_3S-CH-COOCH_2(CF_2)_6H$ (VI-39)
$\quad | \quad CH_2-COOCH_2(CF_2)_6H$ $HO(CF_2-CF_2-O)_{30}-H$ (VI-40)

$C_7F_{15}CH_2(OCH_2CH_2)_{13}OH$ (VI-41)

(VI-42)

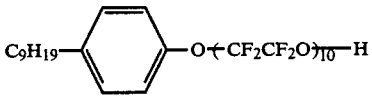

$n-C_8F_{17}SO_3K$ (VI-43)

(VI-44)

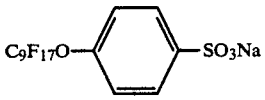

The fourth preferred embodiment of this invention will be described below in detail.

In the compound of Formula (III)

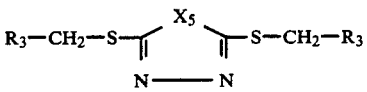

used in this invention, $R_3$ represents a carboxylic acid or sulfonic acid group which may be substituted. It includes, for example, COOH, $COOCH_3$, $COOCH_2OCH_3$, $COOCH_2OC_4H_9$, $COOCH_2CN$,

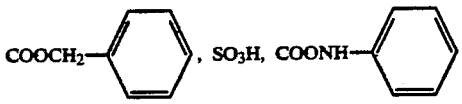

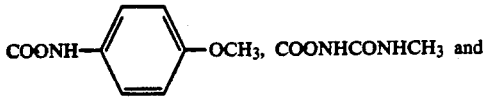

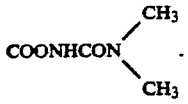

$X_5$ represents a sulfur atom or an oxygen atom.

Examples of the specific compounds are listed below, but by no means limited to these.

| Examples | $X_5$ | $R_3$ |
|---|---|---|
| III-1 | S | COOH |
| III-2 | S | $COOCH_3$ |
| III-3 | S | $COOC_4H_9$ |
| III-4 | S | $COOC_2H_5$ |
| III-5 | S | $COOCH_2OCH_3$ |
| III-6 | S | $COOCH_2CN$ |
| III-7 | S | $COOCH_2C_6H_5$ |
| III-8 | S | $COOCH_2S—C_6H_5$ |
| III-9 | S | $SO_3H$ |
| III-10 | S | $COONH—C_6H_5$ |
| III-11 | S | $COONH—C_6H_5—OCH_3$ |
| III-12 | S | $COONHCONHC_6H_5$ |
| III-13 | S | $COONHCONH—C_6H_4—C_2H_5$ |
| III-14 | S | $COONHCSNH—C_6H_4—C_2H_5$ |
| III-15 | S | $COONHCON(CH_3)_2$ |
| III-16 | S | $COONHCH_2CH_2OH$ |
| III-17 | S | $COONHCH_2CH_2CN$ |
| III-18 | O | COOH |
| III-19 | O | $COOCH_3$ |
| III-20 | O | $COOCH_2OCH_3$ |
| III-21 | O | $COOCH_2O—C_6H_5$ |
| III-22 | O | $COOCH_2OCN$ |
| III-23 | O | $COOCH_2OCN$ |
| III-24 | O | $SO_3H$ |

The hydrazine compound preferably used in this embodiment includes the compound represented by the following Formula (IVa) or (IVb).

$R_{31}NHNHCHO$ Formula (IVa)
$R_{31}NHNHCOR_{32}$ Formula (IVb)

In the formulas, $R_3$; and $R_{32}$ each represent a group such as a pyridyl group, a quinoline group, a furan group or a thiophene group. These groups may be substituted with a group such as an aryl group, an alkyl group, a substituted ureido group, an aliphatic amino group, a halogen atom, an alkoxy group or an alkylamino group. Alternatively, $R_{31}$ and $R_{32}$ represents an aryl group (as exemplified by a phenyl group and a naphthyl group) which may be substituted, or an alkyl group which may be substituted.

The aryl group represented by $R_{31}$ and $R_{32}$ includes a benzene ring or a naphthalene ring, and this ring may be substituted with a variety of substituents. Preferred substituents include a straight-chain or branched alkyl group, preferably having 1 to 20 carbon atoms, as exemplified by a methyl group, an ethyl group, an isopropyl group, and a n-dodecyl group; an alkoxy group, preferably having 1 to 20 carbon atoms, as exemplified by a methoxy group, and an ethoxy group; an aliphatic acylamino group, preferably having 2 to 21 carbon atoms, as exemplified by an acetylamino group, and a heptylamino group; and aromatic acylamino group. Besides these, they also include those in which some of the substituted or unsubstituted aromatic rings as described above are linked with a linking group such as —CONH—, —S—, —O—, $—SO_2NH—$, —NHCONH—, or $—CH_2CHN—$.

The hydrazine compound can be synthesized making reference to the description in U.S. Pat. No. 4,269,929. The hydrazine compound can be incorporated into an emulsion layer or a hydrophilic colloid layer adjacent to the emulsion layer, or further into other hydrophilic colloid layers. It, however, may preferably be incorporated into an emulsion layer or a hydrophilic colloid layer adjacent to the emulsion layer.

The hydrazine compound can be added after it has been dissolved in alcohols such as methanol and ethanol, glycols such as ethylene glycol and diethylene glycol, ethers, or ketones. It may be added in an amount ranging preferably from $10^{-6}$ to $10^{-1}$ mol, and more preferably from $10^{-4}$ to $10^{-2}$ mol, per mol of silver halide.

Examples of particularly preferred hydrazine compounds are as follows. Needless to say, this invention is by no means limited by the following compounds.

(IV-72): 1-Formyl-2-phenylhydrazine
(IV-73): 1-Formyl-2-(4-methoxyphenyl)hydrazine
(IV-74): 1-Formyl-2-(4-bromophenyl)hydrazine
(IV-75): 1-Formyl-2-(4-ethylphenyl)hydrazine
(IV-76): 1-Formyl-2-(4-ethoxyphenyl)hydrazine
(IV-77): 1-Formyl-2-(4-acetoamidophenyl)hydrazine
(IV-78): 1-Formyl-2-(4-butylamidophenyl)hydrazine
(IV-79): 1-Formyl-2-{4-[2-(2,4-di-tert-pentylphenoxy) butylamido]phenyl}hydrazine
(IV-80): 1-Formyl-2-(2,4-dimethylaminophenyl)hydrazine
(IV-81): 1-Formyl-2-(4-acetamido-2-methylphenyl)hydrazine
(IV-82): 1-Formyl-2-[4-(3-phenyl-thioureido)phenyl]-hydrazine
(IV-83): 1-Formyl-2-[4-(3-ethyl-thioureido)phenyl]hydrazine
(IV-84): 1-Formyl-2-{4-[4-(3-phenyl-thioureido)-phenyl]carbamylphenyl}hydrazine
(IV-85): 1-Formyl-2-{4-[3-(4,5-dimethylthiazol-2-yl)thioureylene]phenyl}hydrazine
(IV-86): 1-Formyl-2-[4-(phenylthiocarbamyl)phenyl]-hydrazine
(IV-87): 1-Formyl-2-[4-(N-methylbenzothiazol-2-yl)thioureylenephenyl]hydrazine
(IV-88): 1-Formyl-2-{[4-(1,3-dimethylbenzimidazol-2-yl)thioureylene]phenyl}hydrazine
(IV-89): 1-Formyl-2-[4-(5-methyl-2-thio-imidazolin-3-yl)phenyl]hydrazine
(IV-90): 1-Formyl-2-[4-(3-n-butylureido)phenyl]hydrazine
(IV-91): 1-Formyl-2-(4-[3-(p-chlorophenyl)ureido]phenyl) hydrazine
(IV-92): 1-Formyl-2-(4-{3-[p-(2-mercapto-tetrazol-3-yl)phenyl]thioureylene}phenyl)hydrazine
(IV-93): 1-Formyl-2-(4-[m-(N-sulfopropylbenzothiazol-2-yl)propylamino]phenyl)hydrazine
(IV-94): 1-(p-chlorobenzoyl)-2-phenylhydrazine
(IV-95): 1-(p-cyanobenzoyl)-2-phenylhydrazine (IV-96): 1-(p-carboxybenzoyl)-2-phenylhydrazine
(IV-97): 1-(3,5-dichlorobenzoyl)-2-phenylhydrazine
(IV-98): 1-(2-formylhydrazino)-4-(N-dimethylamino)-benzene
(IV-99): 1-(2-formylhydrazino)-4-(2-formylhydrazino) benzylbenzene
(IV-100)

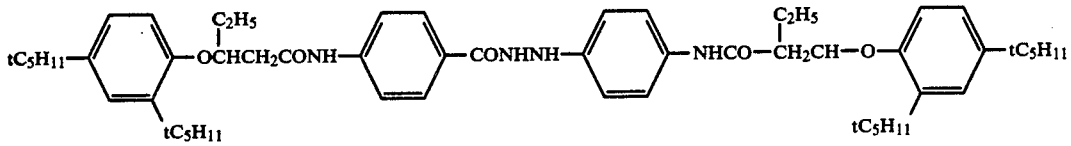

The following description is common to the respective embodiments of this invention.

In the silver halide emulsion used in the light-sensitive material of this invention, any silver halides such as silver bromide, silver chloride, silver iodobromide, silver chlorobromide, and silver chloroiodobromide used in usual silver halide emulsions can be used as the silver halide. Silver halide grains may be those obtained by any of an acidic method, a neutral method and an ammonia method.

The silver halide grains may comprise a grain having uniform distribution of silver halide composition in a grain, or a core/shell grain having different silver halide composition between the inside and surface layer of a grain, and also may be a grain in which the latent image is formed mainly on its surface, or a grain in which it is formed mainly in its inside.

The silver halide grains according to this invention may have any form. A preferred example is a cube having the {100} plane as a crystal surface. Grains having the form of an octahedron, a tetradecahedron or a dodecahedron may be prepared by the method described in the specifications of U.S. Pat. Nos. 4,183,756 and 4,225,666, Japanese Unexamined Patent Publication No. 26589/1980, Japanese Patent Publication No. 42737/1980, etc. and the publications of The Journal of Photographic Science (J. Photgr. Sci.), 21, 39 (1973), etc., and these can be also used. In addition, grains having a twinning plane may also be used.

The silver halide grains according to this invention may be grains comprised of a single form, or may be a mixture of grains having various forms.

Grains having any grain size distribution may be used. Thus, an emulsion having a broad grain size distribution (which is called a polydisperse emulsion) may be used, or an emulsion having a narrow grain size distribution (which is called a monodisperse emulsion) may be used alone or several kinds of the emulsion may be mixed. Alternatively, the polydisperse emulsion and the monodisperse emulsion may be used as a mixture of these.

The silver halide emulsion may be used as a mixture of two or more kinds of silver halide emulsions separately formed.

The light-sensitive silver halide emulsion can be used in the form of so-called primitive emulsions without chemical sensitization. It, however, is chemically sensitized in usual instances.

The silver halide used in this invention can be sensitized using various chemical sensitizers. The chemical sensitizers include, for example, active gelatin; sulfur sensitizers such as sodium thiosulfate, allylthiocarbamide, thiourea, and allylisothiocyanate; selenium sensitizers such as N,N-dimethyl selenourea, and selenourea; reduction sensitizers such as triethylenetetramine, and stannous chloride; and all sorts of noble metal sensitizers as typically exemplified by potassium chloroaurite, potassium aurithiocyanate, potassium chloroaurate, 2-aurosulfobenzo-thiazole methylchloride, ammonium chloroparadate, potassium chloroplatinate, and sodium chloroparadite; each of which can be used alone or in combination of two or more kinds. When a gold sensitizer is used, ammonium thiocyanate can also be used as an auxiliary.

For the purpose of chemical sensitization, methods can be used which are described in books written by Glafkides or Zelikmann et al, or Die Grundlagen der Photographischen Prozesse mit Silberhalogeniden, Edited by H. Frieser, Akademische Verlagsgesellschaft, 1968.

As the light-sensitive emulsion, the emulsions previously described may be used alone or two or more emulsions may be mixed.

In working this invention, after the chemical sensitization as described above is completed, various stabilizers can also be used, including, for example, 4-hydroxy-6-methyl-1,3,3a,7-tetrazaindene, 5-mercapto-1-phenyltetrazole, and 2-mercaptobenzothiazole.

If necessary, there may be further used silver halide solvents such as thioether, or crystal habit controlling agents such as mercapto group-containing compounds and sensitizing dyes.

The emulsion used in this invention may be an emulsion from which unnecessary soluble salts are removed after the growth of silver halide grains has been completed, or from which they remain unremoved. In the case when such salts are removed, they can be removed according to the method as described in Research Disclosure No. 17643.

In the light-sensitive material of this invention, various additives can be further used depending on the purpose. These additives are described in greater detail in Research Disclosures Vol. 176, Item 17643 (December, 1978) and Vol. 187, Item 18716 (November, 1979). Corresponding passages thereof are summarized in the following table.

| Type of additives | RD 17643 | RD 18716 |
|---|---|---|
| 1. Chemical sensitizer | p. 23 | p. 648, right col. |
| 2. Speed-increasing agent | — | " |
| 3. Spectral sensitizer Supersensitizer | pp. 23–24 | p. 648, right col. to p. 649, right col. |
| 4. Brightening agent | p. 24 | — |
| 5. Antifoggant and Stabilizer | pp. 24–25 | p. 649, right col. |
| 6. Light-absorbent Filter dye Ultraviolet absorbent | pp. 25–26 | p. 649, right col. to p. 650, left col. |
| 7. Anti-stain agent | p. 25, right col. | p. 650, left to right col. |
| 8. Dye-image stabilizer | p. 25 | — |
| 9. Hardening agent | p. 26 | p. 651, left col. |
| 10. Binder | p. 26 | " |
| 11. Plasticizer | p. 27 | p. 650, right col. |

-continued

| Type of additives | RD 17643 | RD 18716 |
|---|---|---|
| Lubricant | | |
| 12. Coating auxiliary Surfactant | pp. 26–27 | " |
| 13. Antistatic agent | p. 27 | " |

In embodying the light-sensitive silver halide photographic material of this invention, the emulsion layer and other layers, for example, can be constituted by providing them by coating on one side or both sides of a flexible support usually used in light-sensitive materials. Useful as the flexible support are films comprising a semisynthetic or synthetic polymer such as cellulose nitrate, cellulose acetate, cellulose acetate butyrate, polystyrene, polyvinyl chloride, polyethylene terephthalate, or polycarbonate, and papers having a baryta layer or coated or laminated with an α-olefin polymer as exemplified by polyethylene, polypropylene, or an ethylene/butene copolymer. The support may be colored using dyes or pigments. It may also be black-colored for the purpose of light-screening. The surface of the support is commonly subjected to subbing treatment so that its adhesion to the emulsion layer or the like can be improved. The subbing treatment may preferably be the treatment described in Japanese Unexamined Patent Publications No. 104913/1977, No. 18949/1984, No. 19940/1984 and No. 11941/1984.

In the light-sensitive silver halide photographic material according to this invention, the photographic emulsion layers and other hydrophilic colloid layers can be provided by coating on the support or on other layer according to various coating methods. The coating that can be used include dip coating, roller coating, curtain coating, and extrusion coating.

In the processing such as developing, various methods can be used which are known in the present industrial field and usually used in the processing of light-sensitive silver halide photographic materials.

The silver halide used in the light-sensitive silver halide photographic material according to this invention may preferably comprise silver chloride, silver chlorobromide, silver chloroiodidebromide, etc. with any desired composition and contains at least 50 mol % of silver chloride or silver bromide. The silver halide grains may preferably have an average grain size ranging from 0.025 to 0.5 μm, and more preferably from 0.05 to 0.30 μm.

The degree of monodispersion of the silver halide grains according to this invention is defined by the following formula (1), and the grains are prepared so as to give its value of preferably from 5 to 60, and more preferably from 8 to 30. The grain size of the silver halide grains according to this invention is expressed, for convenience, by the ridge length of a cubic grain, and the degree of monodispersion is expressed by the numerical value obtained by multiplying by 100 the value obtained by dividing the standard deviation of grain size by the average grain size.

$$\left(\sqrt{\frac{\Sigma(r-ri)^2 ni}{\Sigma ni}} \div r\right) \times 100 \quad (1)$$

The silver halide grains that can be used in this invention may preferably comprise a silver halide grain of the type having a multi-layer laminated structure with at least two layers. For example, the grain may be a silver chlorobromide grain comprising a core composed of silver chloride and a shell composed of silver bromide, or, in reverse, a core composed of silver bromide and a shell composed of silver chloride. In this instance, iodine can be contained in any layers with a limit of not more than 5 mol %.

The grains can also be used by mixing at least two types of grains. For example, they can be mixed grains comprised of chief grains comprising a cubic, octahedral or plate-like silver chloroiodobromide grain containing not more than 10 mol % of silver chloride and not more than 5 mol % of iodine, and sub-grains comprising a cubic, octahedral or plate-like silver chloroiodobromide grain containing not more than 5 mol % of iodine and not less than 50 mol % of silver chloride. When the grains are used by mixing them in this way, it is optional to chemically sensitize the chief grains and sub-grains. However, the sub-grains may be chemically sensitized (sulfur sensitization or gold sensitization) to a lower degree than the chief grains to have a lower sensitivity, or may be made to have a lower sensitivity by the controlling of the grain size or the amount of noble metals such as rhodium doped in the inside. The insides of the sub-grains may be fogged with gold, or may be fogged by changing the composition of the core and shell according to a core/shell method. It is better for the chief grains and sub-grains to be as small as possible, and any desired value ranging from 0.025 μm to 1.0 μm can be selected.

In preparing the silver halide emulsion used in this invention, a rhodium salt can be added to control the sensitivity or gradation. In general, the rhodium salt may preferably be added when the grains are formed, but may be added at the time of chemical ripening or preparation of an emulsion coating solution.

The rhodium salt added in the silver halide emulsion used in this invention may be in the form of a simple salt or, alternatively, a double salt. Typically used are rhodium chloride, rhodium trichloride, rhodium ammonium chloride, and so forth.

The amount of rhodium salt added can be arbitrarily changed depending on the required sensitivity or gradation, but a particularly useful amount ranges from $10^{-9}$ mol to $10^{-4}$ mol per mol of silver.

When the rhodium salt is used, other inorganic compounds as exemplified by an iridium salt, a platinum salt, a thallium salt, a cobalt salt and a gold salt may be used in combination. The iridium salt is often used for the purpose of improving high-illuminance performance, and can be preferably used in an amount ranging from $10^{-9}$ to $10^{-4}$ mol per mol of silver.

Various silver halides can be used in the silver halide emulsion layer used in the light-sensitive silver halide photographic material of this invention. They include, for example, silver chloride, silver bromide, silver chlorobromide, silver iodobromide, and silver chloroiodobromide. In particular, the effect of this invention is remarkable for light-sensitive materials containing silver bromide and silver iodobromide, and particularly remarkable for a high-speed light-sensitive material containing silver iodide in a small amount (for example, not more than 5 mol % of AgI).

The silver halide emulsion for the silver halide emulsion layer of the light-sensitive material of this invention can be prepared according to various methods, and may be an emulsion of silver halides suspended in a hydrophilic colloidal solution. For example, used are methods of preparing emulsions according to a single-jet method or double-jet method in the neutral method or ammonia method.

The silver halide grains contained in the silver halide emulsion layer used in the light-sensitive material of this invention may preferably have an average grain size of from 0.01 to 1.0 μm, and particularly preferably from 0.05 to 0.7 μm, and there may preferably be contained silver halide grains in which grains holding at least 75 and particularly preferably not less than 80%, of the total grain number have a grain size of 0.7 time to 1.3 times the average grain size. Herein, the grain size is expressed in terms of a diameter of a round image having an area equal to the projected area of a grain.

As a silver halide emulsion in which a polyvalent metal ion as exemplified by iridium or rhodium is occluded, the emulsions disclosed in U.S. Pat. Nos. 3,271,157, 3,447,927, 3,531,291, etc. can also be used. The silver halide emulsion can be sensitized by chemical sensitization conventionally carried out, using sulfur compounds, or gold compounds such as chloroaurate and gold trichloride.

A polymer latex comprising a homopolymer or copolymer such as alkyl acrylate, alkyl methacrylate, acrylic acid or glycidyl acrylate may also be contained in the silver halide emulsion layers or other hydrophilic colloid layers in order to enhance the dimensional stability of photographic materials and improve film properties.

The silver halide emulsion used in this invention can be endowed with color sensitivity to the desired light-sensitive wavelength region, using a sensitizing dye. As the sensitizing dye, those usually used can be used, including methine dyes such as cyanine, hemicyanine, rhodacyanine, merocyanine, oxanole and hemioxonole, and styryl dyes.

In the silver halide emulsion used in this invention, the compound represented by Formula (VIIa) or (VIIb) is useful as a stabilizer or fog restrainer.

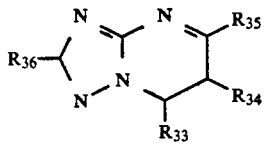

Formula (VIIa)

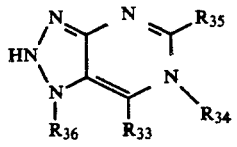

Formula (VIIb)

In the formulas, $R_{33}$, $R_{34}$, $R_{35}$ and $R_{36}$ may be the same or different, and each represent a hydrogen atom, a halogen atom, a nitro group, an amino group, a cyano group, a hydroxyl group, a carboxyl group, an alkoxy group, an acyl group or substituted or unsubstituted alkyl group, an aryl group, or a heterocyclic group; $R_{34}$ and $R_{35}$ may combine to take a closed ring structure of 5 or 6 members.

Examples of specific compounds represented by the above Formulas include the following. Needless to say, this invention is by no means limited by these specific compounds.

(VII-1): 4-Hydroxy-6-methyl-1,3,3a,7-tetrazaindene
(VII-2): 4-Hydroxy-5-ethyl-6-methyl-1,3,3a,7-tetrazaindene
(VII-3): 2-Mercaptomethyl-4-hydroxy-6-methyl-1,3,3a,7-tetrazaindene
(VII-4): 2-Carboxy-4-hydroxy-6-methyl-1,3,3a,7-tetrazaindene
(VII-5): 2,4-Dihydroxy-6-methyl-1,3,3a,7-tetrazaindene
(VII-6): 2-Amino-5-carboxy-4-hydroxy-1,3,3a,7-tetrazaindene
(VII-7): 5-Carboxy-4-hydroxy-1,3,3a,7-tetrazaindene
(VII-8): 2-Methyl-4-hydroxy-6-methyl-1,3,3a,7-tetrazaindene
(VII-9): 4-Hydroxy-5-cyano-1,3,3a,7-tetrazaindene
(VII-10): 3-Chloro-4-hydroxy-6-methyl-1,3,3a,7-tetrazaindene
(VII-11): 2,4-Dihydroxy-6-methyl-1,3,3a,7-tetrazaindene
(VII-12): 1,2-bis(4-Hydroxy-6-methyl-1,3,3a,7-tetrazainden-2-yl)-1,2-dihydroxyethane
(VII-13): 5-Amino-7-hydroxy-2-p-methoxypenyl-1,2,3,4,6-pentazainden.

The above compounds can be added at the time the physical ripening of the silver halide is carried out and/or completed in the course of the formation of emulsions. These compounds can be made to present in the course the silver halide is made to grow and formed in the layer comprising a hydrophilic colloid such as gelatin. They may further be added immediately before chemical ripening, in the course of and/or after completion of chemical ripening, or may be added when coating solutions are prepared. As a preferred addition methods commonly employed, the compounds are added in an amount ranging from $10^{-6}$ to $10^{-1}$ mol, and more preferably from $10^{-4}$ to $10^{-2}$ mol, per mol of silver halide, at the time the chemical ripening has been completed. When the above compounds are added in the emulsion, they can be added following the procedure used when the respective compounds used in this invention are added, using similar solvents to carry out dissolution.

In the light-sensitive material of this invention, a compound having the structure as shown by the following Formula (VIIIa) or (VIIIb) may be used as a fog-preventing agent or a stabilizer in combination to make it possible to obtain a remarkable fog-restraining effect.

| Formula (VIIIa) | Formula (VIIIb) |
|---|---|
| Ar—OH | HO—Ar—OH |

In the formulas, Ar represents an aromatic ring, and the aromatic ring may be substituted with an alkyl group having 1 to 15 carbon atoms, a halogen atom, a hydroxyl group, a hydroxyalkyl group (where the alkyl group may be substituted with a hydroxyl group or a halogen atom), an aldoxime group, or the like.

The compound specifically includes the following compounds. Needless to say, this invention is by no means limited by these specific compounds.

(VIII-1): Hydroquinone
(VIII-2): Methylhydroquinone
(VIII-3): Chlorohydroquinone
(VIII-4): Hydroquinone monosulfonate
(VIII-5): 2,5-Diethylhydroquinone
(VIII-6): 1,4-Dihydroxynaphthalene
(VIII-7): 2,3-Dihydroxynaphthalene
(VIII-8): Gentisaldoxime (VIII-9): 2,5-Dihydroxyacetophenone oxime
(VIII-10): Gentisamide
(VIII-11): N-methylgentisamide
(VIII-12): N-(β-hydroxyethyl)gentisamide
(VIII-13): N-(n-hexadecyl)gentisamide
(VIII-14): Salicylaldoxime
(VIII-15): Resorcylaldoxime
(VIII-16): Hydroquinonemonobenzoate
(VIII-17): Hydroquinonealdoxime The above compounds can be synthesized making reference to the descriptions in U.S. Pat. No. 2,675,314, British Patent No. 623,448, Japanese Unexamined Patent Publication No. 11029/1977, etc.

Known methods can be used to add these additives in the silver halide emulsion. More specifically, they may be dissolved in alcohols such as methyl alcohol and ethyl alcohols, ethers such as diethyl ether and dipropyl ether, ketones such as acetone, dioxane, petroleum ether, or nonionic, anionic or cationic surface active agents. They also may be added after they are dispersed in a high-boiling solvent.

In the silver halide emulsion that can be used in this invention, compounds usually used as hardening agents can be used alone or in combination, which are exemplified by aldehydes such as formaldehydes, glyoxals, glutaldehydes, and mucochloric acid; N-methylol compounds such as dimethylol urea, and methylol dimethylhydantoin; dioxane derivatives such as 2,3-dihydroxydioxane; activated vinyl compounds such as 1,3,5-triacryloyl-hexahydro-s-triazine, and bis(vinylsulfonyl)methyl ether; and activated halides such as 2,4-dichloro-6-hydroxy-s-triazines. There can be also used the compounds usually used as thickening agents, matting agents, coating auxiliaries, and so forth. Hydrophilic binders usually used, having protective colloid properties, can also be used as binders.

As the support used in this invention, baryta paper, polyethylene-coated paper, cellulose acetate, cellulose nitrate, polyethylene terephthalate, etc. can be appropriately selected depending on the purpose for which the light-sensitive material is used.

The respective effects as aimed in this invention can be more enhanced when a desensitizing dye and/or an ultraviolet absorbent is/are contained in the light-sensitive silver halide photographic material according to this invention.

As the desensitizing dye, the compounds represented by the following Formulas (IXa) to (IXe) can be preferably used.

As the ultraviolet absorbent, the compounds represented by the following Formulas (IXf) and (IXg) can be preferably used.

These compounds can be synthesized making reference to the specifications of U.S. Pat. Nos. 3,567,456, 3,615,639, 3,579,345, 3,615,608, 3,598,596, 3,598,955, 3,592,653 and 3,582,343; Japanese Patent Publications No. 26751/1965, No. 27332/1965, No. 13167/1968, No. 8833/1970 and No. 8746/1972; etc.

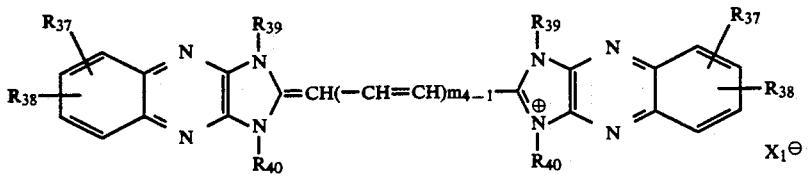

Formula (IXa)

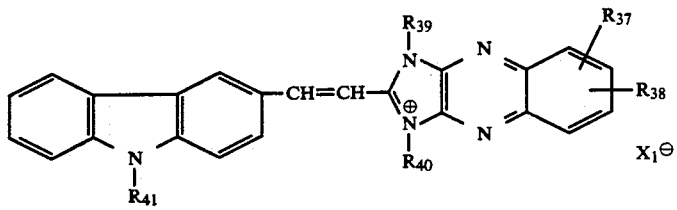

Formula (IXb)

In the formulas, $R_{37}$ and $R_{38}$ each represent a hydrogen atom, a halogen atom, a cyano group, or a nitro group. $R_{37}$ and $R_{38}$ may also combine to form an aromatic ring. $R_{39}$ and $R_{40}$ each represent an alkyl group, a lower alkenyl group, a phenyl group, or a lower hydroxyalkyl group, or may be an aryl group when $R_{37}$ and $R_{38}$ are other than hydrogen atoms; $m^4$ represents a positive integer of 1 to 4; $R_{41}$ represents a lower alkyl group, or a sulfonated lower alkyl group; and $X_1$ represents an acid anion.

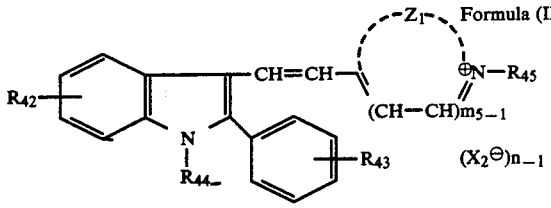

Formula (IXc)

In the formula, $R_{42}$ and $R_{43}$ each represent a hydrogen atom, or a nitro group; $R_{44}$ and $R_{45}$ each represent a lower alkyl group, an allyl group, or a phenyl group; $Z_1$ represents a group of atoms necessary for completing a nitrobenzothiazole nucleus, a nitrobenzoxazole nucleus, a nitrobenzoselenazole nucleus, an imidazo [4,5-b] quinoxaline nucleus, a 3,3-dimethyl-3H-pyrrolo [2,3-b] pyridine nucleus, a 3,3-dialkyl-3H-nitroindole nucleus, a thiazolo [4,5-b] quinoline nucleus, a nitroquinoline nucleus, a nitrothiazole nucleus, a nitronaphthothiazole nucleus, a nitroxazole nucleus, a nitronaphthoxazole nucleus, a nitroselenazole nucleus, a nitronaphthoselenazole nucleus or a nitropyridine nucleus; $X_2$ represents an anion; $m_5$ and n each represent 1 or 2, provided that n represents 1 when the compound forms an internal salt.

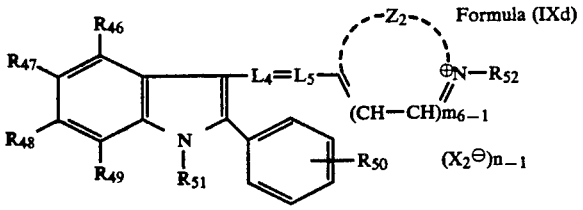

Formula (IXd)

In the formula, $R_{46}$, $R_{47}$, $R_{48}$ and $R_{49}$ each represent a hydrogen atom, a halogen atom, an alkyl group, an alkoxy group, an aryloxy group, or a nitro group; and $R_{50}$ represents a hydrogen atom, an alkyl group, or a nitro group. $Z_2$ represents a group of atoms necessary for completing a thiazole nucleus, a benzothiazole nucleus, a naphthothiazole nucleus, an oxazole nucleus, a benzoxazole nucleus, a naphthoxazole nucleus, a selenazole nucleus, a benzoselenazole nucleus, a naphthoselenazole nucleus, a thiazoline nucleus, a pyridine nucleus, a quinoline nucleus, an isoquinoline nucleus, a 3,3-dialkyl-3H-indole nucleus, an imidazole nucleus, a benzimidazole nucleus or a naphthoimidazole nucleus, unsubstituted or each substituted with a lower alkyl group, a phenyl group, a thienyl group, a halogen atom, an alkoxy group, a hydroxyl group, a cyano group, an alkylsulfonyl group, an alkoxycarbonyl group, a phenylsulfonyl group or a trifluoromethyl group; $L_4$ and $L_5$ each represent a methine chain, unsubstituted or substituted with a lower alkyl group or an aryl group; $R_{51}$ and $R_{52}$ each represent an alkyl group, an alkenyl group, an aryl group, a sulfoalkyl group or an aralkyl group, unsubstituted or having a substituent; $X_2$ represents an anion; and $m^6$ and n each represent 1 or 2, provided that n represents 1 when the compound forms an internal salt.

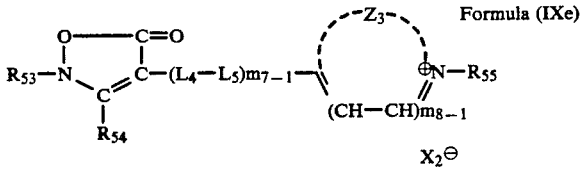

Formula (IXe)

In the formula, $R_{53}$ and $R_{55}$ each represent an alkyl group, and $R_{54}$ represents an aryl group. $L_4$ and $L_5$ each representa methine chain, unsubstituted or substituted with a lower alkyl group or an aryl group; $Z_3$ represents a group of atoms necessary for completing a thiazole nucleus, a benzothiazole nucleus, a naphthothiazole nucleus, an oxazole nucleus, a benzoxazole nucleus, a napohthoxazole nucleus, a selenazole nucleus, a benzoselenazole nucleus, a naphthoselenazole nucleus, a thiazoline nucleus, a pyridine nucleus, a quinoline nucleus, a 3,3-dialkylindolenine nucleus, an imidazole nucleus or an imidazo[4,5-b]quinoxaline nucleus; $X_2$ represents an anion; $m_7$ represents a positive integer of 1 to 3, and $m_8$ represents 1 or 2.

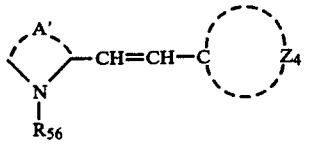

Formula (IXf)

In the formula, $R_{56}$ represents an alkyl group, a hydroxyalkyl alkyl group, a cyanoalkyl group, or a sulfoalkyl group; $Z_4$ represents a group of atoms necessary for completing an oxazole ring, a thiazole ring, a benzoxazole ring, a benzothiazole ring, an imidazole ring or a benzimidazole ring; and A' represents a group of atoms necessary for completing a pyrrole ring or a pyrrolidine ring.

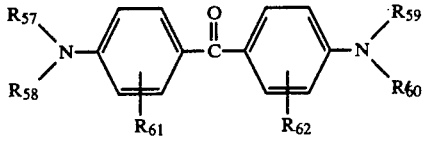

Formula (IXg)

In the formula, $R_{57}$, $R_{58}$, $R_{59}$ and $R_{60}$ eaoh represent an alkyl group, a hydroxyalkyl group, a cyano group, an alkylcyano group, an alkoxy group, or a sulfoalkyl group. $R_{61}$ and $R_{62}$ each represent a sulfonic acid group, or an alkylsulfonic acid group.

Specific exemplary compounds of the desensitizers and ultraviolet absorbents preferably used in this invention are shown below, but by no means limited to these. (In the following, some of the exemplary compounds IX-1 to IX-40 do not fall under the above general formula. "pts" represents a paratoluenesulfonic acid group.

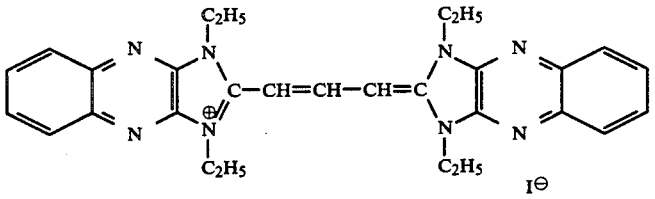

(IX-1)

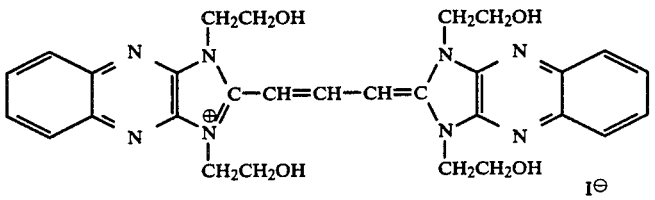

(IX-2)

-continued
(IX-3)
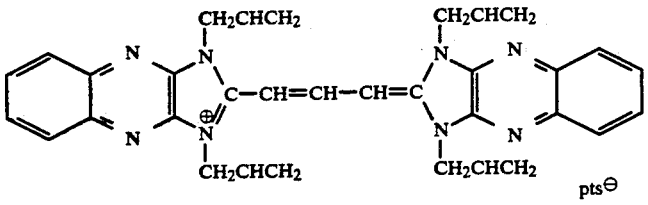
(IX-4)
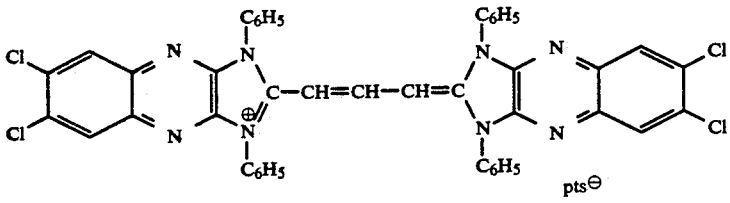
(IX-5)
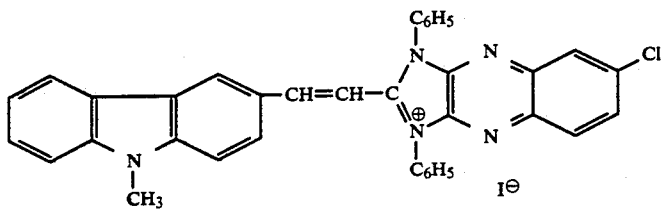
(IX-6)
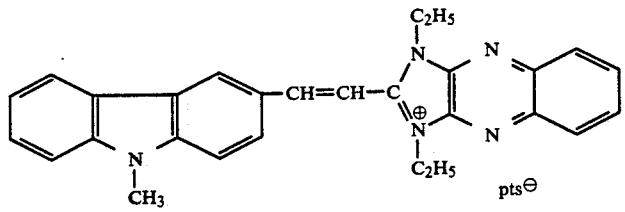
(IX-7)
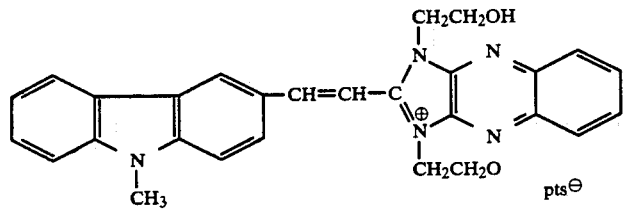
(IX-8)
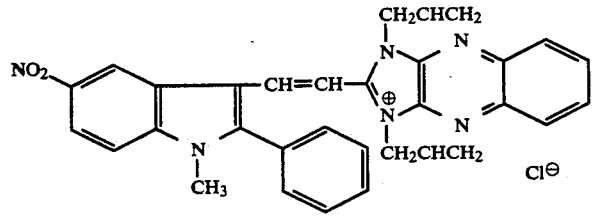
(IX-9)
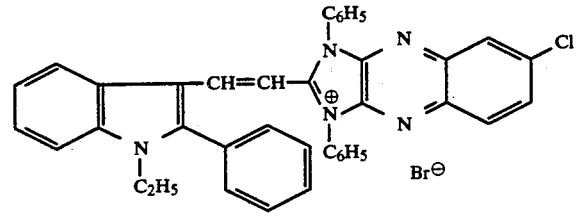

-continued
(IX-10)
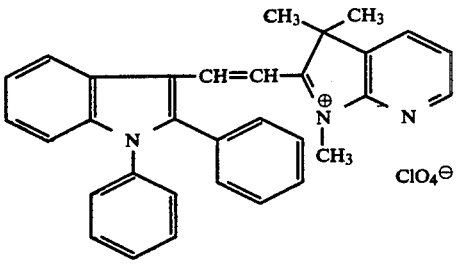
(IX-11)
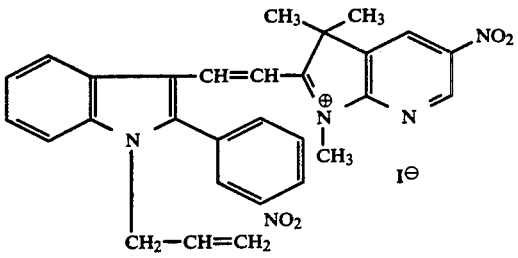
(IX-12)
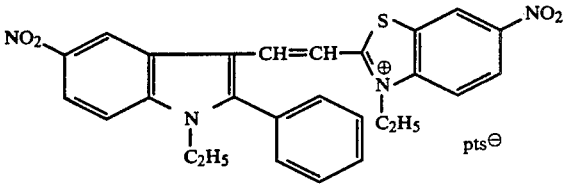
(IX-13)
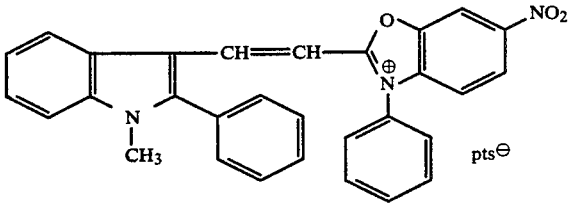
(IX-14)
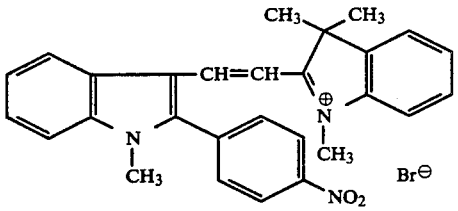
(IX-15)
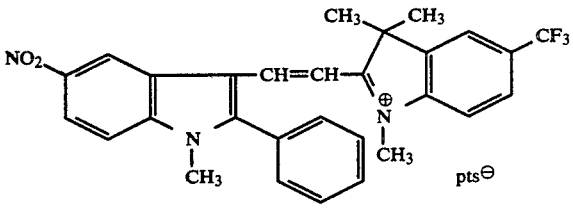
(IX-16)
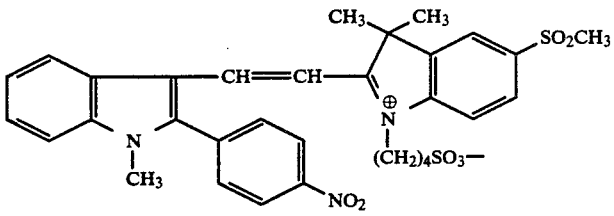

-continued
(IX-17)
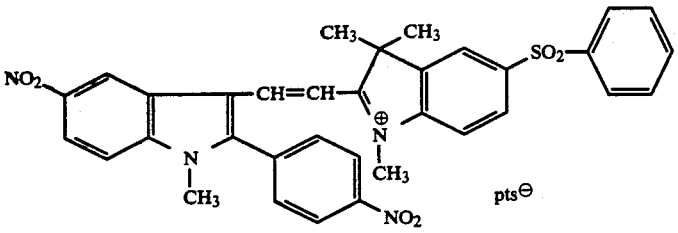
(IX-18)
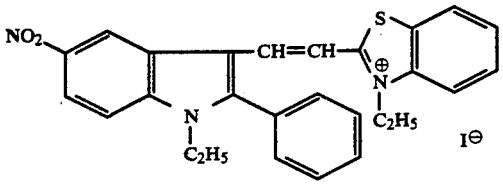
(IX-19)
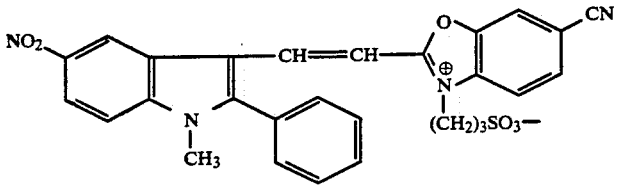
(IX-20)
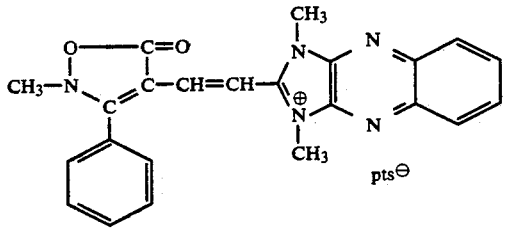
(IX-21)
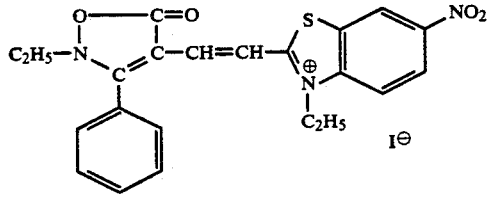
(IX-22)
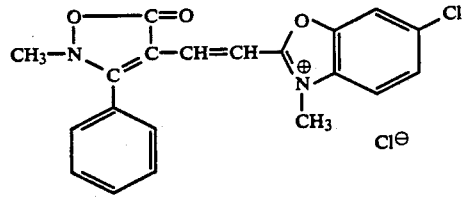
(IX-23)
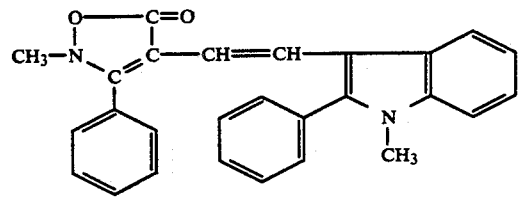

-continued
Phenosafranine (IX-24)
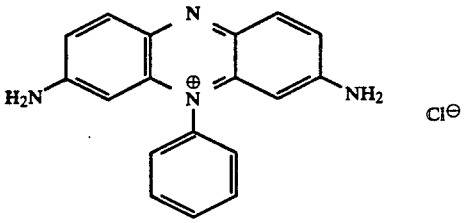
Pinakryptol yellow (IX-25)
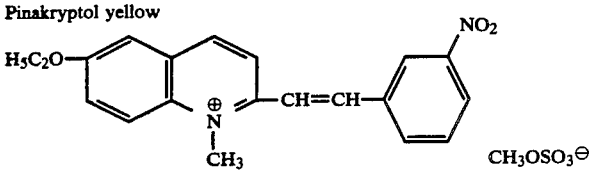
(IX-26)
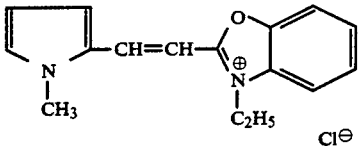
(IX-27)
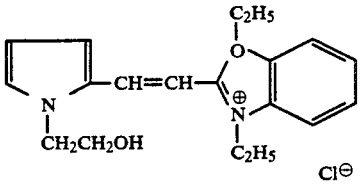
(IX-28)
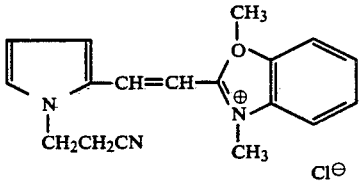
(IX-29)
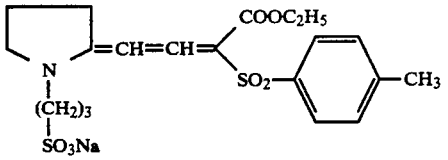
(IX-30)
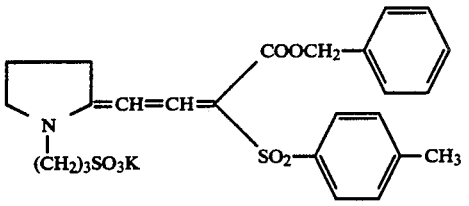
(IX-31)
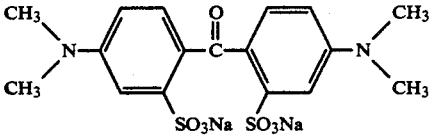

-continued

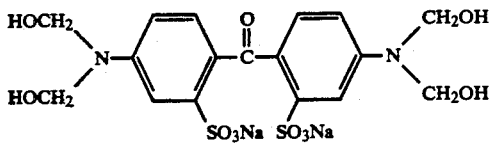
(IX-32)

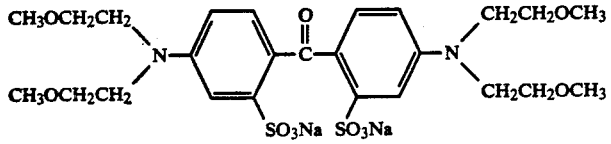
(IX-33)

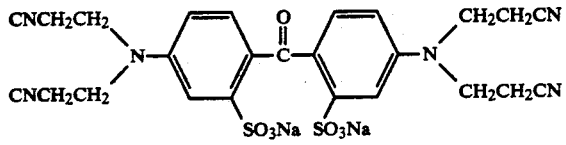
(IX-34)

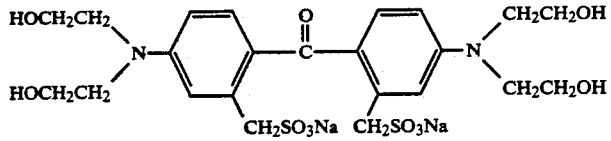
(IX-35)

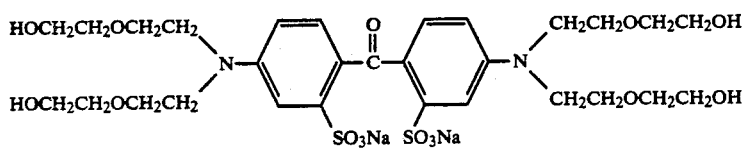
(IX-36)

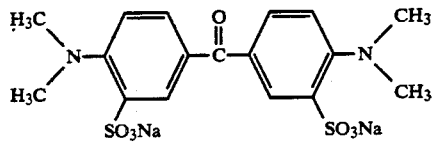
(IX-37)

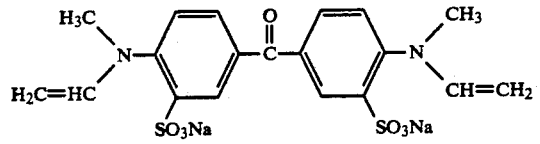
(IX-38)

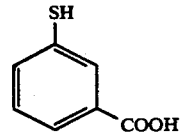
(IX-39)

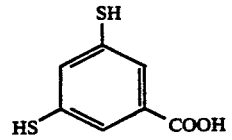
(IX-40)

The silver halide emulsion used in this invention can also be stabilized using the compounds disclosed in the specifications or publications of U.S. Pat. Nos. 2,444,607, 2,716,062 and 3,512,982, West German Publications No. 11 89 380, No. 20 58 626 and No. 21 18 411, Japanese Patent Publication No. 4133/1968, U.S. Pat. No. 3,342,596, Japanese Patent Publication No. 4417/1972, West German Publications No. 21 49 789, Japanese Patent Publication No. 2825/1964, and Japanese Patent Publication No. 13566/1974, preferably as exemplified by 5,6-trimethylene-7-hydroxy-S-triazolo-(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 5-methyl-7-hydroxy-S-triazolo(1,5-a)pyrimidine, 7-hydroxy-S-triazolone(1,5-a)pyrimidine, 5-methyl-6-bromo-7-hydroxy-S-triazolo(1,5-a)pyrimidine, gallic acid esters as exemplified by isoamyl gallate, dodecyl gallate, propyl gallate, and sodium gallate; mercaptans such as 1-phenyl-5-mercaptotetrazole, and 2-mercaptobenzothiazole; benzotriazoles such as 5-bromobenzotriazole, and 5-methylbenzotriazole; benzimidazoles such as 6-nitrobenzimidazole.

An amino compound may preferably be contained in the light-sensitive silver halide photographic material and/or developing solution according to this invention.

The amino compound preferably used in this invention includes all of primary to quaternary amines. Examples of preferred amino compounds include alkanolamines. Preferred examples thereof are shown below, but by no means limited to these.

Diethylaminoethanol
Diethylaminobutanol
Diethylaminopropane-1,2-diol
Dimethylaminopropane-1,2-diol
Diethanolamine
Diethylamino-1-propanol
Triethanolamine
Dipropylaminopropane-1,2-diol
Dioctylamino-1-ethanol
Dioctylaminopropane-1,2-diol
Dodecylaminopropane-1,2-diol
Dodecylamino-1-propanol
Dodecylamino-1-ethanol
Aminopropane-1,2-diol
Diethylamino-2-propanol
Dipropanolamine
Glycine
Triethylamine
Triethylenediamine The amino compound may be contained in at least one layer of the coating layers on the light-sensitive layer side of the light-sensitive silver halide photographic material (for example, silver halide emulsion layers, protective layers, and hydrophilic colloid layers of subbing layers) and/or the developing solution. A preferred embodiment is an embodiment in which the compound is contained in the developing solution. The amino compound is contained in the amount that may vary depending on where it is contained, the type of the amino compound, and so forth, but is required to be in the amount by which the contrast can be promoted.

For the purpose of increasing development performance, a developing agent such as phenidone or hydroquinone and a restrainer such as benzotriazole can also be incorporated into the emulsion side. In another instance, for the purpose of enhancing the processing power of processing solutions, the developing agent or restrainer can be incorporated into a backing layer.

Although the hydrophilic colloid particularly advantageously used in this invention is gelatin, hydrophilic colloids other than gelatin may include, for example, colloidal albumin, agar, gum arabic, alginic acid, hydrolyzed cellulose acetate, acrylamide, imidized polyamide, polyvinyl alcohol, hydrolyzed polyvinyl acetate, gelatin derivatives such as phenylcarbanmyl gelatin, acylated gelatin and phthalated gelatin as disclosed, for example, in the specifications of U.S. Pat. Nos. 2,614,928 and 2,525,753, and gelatins graft-polymerized with a polymerizable monomer having an ethylene group such as styrene acrylate, acrylate, methacrylic acid or methacrylate, as disclosed in the specifications of U.S. Pat. Nos. 2,548,520 and 2,831,767. These hydrophilic colloids can also be applied in the layer containing no silver halide, as exemplified by anti-halation layers, protective layers, and intermediate layers.

The gelatin used in this invention can be any of those having been alkali-treated or acid-treated, but it is preferred to remove calcium or ion content when ossein gelatin is used. As preferred content, the calcium content may range from 1 to 999 ppm, and more preferably from 1 to 500 ppm. The ion content may preferably range from 0.01 to 50 ppm, and more preferably rom 0.1 to 10 ppm. The controlling of the quantity of calcium content or iron content like this can be achieved by passing a gelatin solution through an ion-exchange apparatus.

The support used in this invention typically includes, for example, baryta paper, polyethylene-coated paper, polypropylene synthetic paper, glass sheets, cellulose acetate film, cellulose nitrate film, polyester films as exemplified by polyethylene terephthalate film, polyamide film, polypropylene film, polycarbonate film, and polystyrene film. Particularly preferred supports are polyethylene terephthalate film and cellulose acetate film. These supports are each appropriately selected depending on the purpose for which the light-sensitive silver halide photographic material is used.

The developing agent used in the developing of the light-sensitive silver halide photographic material according to this invention includes the following. A developing agent of an $HO—(CH{=}CH)_nOH$ type is typified by hydroquinone; besides, catechol, pyrogallol and derivatives thereof, as well as ascorbic acid, chlorohydroquinone, bromohydroquinone, methylhydroquinone, 2,3-dibromohydroquinone, 2,5-diethylhydroquinone, 4-chlorocatechol, 4-phenyl-catechol, 3-methoxycatechol, 4-acetyl-pyrogallol, and sodium ascorbate.

A developing agent of an $HO—(CH{=}CH)_n—NH_2$ type is typified by o-aminophenol and p-aminophenol, including 4-aminophenol, 2-amino-6-phenylphenol, 2-amino-4-chloro-6-phenylphenol, and N-methyl-p-aminophenol.

A developing agent of an $H_2N—(CH{=}CH)_n—NH_2$ type includes, for example, 4-amino-2-methyl-N,N-diethylaniline, 2,4-diamino-N,N-diethylaniline, N-(4-amino-3-methylphenyl)morpholine, and p-phenylenediamine.

A developing agent of a heterocyclic type includes 3-pyrazolidones such as 1-phenyl-3-pyrazolidone, 1-phenyl-4,4-dimethyl-3-pyrazolidone, and 1-phenyl-4-methyl-4-hydroxymethyl-3-pyrazolidone; 1-phenyl-4-amino-5-pyrazolone, and 5-aminouracil.

Besides, the developing agents as described in T. H. James, The Theory of the Photographic Process, Fourth Edition, pp.291–334, and Journal of the American Chemical Society, Vol. 73, p.3,100 (1951) can be effectively used in this invention. These developing agents may be used alone or in combination of two or more kinds, but it is preferred to use two or more kinds in combination.

The preferred combination include a combination of hydroquinone with phenidone, or hydroquinone with dimethone. It is desirable to use hydroquinone in an amount of 5 g/lit; and phenidone or dimethone, in an amount ranging from 0.05 to 5 g/lit.

In the developing solution used in the light-sensitive material of this invention, a sulfite such as sodium sulfite, potassium sulfite or ammonium sulfite may be used as a preservative, without impairing the effect of this invention. This can be said to be a characteristic of this invention. The sulfite may desirably be in a concentration of from 0.06 to 1 gram ion/lit. Hydroxylamine or hydrazide compounds may also be used as the preservative. In this instance, they may preferably be used in an amount of from 5 to 500 g, and more preferably from 20 to 200 g, per liter of the developing solution.

The developing solution may also contain glycols as an organic solvent. Such glycols include ethylene glycol, diethylene glycol, propylene glycol, triethylene glycol, 1,4-butanediol and 1,5-pentanediol, but diethylene glycol is preferably used. These glycols may preferably be used in an amount of from 5 to 500 g, and more preferably from 20 to 200 g, per liter of the developing solution. These organic solvents can be used alone or in combination.

Besides, it is optional to control the pH and impart the function as a buffer, using a caustic alkali, a carbonic alkali or an amine, and also to add an inorganic development restrainer such as potassium bromide; a metal ion scavenger such as ethylenediaminetetraacetic acid; a development accelerator such as methanol, ethanol, benzyl alcohol, or polyalkylene oxide; a surface active agent such as a sodium alkylarylsulfonate, natural saponin, a saccharide, or an alkylester of any of the above compounds; a hardening agent such as glutaldehyde, formalin, or glyoxal; and an ionic strength modifier such as sodium sulfate.

The light-sensitive silver halide photographic material according to this invention is subjected to development processing, using the developing solution containing the development restrainer as described above. A light-sensitive material with a very good shelf stability can be thus obtained.

The developing solution having the above composition may preferably have a pH value of from 9 to 12, and more preferably have a pH value ranging from 10 to 11 from the viewpoints of preservativity and photographic performance. On account of cations in the developing solution, a developing solution having a higher proportion of potassium ions than sodium ions is preferred since its activities can be increased correspondingly.

The light-sensitive silver halide photographic material according to this invention can be processed under various conditions. Processing temperature, for example, developing temperature, may preferably be not higher than 50° C., and particularly preferably from about 25° C. to 40° C. As to the development time, it is common for the development to be completed in 3 minutes, preferably in 2 minutes, and particularly preferably in from 10 seconds to 50 seconds to often bring about good results. Processing steps other than the developing, as exemplified by the steps of washing, stopping, stabilizing, fixing, and further, if necessary, pre-hardening, neutralizing, etc. may be optionally employed, and thus these steps can be appropriately omitted. In addition, these processing steps may also be in accordance with so-called manual development processing such as tray development or frame development, or mechanical development such as roller development or hanger development.

EXAMPLES

This invention will be specifically described below by giving Examples. As a matter of course, this invention is by no means limited to the following Examples.

EXAMPLE 1

Under acidic conditions of pH 3.0, grains containing $10^{-5}$ mol of rhodium, per mol of silver, were prepared according to a controlled double jet method. The growth of grains was effected in a system containing 30 mg of benzyladenine, per liter of an aqueous 1% gelatin solution. After the mixing of silver and halide, 600 mg of 6-methyl-4-hydroxy-1,3,3a,7-tetrazaindene, per mol of silver halide, was added and thereafter washing and desalting were carried out.

Subsequently, 60 mg of 6-methyl-4-hydroxy-1,3,3a,7-tetrazaindene, per mol of silver halide, was added and thereafter sulfur sensitization was carried out. After the sulfur sensitization, 6-methyl-4-hydroxy-1,3,3a,7-tetrazaindene was added as a stabilizer.

Silver halide emulsion layer

Additives were each added in the above emulsions so as to give the following amount per unit area, to prepare a solution. The resulting solution was coated on a polyethylene terephthalate support (thickness: 100 μm) having been subjected to latex subbing treatment according to Example 1 in Japanese Unexamined Patent Publication No. 19941/1984.

| | |
|---|---|
| Latex polymer: Styrene/butyl acrylate/acrylic acid terpolymer | 1.0 g/m$^2$ |
| Tetraphenylphosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 200 mg/m$^2$ |
| Phenidone | 100 mg/m$^2$ |
| Sodium styrenesulfonate/maleic acid copolymer (Mw = 250,000) | 200 mg/m2 |
| Butyl gallate | 500 mg/m$^2$ |
| Hydrazine compound [the compound of Formula (IV)] or tetrazolium compound [the compound of Formula (V)] as shown in Table 1 | |
| 5-Methylbenzotriazole | 30 mg/m$^2$ |
| 2-Mercaptobenzimidazole-5-sulfonic acid | 30 mg/m$^2$ |
| Inert ossein gelatin (isoelectric point: 4.9) | 1.5 g/m$^2$ |
| 1-(p-Acetylamidophenyl)-5-mercaptotetrazole | 30 mg/m$^2$ |
| Silver weight | 2.8 g/m$^2$ |

(Emulsion layer protective film)

A solution with the following composition was prepared and coated to provide a emulsion layer protective film. Fluorinated dioctylsulfosuccinic acid ester

| | |
|---|---|
| Fluorinated dioctylsulfosuccinic acid ester | 300 mg/m$^2$ |
| Matting agent: Polymethyl methacrylate (average particle diameter: 3.5 μm) | 100 mg/m$^2$ |
| Lithium nitrate | 30 mg/m$^2$ |
| Acid-treated gelatin (isoelectric point: 7.0) | 1.2 g/m$^2$ |
| Colloidal silica | 50 mg/m$^2$ |
| Sodium styrenesulfonate/maleic acid copolymer | 100 mg/m$^2$ |

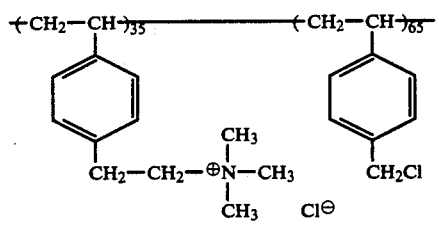

Vat dye

Backing layer

On the side opposite to the emulsion layer side, the support was previously subjected to corona discharging at a power of 30 W/m$^2$·min. Thereafter, a butadiene/styrene/divinylbenzene/acrylic acid latex polymer was coated in the presence of a hexamethylene aziridine hardening agent, followed by heating at 160° C. for 10 seconds and further corona discharging. Subsequently, 1 g/m$^2$ of a conductive polymer used in the non-gelatin layer (as shown in Table 1) was mixed with a styrene/-butyl acrylate/acrylic acid polymer, and the mixture was coated thereon. Next, on the resulting layer, a backing layer containing a backing dye with the following composition was provided by coating. The gelatin layer was hardened using glyoxal and sodium 1-oxy-3,5-dichloro-S-triazine.

| | |
|---|---|
| Hydroquinone | 100 mg/m$^2$ |
| Phenidone | 30 mg/m$^2$ |
| Latex polymer: Butyl acrylate/styrene copolymer | 0.5 g/m$^2$ |
| Styrene/maleic acid copolymer | 100 mg/m$^2$ |
| Citric acid | 40 mg/m$^2$ |
| Benzotriazole | 100 mg/m$^2$ |
| Lithium nitrate | 30 mg/m$^2$ |
| Backing dye | (a) to (c) shown below |
| Ossein gelatin | 2.0 g/m$^2$ |
| Compound of this invention, having the sulfonic acid group | 0.5 g/m$^2$ |

(a)

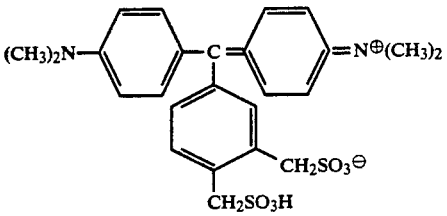

40 mg/m$^2$ (b)

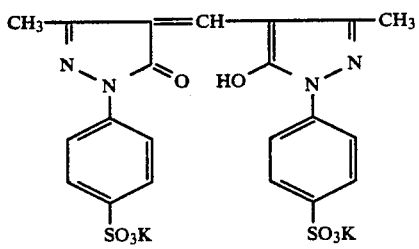

30 mg/m$^2$ (c)

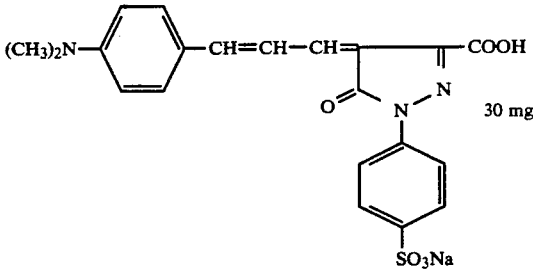

30 mg/m$^2$

Samples obtained in the above way were exposed to light using the light source as shown below and subjected to development processing using the following developing solution and fixing solution.

Exposure method

A non-electrode discharge light source having a maximum of specific energy at 360 to 450 nm, called "V-bulb", manufactured by Fusion Co., U.S.A., or a conventional light source having a maximum of specific energy at 340 to 380 nm, called "D-bulb", was set beneath a glass sheet, and an original and the light-sensitive material were placed on the glass surface so that the superimposition quality can be evaluated. Exposure was then carried out.

| (Formulation of developing solution) | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |

Made up to 1 liter with water.
The pH was adjusted to 11.5 using sodium hydroxide.

Formulation of fixing solution

| | |
|---|---|
| Composition A: | |
| Ammonium thiosulfate (an aqueous 72.5 wt. % solution) | 240 ml |
| Sodium sulfite | 17 g |
| Sodium acetate.trihydrate | 6.5 g |
| Boric acid | 6 g |
| Sodium citrate.dihydrate | 2 g |
| Acetic acid (an aqueous 90 wt. % solution) | 13.6 ml |
| Composition B: | |
| Pure water (ion-exchanged water) | 17 ml |
| Sulfuric acid (an aqueous 50 wt. % solution) | 3.0 g |
| Aluminum sulfate (an aqueous solution with a content of 8.1 wt. % in terms of $Al_2O_3$) | 20 g |

When using the fixing solution, the above Composition A and Composition B were dissolved in this order in 500 ml of water, and the solution was made up to 1 liter. The pH of this fixing solution was about 5.6.

(Development processing conditions)

| Step | Temperature | Time |
|---|---|---|
| Developing | 40° C. | 8 seconds |
| Fixing | 35° C. | 8 seconds |
| Washing | Room temp. | 10 seconds |

Evaluation was made in the following way. Results obtained are shown in Table 1.

Evaluation method for photographic performance (1) Pinhole suppression performance:

A halftone film was placed on a base for mounting, and the periphery of the halftone film was further kept fastened with a transparent Scotch tape used for plate making. After the exposure and development processing were carried out, the sample free from pinholes was judged as "5", and the sample with pinholes generated in a largest number at the worst level, as "1" to make relative five-rank evaluation.

(2) Superimposition quality:

The superimposition quality refers to the image quality that enables reproduction of a 50 μm line-width image on a line image film when correct exposure was carried out so that an area having a 50% halftone dot area may give a 50% halftone dot area on the contact light-sensitive material. A very good superimposition quality was judged as "5", and an image quality with the worst level, as "1" to make relative five-rank evaluation.

Results obtained are shown in Table 1.

TABLE 1

| Sample No. | Backing layer: Non-gelatin layer polymer | Backing layer: Gelatin layer polymer | Backing layer: Corona discharging | Backing layer: Ca content in gelatin (ppm) | Backing layer: Fe content in gelatin (ppm) | Emulsion layer: Tetrazolium compound (1.5 g/mol Ag) | Emulsion layer: Hydrazine compound (1.2 g/mol Ag) | Photographic Performance: Pinholes | Photographic Performance: Superimposition | Remarks |
|---|---|---|---|---|---|---|---|---|---|---|
| 1 | — | — | — | 2,000 | 10 | — | — | 1 | 1 | Compa. |
| 2 | — | — | — | 2,000 | 10 | — | IV-1 | 2 | 2 | Compa. |
| 3 | — | — | — | 2,000 | 10 | V-3 | — | 2 | 3 | Compa. |
| 4 | (1) | — | — | 2,000 | 10 | V-3 | — | 3 | 3 | Compa. |
| 5 | (1) | (26) | — | 2,000 | 10 | V-3 | — | 3 | 3 | Compa. |
| 6 | (1) | (26) | Treated | 2,000 | 10 | V-3 | — | 4 | 4 | Inv. |
| 7 | (1) | (26) | Treated | 200 | 10 | V-3 | — | 4.5 | 4 | Inv. |
| 8 | (1) | (26) | Treated | 200 | 2 | V-3 | — | 5 | 5 | Inv. |
| 9 | (1) | (26) | Treated | 200 | 2 | — | IV-53 | 5 | 4 | Inv. |
| 10 | (3) | (26) | Treated | 200 | 2 | — | IV-53 | 5 | 4 | Inv. |
| 11 | (5) | (26) | Treated | 200 | 2 | — | IV-53 | 5 | 4 | Inv. |
| 12 | (6) | (26) | Treated | 200 | 2 | — | IV-53 | 5 | 4 | Inv. |
| 13 | (9) | (26) | Treated | 200 | 2 | — | IV-53 | 5 | 5 | Inv. |
| 14 | (1) | (40) | Treated | 200 | 2 | — | IV-53 | 5 | 4 | Inv. |
| 15 | (1) | (28) | Treated | 200 | 2 | — | IV-59 | 5 | 5 | Inv. |
| 16 | (1) | (29) | Treated | 200 | 2 | — | IV-59 | 5 | 4 | Inv. |
| 17 | (1) | (30) | Treated | 200 | 2 | — | IV-59 | 5 | 5 | Inv. |
| 18 | (1) | (1) | Treated | 200 | 2 | — | IV-59 | 5 | 5 | Inv. |
| 19 | (1) | (2) | Treated | 200 | 2 | — | IV-59 | 5 | 4 | Inv. |
| 20 | (1) | (3) | Treated | 200 | 2 | — | IV-59 | 5 | 5 | Inv. |

As will be seen from Table 1, Samples 6 to 20 constituted according to this invention show that there can be obtained light-sensitive materials having remarkably improved superimposition quality and less generation of pinholes, compared with comparative samples.

EXAMPLE 2

Emulsions were prepared in the same manner as Example 1, except that the rhodium was aded in an amount of $1\times10^{-6}$ per mol of silver halide and also sulfur-gold sensitization was applied in place of the sulfur sensitization. The following two kinds were also added as sensitizing dyes.

The following dye was added in the emulsion layer protective film layer.

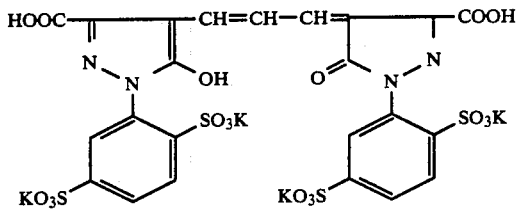

10 mg/m²

The following dye was also added as the backing dye.

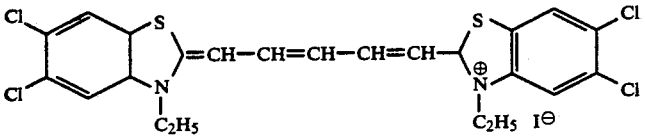

30 mg/m²

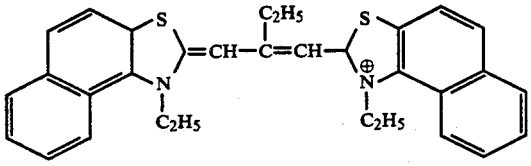

Br⊖

30 mg/m²

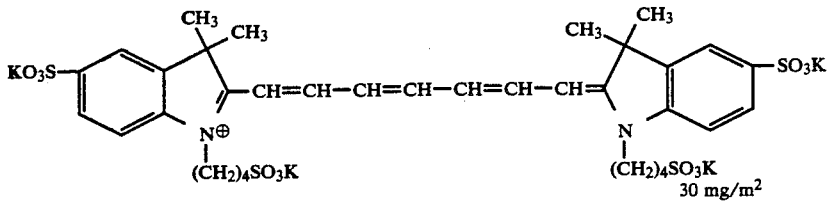

The gelatin layer was hardened using the following two types of hardening agents. The amount for addition is expressed as the amount per 1 g of gelatin.

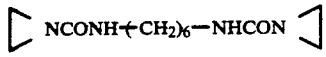

20 mg $CH_2=CH-SO_2-CH_2-O-CH_2-SO_2-CH=CH_2$ 50 mg

Other additives were added as shown in Table 1 for Samples 1 to 8. Exposure was carried out for $10^{-5}$ second using a xenon bulb. Results obtained are shown in Table 2.

TABLE 2

| Sample No. | Pinholes | Contrast (Sharpness) | Remark |
|---|---|---|---|
| 1 | 1 | 1 | Comparative |
| 2 | 2 | 2 | Comparative |
| 3 | 2 | 2 | Comparative |
| 4 | 3 | 2 | Comparative |
| 5 | 3 | 2 | Comparative |
| 6 | 4 | 4 | This inv. |
| 7 | 5 | 5 | This inv. |
| 8 | 5 | 5 | This inv. |

As will be evident also from the results shown in Table 2, the samples containing the conductive polymer of this invention and subjected to corona discharge treatment are seen to have suppressed the generation of pinholes and also have superior sharpness.

As described above, this invention has made it possible to provide a light-sensitive silver halide photographic material having superior photographic performance such that generation of pinholes can be suppressed, and also high contrast line-image photographing, scanner setting and contacting can be achieved with good performance.

EXAMPLE 3

On the opposite side of a polyethylene terephthalate support coated with a light-sensitive silver halide photographic emulsion prepared following a conventional method, latex subbing treatment was applied following Example 1 in Japanese Unexamined Patent Publication No. 19941/1984. Thereafter, a polymer layer (non-gelatin layer), a gelatin layer, an anti-halation layer and an anti-halation layer protective layer which are composed as described below were applied and dried to prepare samples.

| (Polymer layer) | |
|---|---|
| Latex polymer: Butyl acrylate/styrene/acrylic acid terpolymer | 0.2 g/m² |
| Polymer of this invention | as shown in Table 3 |
| Hardening agent (H) | 20 mg/m² |

-continued (Polymer layer)

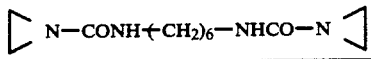

Backing layer

On the resulting layer, a backing layer containing a backing dye with the following composition was provided by coating. The gelatin layer was hardened using glyoxal and sodium 1-oxy-3,5-dichloro-S-triazine.

| | |
|---|---|
| Hydroquinone | 100 mg/m² |
| Phenidone | 30 mg/m² |
| Latex polymer: Butyl acrylate/styrene copolymer | 0.5 g/m² |
| Styrene/maleic acid copolymer | 100 mg/m² |
| Citric acid | 40 mg/m² |
| Benzotriazole | 100 mg/m² |
| Lithium nitrate | 30 mg/m² |
| Backing dye | (a) described in Example 1 |
| Ossein gelatin | 2.0 g/m² |
| Compound of this invention, having the sulfonic acid group (Compound (26)) | 0.5 g/m² |
| Calcium | 2,000 ppm in gelatin |
| Iron | 10 ppm in gelatin |
| (Anti-halation layer) | |
| Styrene/maleic acid copolymer | 100 mg/m² |
| Citric acid (adjusted to pH 5.4 after coating) | 40 mg/m² |
| Saponin | 200 mg/m² |
| Lithium nitrate | 30 mg/m² |
| Backing dye | The compounds (a), (b) and (c) used in Example 1 and contents thereof |
| Alkali-treated gelatin | 2.0 g/m² |
| Formalin | 10 mg/m² |

Anti-halation layer protective layer

Additives were each added so as to give the following amount per unit area, to prepare a solution. The resulting solution was coated on the top of the backing layer.

| | |
|---|---|
| Dioctylsulfosuccinate | 200 mg/m² |
| Matting agent: Polymethyl methacrylate (average particle diameter: 4.0 μm) | 50 mg/m² |
| Fluorinated sodium dodecylbenzenesulfonate | 50 mg/m² |

The compound of this invention, capable of binding with magnesium ions and/or calcium ions

| | the amount as shown in Table 3 |
|---|---|
| Alkali-treated gelatin | 1.0 g/m² |
| Formalin | 10 mg/m² |

The samples thus obtained were processed using the developing solution and fixing solution having the following composition and under the following conditions by using an automatic processing machine. In preparing the processing solutions such as the developing solution and fixing solution, ordinary city water was used.

| (Formulation of developing solution) | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |

Made up to 1 liter with water.
The pH was adjusted to 11.5 using sodium hydroxide.

Formulation of fixing solution

| | |
|---|---|
| Composition A: | |
| Ammonium thiosulfate (an aqueous 72.5 wt. % solution) | 240 ml |
| Sodium sulfite | 17 g |
| Sodium acetate.trihydrate | 6.5 g |
| Boric acid | 6 g |
| Sodium citrate.dihydrate | 2 g |
| Acetic acid (an aqueous 90 wt. % solution) | 13.6 ml |
| Composition B: | |
| Pure water (ion-exchanged water) | 17 ml |
| Sulfuric acid (an aqueous 50 wt. % solution) | 4.7 g |
| Aluminum sulfate (an aqueous solution with a content of 8.1 wt. % in terms of $Al_2O_3$) | 26.5 g |

When using the fixing solution, the above Composition A and Composition B were dissolved in this order in 500 ml of water, and the solution was made up to 1 liter. The pH of this fixing solution was about 4.3.

(Development processing conditions)

| Step | Temperature | Time |
|---|---|---|
| Developing | 40° C. | 15 seconds |
| Fixing | 35° C. | 10 seconds |
| Washing | Room temp. | 10 seconds |

Results obtained are shown in Table 3.

TABLE 3

| Sample No. | Polymer of Formula (I) No. | Polymer of Formula (I) Amount | Compound Type | Compound Amount | Specific resintance Before processing | Specific resintance After processing | Remarks |
|---|---|---|---|---|---|---|---|
| 21 | — | — | — | — | $5 \times 10^{13}$ | $8 \times 10^{13}$ | Compa. |
| 22 | I-4 | 0.5 | — | — | $4 \times 10^{9}$ | $5 \times 10^{13}$ | Compa. |
| 23 | I-4 | 0.5 | A | 0.5 | $4 \times 10^{9}$ | $5 \times 10^{10}$ | Inv. |
| 24 | I-4 | 1.0 | A | 0.2 | $7 \times 10^{8}$ | $7 \times 10^{10}$ | Inv. |
| 25 | I-8 | 1.0 | A | 0.2 | $4 \times 10^{8}$ | $6 \times 10^{9}$ | Inv. |
| 26 | I-8 | 0.5 | B | 0.2 | $2 \times 10^{9}$ | $4 \times 10^{10}$ | Inv. |

In the table, "Compound" represents the compound capable of binding with magnesium ions and/or calcium ions. A denotes a hydrolyzed maleic anhydride polymer, and B, a cyclodextrin polymer.

Unit for the amount of the polymer and compound each is expressed in g/m². Surface specific resistance is expressed in Ω/cm.

It is seen from the results shown in Table 3 that the samples according to this invention undergo less deterioration of the antistatic performance after the development processing, and hence are remarkably improved compared with the comparative samples.

Thus, this invention has made it possible to provide a light-sensitive silver halide photographic material that causes no deterioration of the antistatic performance even after the processing such as developing.

EXAMPLE 4

Preparation of emulsion

Under acidic conditions of pH 3.0, silver chlorobromide grains containing $10^{-5}$ mol of rhodium, per mol of silver, having an average grain size of 0.11 μm, a degree of monodispersion in silver halide composition, of 15, and containing 5 mol % of silver bromide were prepared according to a controlled double jet method. The growth of grains was effected in a system containing 30 mg of benzyladenine, per liter of an aqueous 1% gelatin solution. After the mixing of silver and halide, 600 mg of 6-methyl-4-hydroxy-1,3,3a,7-tetrazaindene, per mol of silver halide, was added and thereafter washing and desalting were carried out.

Subsequently, 60 mg of 6-methyl-4-hydroxy-1,3,3a,7-tetrazaindene, per mol of silver halide, was added and thereafter 15 mg of sodium thiosulfate, per mol of silver halide, was added to carry out sulfur sensitization at 60° C. After the sulfur sensitization, 6-methyl-4-hydroxy-1,3,3a,7-tetrazaindene was added as a stabilizer in an amount of 600 mg per mol of silver halide.

Additives were each added in the above emulsion so as to give the following amount per unit area, to prepare a solution. The resulting solution was coated on one side of a 100 μm thick polyethylene terephthalate support having been subjected to latex subbing treatment according to Example 1 in Japanese Unexamined Patent Publication No. 19941/1984.

| | |
|---|---|
| Latex polymer: Styrene/butyl acrylate/acrylic acid terpolymer | 1.0 g/m² |
| Tetraphenylphosphonium chloride | 30 mg/m² |
| Saponin | 200 mg/m² |
| Polyethylene glycol | 100 mg/m² |
| Hydroquinone | 200 mg/m² |
| Styrene/maleic acid copolymer | 20 mg/m² |
| Hydrazine compound | as shown in Table 4 |
| 5-Methylbenzotriazole | 30 mg/m² |
| Desensitizing dye (M) | 20 mg/m² |

| | |
|---|---|
| Alkali-treated gelatin (isoelectric point: 4.9) | 1.5 g/m² |
| Bis(vinylsulfonylmethyl) ether | 15 mg/m² |

-continued

| | |
|---|---|
| Silver weight | 2.8 g/m$^2$ |

Desensitizing dye (M)

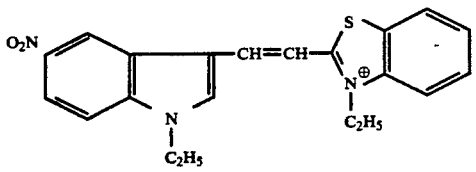

(Emulsion layer protective film)

A solution with the following composition was prepared and simultaneously coated layer by layer together with the emulsion to provide a emulsion layer protective film.

| | |
|---|---|
| Fluorinated dioctylsulfosuccinic acid ester | 200 mg/m$^2$ |
| Sodium dodecylbenzenesulfonate | 100 mg/m$^2$ |
| Matting agent: Polymethyl methacrylate (average particle diameter: 3.5 μm) | 100 mg/m$^2$ |
| Lithium nitrate | 30 mg/m$^2$ |
| Propyl gallate | 300 mg/m$^2$ |
| Sodium 2-mercaptobenzimidazole-5-sulfonate | 30 mg/m$^2$ |
| Alkali-treated gelatin (isoelectric point: 4.9) | 1.3 g/m$^2$ |
| Colloidal silica | 30 mg/m$^2$ |
| Styrene/maleic acid copolymer | 100 mg/m$^2$ |
| Bis(vinylsulfonylmethyl) ether | 15 mg/m$^2$ |

On the side opposite to the emulsion layer side, the support was previously subjected to corona discharging at a power of 30 W/m$^2$·min. Thereafter, a butadiene/-styrene/divinylbenzene/acrylic acid latex polymer was coated in the presence of a hexamethylene aziridine hardening agent, followed by heating at 160° C. for 10 seconds and further corona discharging. Subsequently, 1 g/m$^2$ of a conductive polymer to be used in the non-gelatin layer (Compound (1) as an exemplary compound) was mixed with a styrene/butyl acrylate/acrylic acid polymer, and the mixture was coated thereon.

Next, coated on the resulting layer was a solution prepared using additi-ves so as to give the following amount per unit area to give a backing layer.

| | |
|---|---|
| Latex polymer: Butyl acrylate/styrene copolymer | 0.5 g/m$^2$ |
| Water-soluble polymer of the formula (I) of this invention | as shown in Table 4 |
| Styrene/maleic acid copolymer | 100 mg/m$^2$ |
| Citric acid (adjusted to pH 5.4 after coating) | 40 mg/m$^2$ |
| Saponin | 200 mg/m$^2$ |
| Lithium nitrate | 30 mg/m$^2$ |
| Backing dye | The compounds of (a), (b) and (c) used in Example 1 and contents thereof. |
| Alkali-treated gelatin | 2.0 g/m$^2$ |
| Hardening agent of the formula (II) of this invention | as shown in Table 4 |

Backing layer protective film

Additives were each added so as to give the following amount per unit area, to prepare a solution. The resulting solution was simultaneously coated layer by layer on the top of the backing layer.

| | |
|---|---|
| Dioctyl sulfosuccinate | 200 mg/m$^2$ |
| Matting agent: Polymethyl methacrylate (average particle diameter: 4.0 μm) | 50 mg/m$^2$ |
| Alkali-treated gelatin (isoelectric point: 4.9) | 1.0 g/m$^2$ |
| Fluorinated sodium dodecylbenzenesulfonate | 50 mg/m$^2$ |
| Bis(vinylsulfonylmethyl) ether | 20 mg/m$^2$ |

The above coating solution was previously adjusted to have a pH of 5.4 and then coated. Samples obtained in this way were exposed to light using the light source as shown in Table 4 and subjected to development processing using the following developing solution and fixing solution.

Exposure method

A non-electrode discharge light source having a maximum of specific energy at 400 to 420 nm, called "V-bulb", manufactured by Fusion Co., U.S.A., or a conventional light source having a maximum of specific energy at 350 to 380 nm, called "D-bulb", was set beneath a glass sheet, and an original and the light-sensitive material were placed on the glass surface so that the superimposition quality can be evaluated. Exposure was then carried out.

| (Formulation of developing solution) | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |

Made up to 1 liter with water.

The pH was adjusted to 11.5 using sodium hydroxide.

| (Formulation of fixing solution) | |
|---|---|
| Composition A: | |
| Ammonium thiosulfate (an aqueous 72.5 wt. % solution) | 240 ml |
| Sodium sulfite | 17 g |
| Sodium acetate.trihydrate | 6.5 g |
| Boric acid | 6 g |
| Sodium citrate.dihydrate | 2 g |
| Acetic acid (an aqueous 90 wt. % solution) | 13.6 ml |
| Composition B: | |
| Pure water (ion-exchanged water) | 17 ml |
| Sulfuric acid (an aqueous 50 wt. % solution) | 4.7 g |
| Aluminum sulfate (an aqueous solution with a content of 8.1 wt. % in terms of $Al_2O_3$) | 26.5 g |

When using the fixing solution, the above Composition A and Composition B were dissolved in this order in 500 ml of water, and the solution was made up to 1 liter. The pH of this fixing solution was about 4.3.

(Development processing conditions)

| Step | Temperature | Time |
|---|---|---|
| Developing | 40° C. | 15 seconds |
| Fixing | 35° C. | 10 seconds |
| Washing | Room temp. | 10 seconds |

Evaluation was made in the following way. Results obtained are shown in Table 4.

Evaluation method for photographic performance (1) Pinhole suppression performance:

A halftone film was placed on a base for mounting, and the periphery of the halftone film was further kept fastened with a transparent Scotch tape used for plate making. After the exposure and development processing were carried out, the sample free from pinholes was judged as "5", and the sample with pinholes generated in a largest number at the worst level, as "1" to make relative five-rank evaluation.

(2) Superimposition quality:

The superimposition quality refers to the image quality that enables reproduction of a 50 μm line-width image on a line image film when correct exposure was carried out so that an area having a 50% halftone dot area may give a 50% halftone dot area on the contact light-sensitive material. A very good superimposition quality was judged as "5", and an image quality with the worst level, as "1" to make relative five-rank evaluation.

Results obtained are shown in Table 4.

TABLE 4

| Sample No. | Emulsion layer: Hydrazine compound (IV) No. | Emulsion layer: Hydrazine compound (IV) Amount (g/m²) | Backing layer: Polymer (I) No. | Backing layer: Polymer (I) Amount (mg/m²) | Backing layer: Hardening agent No. | Backing layer: Hardening agent Amount (mg/m²) | Exposure light source* | Photographic performance: Pinholes supression performance | Photographic performance: Super imposition performance | Remarks |
|---|---|---|---|---|---|---|---|---|---|---|
| 27 | — | — | — | — | — | — | D valve | 1 | 1 | Compa. |
| 28 | IV-67 | 50 | — | — | — | — | D valve | 1 | 3 | Compa. |
| 29 | IV-67 | 50 | — | — | II-1 | 100 | D valve | 1 | 2 | Compa. |
| 30 | IV-67 | 50 | I-4 | 0.2 | II-1 | 100 | D valve | 4 | 4 | Inv. |
| 31 | IV-67 | 50 | I-4 | 0.5 | II-1 | 100 | D valve | 5 | 4 | Inv. |
| 32 | IV-67 | 50 | I-4 | 1.0 | II-1 | 200 | D valve | 5 | 5 | Inv. |
| 33 | IV-68 | 80 | I-4 | 0.5 | II-1 | 100 | D valve | 5 | 4 | Inv. |
| 34 | IV-68 | 80 | I-12 | 0.5 | II-1 | 100 | D valve | 5 | 5 | Inv. |
| 35 | IV-68 | 80 | I-12 | 0.5 | II-3 | 150 | D valve | 5 | 4 | Inv. |
| 36 | IV-68 | 80 | I-22 | 0.5 | II-3 | 150 | V valve | 5 | 5 | Inv. |

*Energy maximum (nm)
Light source to give amount of exposure:
D-bulb: 350-380 nm
V-bulb: 400-420 nm As will be seen from Table 4, the generation of pinholes is suppressed and also the superimposition performance is improved when the light-sensitive material is provided with the silver halide emulsion layer containing the hydrazine compound and the backing layer containing the polymer and hardening agent according to this invention.

It is further shown that the light-sensitive material improved in the superimposition performance with less generation of pinholes can be obtained when the light source having an energy maximum at 400 to 420 nm is used as the light source.

EXAMPLE 5

In the same manner as Example 4, silver chlorobromide grains containing $10^{-5}$ mol of rhodium, per mol of silver, having an average grain size of 0.20 μm, a degree of monodispersion, of 20, and containing 2 mol % of silver bromide were prepared. This grains were treated, washed with water and desalted, followed by sulfur sensitization, in the same manner as Example 4.

In the resulting emulsion, additives were each added so as to give the following amount per unit area, to prepare a solution. The solution was coated on the polyethylene terephthalate support as used in Example 4, having been subjected to subbing treatment.

| | |
|---|---|
| Latex polymer: Styrene/butyl acrylate/acrylic acid terpolymer | 1.0 g/m² |
| Phenol | 1 mg/m² |
| Saponin | 200 mg/m² |
| Sodium dodecylbenzenesulfonate | 50 mg/m² |
| Tetrazolium compound | as shown in Table 5 |
| Compound (N) | 40 mg/m² |
| Compound (O) | 50 mg/m² |
| Styrene/maleic acid copolymer | 20 mg/m² |
| Alkali-treated gelatin (isoelectric point: 4.9) | 2.0 g/m² |
| Silver weight | 3.5 g/m² |
| Formalin | 10 mg/m² |

Compound (N)

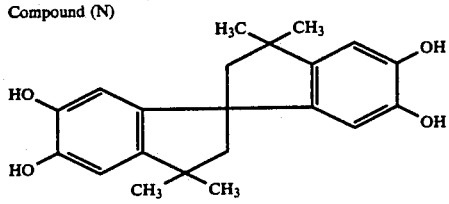

Compound (O)

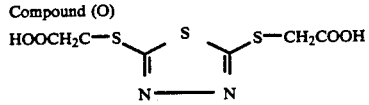

The coating solution was previously adjusted to pH 6.5 using sodium hydroxide and then coated. Additives were each added so as to give the following amount per unit area, to prepare a solution. The solution was simultaneously coated layer by layer together with the emulsion coating solution to provide a emulsion layer protective film.

| | |
|---|---|
| Fluorinated dioctylsulfosuccinic acid ester | 100 mg/m² |
| Dioctylsulfosuccinate | 100 mg/m² |
| Matting agent: Amorphous silica | 50 mg/m² |
| Compound (O) | 30 mg/m² |
| 5-Methylbenzotriazole | 20 mg/m² |
| Compound (P) | 500 mg/m² |
| Propyl gallate | 300 mg/m² |
| Styrene/maleic acid copolymer | 100 mg/m² |
| Alkali-treated gelatin (isoelectric point: 4.9) | 1.0 g/m² |
| Formalin | 10 mg/m² |

The solution was previously adjusted to pH 5.4 using citric acid, and then coated.

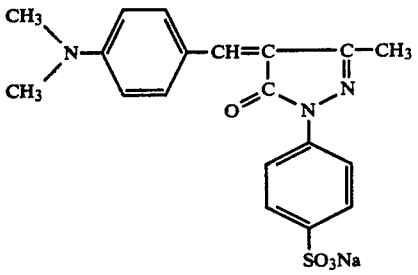

Compound (P)

-continued

| Composition B: | |
|---|---|
| Pure water (ion-exchanged water) | 3 mg |
| Diethylene glycol | 50 g |
| Disodium ethylenediaminetetraacetate | 25 mg |
| Acetic acid (an aqueous 90% solution) | 0.3 ml |
| 1-Phenyl-3-pyrazolidone | 500 mg |

When using the developing solution, the above Composition A and Composition B were dissolved in this order in 500 ml of water, and the solution was made up to 1 liter.

TABLE 5

| Sample No. | Emulsion layer Tetrazolium compound (V) No. | Amount (g/m²) | Backing layer Polymer (I) No. | Amount (mg/m²) | Hardening agent (II) No. | Amount (mg/m²) | Exposure light source* | Photographic performance Pinholes supression performance | Super imposition performance | Remarks |
|---|---|---|---|---|---|---|---|---|---|---|
| 37 | — | — | — | — | — | — | D valve | 1 | 1 | Compa. |
| 38 | Vd-2 | 50 | — | — | — | — | D valve | 1 | 3 | Compa. |
| 39 | Vd-2 | 50 | — | — | II-1 | 100 | D valve | 1 | 3 | Compa. |
| 40 | Vd-2 | 50 | I-4 | 0.2 | II-1 | 100 | D valve | 4 | 4 | Inv. |
| 41 | Vd-2 | 50 | I-4 | 0.5 | II-1 | 100 | D valve | 5 | 4 | Inv. |
| 42 | Vd-2 | 50 | I-4 | 1.0 | II-1 | 200 | D valve | 5 | 5 | Inv. |
| 43 | Vd-7 | 40 | I-4 | 0.5 | II-1 | 100 | D valve | 5 | 4 | Inv. |
| 44 | Vd-7 | 40 | I-12 | 0.5 | II-1 | 100 | D valve | 5 | 5 | Inv. |
| 45 | Vd-7 | 40 | I-12 | 0.5 | II-3 | 100 | D valve | 5 | 4 | Inv. |
| 46 | Vd-7 | 40 | I-22 | 0.5 | II-3 | 100 | V valve | 5 | 5 | Inv. |

*Energy maximum (nm)
Light source to give amount of exposure:
D-bulb: 350–380 nm
V-bulb: 400–420 nm Next, on the side opposite to the emulsion layer side, the support was provided with a backing layer in entirely the same manner as Example 4. The water-soluble polymer of the formula (I) and hardening agent of the formula (II) used are as shown in Table 5. The samples obtained were subjected to exposure and development processing in the same manner as Example 4. However, the following developing solution was used. Results obtained are shown in Table 5.

Composition A:

| | |
|---|---|
| Pure water (ion-exchanged water) | 150 ml |
| Disodium ethylenediaminetetraacetate | 2 g |
| Diethylene glycol | 50 g |
| Potassium sulfite (an aqueous 55% w/v solution) | 100 ml |
| Potassium carbonate | 50 g |
| Hydroquinone | 15 g |
| 1-Phenyl-5-mercaptotetrazole | 30 mg |
| Potassium hydroxide in the amount that may adjust the pH of the solution used, to 10.4. | |
| Potassium bromide | 4.5 g |

As will be evident also from the results shown in Table 5, it is seen that, in the combination according to this invention, the generation of pinholes is suppressed and the superimposition performance is improved also when the tetrazolium compound is used in the silver halide emulsion layer.

EXAMPLE 6

In Example 5, a sample was prepared in which a layer containing the water-soluble polymer of the formula (I) of this invention and the hardening agent of the formula (II) as shown in Table 6 is provided between the backing layer and the subbing-treated support.

Also prepared was a sample in which the water-soluble polymer of the formula (I) of this invention is contained also in the backing layer and/or backing layer protective layer.

The resulting samples were subjected to exposure and development processing in the same manner as Example 5. Evaluation was also made in the same way.

Results obtained are shown in Table 6.

TABLE 6-1

| Sample No. | Emulsion layer Tetrazolium compound (V) No. | Amount (g/m²) | Polymer content Polymer (I) No. | Amount (g/m²) | Hydophobic polymer No. | Amount (g/m²) | Hardening agent source* No. | Amount (mg/m²) | Backing layer Conductive polymer (I) No. | Amount (g/m²) | Hardening agent (II) No. | Amount (mg/m²) |
|---|---|---|---|---|---|---|---|---|---|---|---|---|
| 47 | V-2 | 50 | — | — | — | — | — | — | — | — | — | — |
| 48 | V-2 | 50 | I-4 | 0.2 | — | — | II-1 | 100 | — | — | — | — |
| 49 | V-2 | 50 | I-4 | 0.5 | — | — | II-1 | 100 | — | — | — | — |
| 50 | V-2 | 50 | I-4 | 1.0 | — | — | II-1 | 200 | — | — | — | — |
| 51 | V-2 | 50 | I-4 | 0.5 | A* | 0.2 | II-1 | 200 | — | — | — | — |
| 52 | V-2 | 50 | I-4 | 0.8 | A* | 0.2 | II-1 | 200 | — | — | — | — |
| 53 | V-2 | 50 | I-4 | 0.8 | A* | 0.2 | II-1 | 200 | I-4 | 0.1 | Glyoxal | 10 |
| 54 | V-2 | 50 | I-4 | 0.8 | A* | 0.2 | II-1 | 200 | I-4 | 0.5 | Glyoxal | 10 |
| 55 | V-8 | 40 | I-4 | 0.8 | A* | 0.2 | II-1 | 200 | — | — | Glyoxal | 10 |
| 56 | V-8 | 40 | I-22 | 1.0 | — | — | II-3 | 150 | — | — | — | — |

TABLE 6-1-continued

| Sample No. | Emulsion layer Tetrazolium compound (V) No. | Amount (g/m²) | Polymer content Polymer (I) No. | Amount (g/m²) | Hydophobic polymer No. | Amount (g/m²) | Hardening agent source* No. | Amount (mg/m²) | Backing layer Conductive polymer (I) No. | Amount (g/m²) | Hardening agent (II) No. | Amount (mg/m²) |
|---|---|---|---|---|---|---|---|---|---|---|---|---|
| 57 | V-8 | 40 | I-22 | 1.0 | — | — | II-3 | 150 | I-22 | 0.1 | II-3 | 150 |

*Compound of the formula (A)

(A) 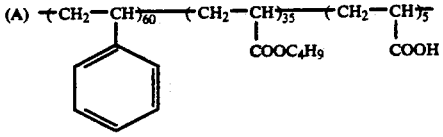

Molecular weight: 1,000,000.

TABLE 6-2

| Sample | Backing layer protective layer Polymer (I) No. | Amount (g/m²) | Hardening agent No. | Amount (mg/m²) | Exposure light source* | Photographic performance Pinhole supression performance | Super imposition performance | Remarks |
|---|---|---|---|---|---|---|---|---|
| 47 | — | — | — | — | D valve | 1 | 3 | Comparative |
| 48 | — | — | — | — | D valve | 4 | 4 | Invention |
| 49 | — | — | — | — | D valve | 4 | 5 | Invention |
| 50 | — | — | — | — | D valve | 5 | 5 | Invention |
| 51 | — | — | — | — | D valve | 4 | 5 | Invention |
| 52 | — | — | — | — | D valve | 4.5 | 5 | Invention |
| 53 | I-4 | 0.1 | Glyoxal | 5 | D valve | 5 | 5 | Invention |
| 54 | — | — | — | — | D valve | 5 | 5 | Invention |
| 55 | I-22 | 0.1 | Glyoxal | 5 | D valve | 5 | 5 | Invention |
| 56 | — | — | — | — | D valve | 4.5 | 5 | Invention |
| 57 | I-22 | 0.1 | II-3 | 100 | D valve | 5 | 5 | Invention |

As will be evident also from the results shown in Table 6, it is seen that, in the combination according to this invention, the generation of pinholes is suppressed and the superimposition performance is improved also when the water-soluble polymer-containing layer is provided between the backing layer and the subbing-treated support.

It was further found that the generation of pinholes can be better suppressed when the water-soluble polymer of the formula (I) of this invention is used in combination in the backing layer and/or backing layer protective layer, even in a small amount.

As described above, this invention can provide a light-sensitive silver halide photographic material having the photographic performance such that the generation of pinholes can be suppressed and also a good superimposition quality can be obtained, and can make image formation with such performance.

EXAMPLE 7

Under acidic conditions of pH 3.0, grains containing $10^{-5}$ mol of rhodium, per mol of silver, having an average grain size and a degree of monodispersion in silver halide composition, as shown in Table 7 below were prepared according to a controlled double jet method. The growth of grains was effected in a system containing 30 mg of benzyladenine, per liter of an aqueous 1% gelatin solution. After the mixing of silver and halide, 600 mg of 6-methyl-4-hydroxy-1,3,3a,7-tetrazaindene, per mol of silver halide, was added and thereafter washing and desalting were carried out.

Subsequently, 60 mg of 6-methyl-4-hydroxy-1,3,3a,7-tetrazaindene, per mol of silver halide, was added and thereafter sulfur sensitization was carried out. After the sulfur sensitization, 6-methyl-4-hydroxy-1,3,3a,7-tetrazindene was added as a stabilizer.

Silver halide emulsion layer

Additives were each added in the above emulsion so as to give the following amount per unit area, to prepare a solution. The resulting solution was coated on a polyethylene terephthalate support (thickness: 100 μm) having been subjected to latex subbing treatment according to Example 1 in Japanese Unexamined Patent Publication No. 19941/1984.

| | |
|---|---|
| Latex polymer: Styrene/butyl acrylate/acrylic acid terpolymer | 1.0 g/m² |
| Tetraphenylphosphonium chloride | 30 mg/m² |
| Saponin | 200 mg/m² |
| Polyethylene glycol | 100 mg/m² |
| Sodium dodecylbenzenesulfonate | 100 mg/m² |
| Hydroquinone | 200 mg/m² |
| Phenidone | 100 mg/m² |
| Sodium styrenesulfonate/maleic acid copolymer (Mw = 250,000) | 200 mg/m² |
| Butyl gallate | 500 mg/m² |
| Hydrazine [the compound of Formula (IV)] | as shown in Table 7 |
| 5-Methylbenzotriazole | 30 mg/m² |
| Desensitizing dye of Formula (IXa) to (IXg) | as shown in Table 7 |
| 2-Mercaptobenzimidazole-5-sulfonic acid | 30 mg/m² |
| Inert ossein gelatin (isoelectric point: 4.9) | 1.5 g/m² |
| 1-(p-Acetylamidophenyl)-5-mercapto-tetrazole | 30 mg/m² |
| Silver weight | 2.8 g/m² |

Emulsion layer protective film

A solution with the following composition was prepared and coated to provide a emulsion layer protective film.

| | |
|---|---|
| Fluorinated dioctylsulfosuccinic acid ester | 300 mg/m$^2$ |
| Matting agent: Polymethyl methacrylate (average particle diameter: 3.5 μm) | 100 mg/m$^2$ |
| Lithium nitrate | 30 mg/m$^2$ |
| Acid-treated gelatin (isoelectric point: 7.0) | 1.2 g/m$^2$ |
| Colloidal silica | 50 mg/m$^2$ |
| Sodium styrenesulfonate/maleic acid copolymer | 100 mg/m$^2$ |
| Vat dye | |

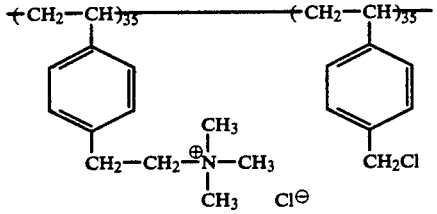

Treatment on the opposite side of the support and preparation of a non-gelatin layer thereon On the side opposite to the emulsion layer side, the support was previously subjected to corona discharging at a power of 30 W/m$^2$·min. Thereafter, a butadiene/-styrene/divinylbenzene/acrylic acid latex polymer was coated in the presence of a hexamethylene aziridine hardening agent, followed by heating at 160° C. for 10 seconds and further corons discharging. Subsequently, 1 g/m$^2$ of a conductive polymer to be used in the non-gelatin layer (Compound (1) as an exemplary compound) was mixed with a styrene/butyl acrylate/acrylic acid polymer, and the mixture was coated thereon.

Backing layer

Additives were each added so as to give the following amount per unit area, to prepare a solution. The resulting solution was coated on the non-gelatin layer of the support.

| | |
|---|---|
| Hydroquinone | 100 mg/m$^2$ |
| Phenidone | 30 mg/m$^2$ |
| Latex polymer: Butyl acrylate/styrene copolymer | 0.5 g/m$^2$ |
| Styrene/maleic acid copolymer | 100 mg/m$^2$ |
| Citric acid | 40 mg/m$^2$ |
| Benzotriazole | 100 mg/m$^2$ |
| Lithium nitrate | 30 mg/m$^2$ |
| Backing dye | The compounds of (a) to (c) used in Example 1 and contents thereof |
| Ossein gelatin | 2.0 g/m$^2$ |
| Compound of this invention, having the sulfonic acid group as shown in Table 7 | |

Backing layer protective layer

Additives were each added so as to give the following amount per unit area, to prepare a solution, which was then coated.

| | |
|---|---|
| Dioctyl sulfosuccinate | 100 mg/m$^2$ |
| Surface active agent of this invention VI-39 | 200 mg/m$^2$ |
| Matting agent: Polymethyl methacrylate (average particle diameter: 4.0 μm) | 100 mg/m$^2$ |
| Colloidal silica | 30 mg/m$^2$ |
| Ossein gelatin (isoelectric point: 4.9) | 1.0 g/m$^2$ |
| Surface active agent of this invention as shown in Table 7 | |

Samples obtained in the above way were exposed to light using the light source as shown in Table 7 and subjected to development processing using the following developing solution and fixing solution.

Exposure method

A non-electrode discharge light source having a maximum of specific energy at 360 to 450 nm, called "V-bulb", manufactured by Fusion Co., U.S.A., or a conventional light source having a maximum of specific energy at 340 to 380 nm, called "D-bulb", was set beneath a glass sheet, and an original and the light-sensitive material were placed on the glass surface so that the superimposition quality can be evaluated. Exposure was then carried out.

(Formulation of developing solution)

| | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-sulfosalicylate | 75 g |
| Sodium ethylenediaminetetraacetate | 2 g |

Made up to 1 liter with water.
The pH was adjusted to 11.5 using sodium hydroxide.

(Formulation of fixing solution)

| | |
|---|---|
| Composition A: | |
| Ammonium thiosulfate (an aqueous 72.5 wt. % solution) | 240 ml |
| Sodium sulfite | 17 g |
| Sodium acetate.trihydrate | 6.5 g |
| Boric acid | 6 g |
| Sodium citrate.dihydrate | 2 g |
| Acetic acid (an aqueous 90 wt. % solution) | 13.6 ml |
| Composition B: | |
| Pure water (ion-exchanged water) | 17 ml |
| Sulfuric acid (an aqueous 50 wt. % solution) | 3.0 g |
| Aluminum sulfate (an aqueous solution with a content of 8.1 wt. % in terms of $Al_2O_3$) | 20 g |

When using the fixing solution, the above Composition A and Composition B were dissolved in this order in 500 ml of water, and the solution was made up to 1 liter. The pH of this fixing solution was about 5.6.

(Development processing conditions)

| Step | Temperature | Time |
|---|---|---|
| Developing | 40° C. | 8 seconds |
| Fixing | 35° C. | 8 seconds |
| Washing | Room temp. | 10 seconds |

Evaluation was made in the following way. Results obtained are shown in Table 7.

Evaluation method for photographic performance (1) Pinhole suppression performance:

A halftone film was placed on a base for mounting, and the periphery of the halftone film was further kept fastened with a transparent Scotch tape used for plate making. After the exposure and development processing were carried out, the sample free from pinholes was judged as "5", and the sample with pinholes generated in a largest number at the worst level, as "1" to make relative five-rank evaluation.

(2) Superimposition quality:

The superimposition quality refers to the image quality that enables reproduction of a 50 μm line-width image on a line image film when correct exposure was carried out so that an area having a 50 % halftone dot area may give a 50% halftone dot area on the contact light-sensitive material. A very good superimposition quality was judged as "5", and an image quality with the worst level, as "1"to make relative five-rank evaluation.

Results obtained are shown in Table 7.

TABLE 7-1

| Sample No. | Emulsion layer: Silver halide grains: Average grain size (μm) | Degree of monodispersion | Silver halide composition (mol % ratio) (Cl/Br/I) | Compound of Formula (IV): No. | Amount (g/m²) | Compounds of Formulas (IXa) to (IXg): No. | Amount (mg/m²) |
|---|---|---|---|---|---|---|---|
| 58 | 0.10 | 15 | 50/50/0 | — | — | — | — |
| 59 | 0.10 | 15 | 60/40/0 | — | — | — | — |
| 60 | 0.10 | 15 | 65/35/0 | — | — | — | — |
| 61 | 0.10 | 15 | 65/35/0 | IV-1 | 31 | — | — |
| 62 | 0.10 | 15 | 90/10/0 | IV-1 | 31 | — | — |
| 63 | 0.10 | 15 | 90/10/0 | IV-1 | 31 | IX-31 | 33 |
| 64 | 0.10 | 15 | 90/10/0 | IV-1 | 31 | IX-31 | 33 |
| 65 | 0.10 | 15 | 90/10/0 | IV-3 | 31 | IX-31 | 33 |
| 66 | 0.10 | 15 | 90/10/0 | IV-3 | 31 | IX-31 | 33 |
| 67 | 0.12 | 18 | 100/0/0 | IV-3 | 31 | IX-31 | 33 |
| 68 | 0.12 | 18 | 100/0/0 | IV-3 | 31 | IX-31 | 33 |
| 69 | 0.11 | 16 | 95/5/0 | IV-47 | 40 | III-4 | 20 |
| 70 | 0.11 | 16 | 95/5/0 | IV-47 | 40 | III-4 | 20 |
| 71 | 0.15 | 15 | 90/9/1 | IV-47 | 40 | III-4 | 20 |
| 72 | 0.15 | 15 | 90/9/1 | IV-47 | 40 | III-4 | 20 |
| 73 | 0.15 | 15 | 90/9/1 | IV-48 | 40 | III-18 | 26 |
| 74 | 0.20 | 15 | 100/0/0 | IV-49 | 40 | III-18 | 26 |
| 75 | 0.20 | 15 | 100/0/0 | IV-50 | 40 | III-18 | 26 |
| 76 | 0.20 | 15 | 100/0/0 | IV-51 | 40 | III-18 | 26 |
| 77 | 0.20 | 15 | 100/0/0 | IV-53 | 40 | III-18 | 26 |
| 78 | 0.20 | 15 | 100/0/0 | IV-53 | 40 | III-18 | 26 |
| 79 | 0.20 | 15 | 100/0/0 | IV-53 | 40 | III-18 | 26 |

TABLE 7-2

| Sample No. | Backing layer: Polymer compound: No. | Amount (g/m²) | Backing layer protective layer: Polymer comp.: No. | Amount (g/m²) | Surfactant: No. | Amount (g/m²) |
|---|---|---|---|---|---|---|
| 58 | — | — | — | — | — | — |
| 59 | — | — | — | — | — | — |
| 60 | — | — | — | — | — | — |
| 61 | — | — | — | — | — | — |
| 62 | — | — | — | — | — | — |
| 63 | 11 | 1.0 | — | — | — | — |
| 64 | 11 | 1.0 | 11 | 0.5 | — | — |
| 65 | 11 | 1.0 | 11 | 0.5 | VI-4 | 0.3 |
| 66 | 12 | 1.0 | 11 | 0.5 | VI-9 | 0.3 |
| 67 | 12 | 1.0 | 11 | 0.5 | VI-9 | 0.3 |
| 68 | 13 | 1.0 | 11 | 0.5 | VI-9 | 0.3 |
| 69 | 13 | 1.0 | 11 | 0.5 | VI-9 | 0.3 |
| 70 | 11 | 1.0 | — | — | VI-9 | 0.3 |
| 71 | 11 | 1.0 | 11 | 0.5 | VI-9 | 0.3 |
| 72 | 13 | 1.0 | — | — | VI-20 | 0.3 |
| 73 | 15 | 1.0 | — | — | VI-20 | 0.3 |
| 74 | 18 | 1.0 | — | — | VI-20 | 0.3 |
| 75 | 20 | 1.0 | — | — | VI-20 | 0.3 |
| 76 | 11 | 1.0 | 11 | 0.5 | VI-20 | 0.3 |
| 77 | 11 | 1.0 | 11 | 0.5 | VI-20 | 0.3 |
| 78 | 15 | 1.0 | 11 | 0.5 | VI-20 | 0.3 |
| 79 | 18 | 1.0 | 11 | 0.5 | VI-20 | 0.3 |

TABLE 7-3

| Sample No. | Exposure light source* | Photographic performance: Pinhole supression performance | Superimposition performance | Remarks |
|---|---|---|---|---|
| 58 | D bulb | 1 | 1 | Comparative |
| 59 | D bulb | 2 | 1 | Comparative |
| 60 | D bulb | 2 | 2 | Comparative |
| 61 | D bulb | 2 | 2 | Comparative |
| 62 | D bulb | 2 | 2 | Comparative |
| 63 | D bulb | 3 | 4 | Invention |
| 64 | D bulb | 3 | 3 | Invention |
| 65 | D bulb | 5 | 5 | Invention |
| 66 | D bulb | 5 | 5 | Invention |
| 67 | D bulb | 5 | 5 | Invention |
| 68 | D bulb | 5 | 5 | Invention |
| 69 | D bulb | 5 | 5 | Invention |
| 70 | D bulb | 4 | 4 | Invention |
| 71 | D bulb | 5 | 5 | Invention |
| 72 | D bulb | 4 | 5 | Invention |
| 73 | D bulb | 4 | 5 | Invention |
| 74 | D bulb | 4 | 5 | Invention |
| 75 | D bulb | 4 | 5 | Invention |
| 76 | D bulb | 5 | 5 | Invention |
| 77 | D bulb | 5 | 5 | Invention |
| 78 | V bulb | 5 | 5 | Invention |
| 79 | V bulb | 5 | 5 | Invention |

*Energy maximum (nm)
Light source to give amount of exposure:
D-bulb: 350–380 nm
V-bulb: 400–420 nm As will be seen from Table 7, the generation of pinholes is suppressed and also the superimposition performance is improved when the light-sensitive material is provided with (i) the silver halide emulsion layer containing the hydrazine compound [Formula (IV)] and the sensitizing dye or ultraviolet absorbent [Formulas (IXa) to (IXg)] and (ii) the layer provided thereon as the protective layer containing the surfactant [Formula (IV)] and the metal oxide according to this invention.

It is further shown that the light-sensitive material remarkably improved in the superimposition performance with less generation of pinholes can be obtained when the light source having an energy maximum at 400 to 420 nm is used as the light source.

EXAMPLE 8

Samples were prepared in the same manner as Example 7, except that two types of silver halide grains comprised of chief grains and sub-grains were mixed and used herein. The chief grains were cubic silver iodobromide grains having an average grain size of 0.12 μm and a degree of monodispersion, of 15, containing 2 mol % of iodine, and contained $10^{-5}$ mol of rhodium inside the grains. The subgrains were cubic silver chlorobromide grains having an average grain size of 0.08 μm and a degree of monodispersion, of 15, and contained $2\times10^{-5}$ mol of rhodium inside the grains, containing 2 mol % of bromide, having a lower sensitivity than the chief grains. The chief grains and sub-grains were mixed in the proportion of 1:10, and the same additives as in Example 7 were added to prepare samples, which were then subjected to exposure and development processing. Evaluation was also made in the same manner.

Results obtained are shown in Table 8.

TABLE 8-1

| Sample No. | Emulsion layer: Compound of Formulas (Va)-(Vc) No. | Amount (g/m²) | Compound of Formulas (IXa)-(IXg) No. | Amount (mg/m²) | Backing layer Polymer compound No. | Amount (g/m²) |
|---|---|---|---|---|---|---|
| 80 (Coma.) | V-2 | 20 | — | — | — | — |
| 81 (Inv.) | V-3 | 30 | — | — | 11 | 1.0 |
| 82 (Inv.) | V-6 | 30 | — | — | 11 | 1.0 |
| 83 (Inv.) | V-8 | 30 | — | — | 11 | 1.0 |
| 84 (Inv.) | V-10 | 30 | IX-12 | 0.1 | 11 | 1.0 |
| 85 (Inv.) | V-11 | 30 | — | — | 14 | 1.0 |
| 86 (Inv.) | V-12 | 30 | — | — | 14 | 1.0 |
| 87 (Inv.) | V-13 | 30 | IX-12 | 0.1 | 14 | 1.0 |
| 88 (Inv.) | V-3 | 20 | — | — | 16 | 1.0 |
| 89 (Inv.) | V-3 | 20 | — | — | 18 | 1.0 |
| 90 (Inv.) | V-3 | 20 | — | — | 20 | 1.0 |
| 91 (Inv.) | V-15 | 30 | IX-16 | 0.1 | 22 | 1.0 |
| 92 (Inv.) | V-16 | 30 | IX-16 | 0.1 | 26 | 1.0 |
| 93 (Inv.) | V-18 | 30 | IX-16 | 0.1 | 26 | 1.0 |

TABLE 8-2

| Sample No. | Backing layer protective layer: Polymer compound No. | Amount (g/m²) | Surfactant No. | Amount (g/m²) | Exposure light source | Photographic performance: Pinhole supression performance | Super imposition performance |
|---|---|---|---|---|---|---|---|
| 80 | — | — | — | — | V bulb | 1 | 2 |
| 81 | — | — | — | — | V bulb | 3 | 3 |
| 82 | 11 | 0.5 | — | — | V bulb | 4 | 3 |
| 83 | 11 | 0.5 | VI-4 | 0.2 | V bulb | 4 | 4 |
| 84 | 11 | 0.5 | VI-4 | 0.2 | V bulb | 5 | 5 |
| 85 | — | — | — | — | V bulb | 3 | 3 |
| 86 | 14 | 0.3 | VI-4 | 0.2 | V bulb | 4 | 4 |
| 87 | 14 | 0.3 | VI-4 | 0.2 | V bulb | 5 | 5 |
| 88 | 16 | 0.5 | VI-6 | 0.2 | V bulb | 4 | 4 |
| 89 | 18 | 0.5 | VI-10 | 0.2 | V bulb | 4 | 4 |
| 90 | 20 | 0.5 | VI-10 | 0.2 | V bulb | 4 | 4 |
| 91 | 22 | 0.5 | VI-14 | 0.2 | V bulb | 5 | 5 |
| 92 | 22 | 0.5 | VI-16 | 0.2 | V bulb | 4 | 4 |
| 93 | 26 | 0.5 | VI-16 | 0.2 | V bulb | 4 | 4 |

As will be evident from the results shown in Table 8, it is seen that, in the combination according to this invention, the generation of pinholes can be suppressed and also the superimposition performance can be improved by providing the layer containing the polymer compound of this invention, also when the tetrazolium compound is used in the silver halide emulsion layer.

As described above, this invention can provide a light-sensitive silver halide photographic material having the photographic performance such that the generation of pinholes can be suppressed and also a good superimposition quality can be obtained, and can make image formation with such performance.

EXAMPLE 9

A silver iodobromide emulsion (1 mol % of silver iodide per mol of silver) was prepared according to a simultaneous mixing method. It comprised grains having an average grain size of 0.28 μm. This emulsion was washed with water and desalted according to a conventional method, followed by sulfur sensitization. After the sensitization, as stabilizers, 1.5 g of 4-hydroxy-6-methyl-1,3,3a,7-tetrazaindene, 3 g of hydroquinone and 2 g of resorcylaldoxime, each per mol of silver, were added.

In addition, as fog restrainers, 1-phenyl-5-mercaptotetrazole and 5-methylbenzotriazole were each added in an amount of 0.1 g per mol of silver, and as a sensitizing dye 200 g (per mol of silver) of sodium anhydro-5,5-dichloro-9-ethyl-3,3-bis(3-sulfopropyl)oxacarbocyanine hydroxide was added. Further, 1 g (per mol of silver) of saponin as a coating auxiliary and 200 mg (per mol of silver) of a styrene/maleic acid copolymer as a thickening agent were added. An emulsion was thus prepared. This emulsion was divided into 12 fractions, and the compounds of Formula (III) as shown in Table 9 or comparative compounds thereof (the following d, e, f) and the hydrazine compounds as shown in Table 9 were respectively added in the divided emulsions to make emulsion coating solutions.

The compounds represented by Formula (III) were each added in an amount of $3\times10^{-4}$ mol per mol of silver, and the compounds d), e) and f), each $3\times10^{-3}$ mol per mol of silver.

(d)

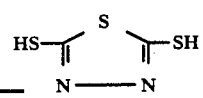

-continued (e)

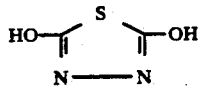

(f)

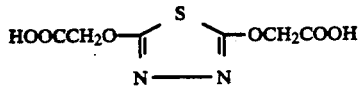

Preparation of emulsion layer protective coating solution

Subsequently, a coating solution for an emulsion layer protective film was prepared in the following way. Namely, in 1 kg of gelatin, 10 lit of pure water was added. After swelling, the mixture was heated to 40° C., and 30 g of a polymer of methyl methacrylate (average particle diameter: 0.27 μm) as a matting agent was dispersed in gelatin to make up the dispersion to 20 lit. The coating solution for the protective layer was thus prepared.

Preparation of light-sensitive silver halide photographic material

On a 100 μm thick polyethylene terephthalate support having been subjected to subbing treatment, the emulsion coating solution and protective film coating solution prepared in the above were put into combination and simultaneously coated layer by layer so that the silver weight may be 3.5 g/m$^2$, the amount of gelatin on the emulsion layer may be 1.8 g/m$^2$ and the amount of gelatin on the protective layer may be 1.1 g/m$^2$. Samples No. 94 to No. 105 as shown in Table 9 were thus prepared. When they are coated layer by layer, three kinds of hardening agents, 20 mg (per gram of gelatin) of formaldehyde, 20 mg (per gram of gelatin) of mucochloric acid and 10 mg (per gram of gelatin) of ethyleneimine, were added in the protective film coating solution to effect hardening.

Preparation of layers on the opposite side

On the side opposite to the emulsion layer side, the support was previously subjected to corona discharging at a power of 30 W/m$^2$·min. Thereafter, a butadiene/styrene/divinylbenzene/acrylic acid latex polymer was coated in the presence of a hexamethylene aziridine hardening agent, followed by heating at 160° C. for 10 seconds and further corona discharging. Subsequently, 1 g/m$^2$ of a conductive polymer to be used in the non-gelatin layer (Compound (1) as an exemplary compound) was mixed with a styrene/butyl acrylate/acrylic acid polymer, and the mixture was coated thereon. Next, on the resulting layer, a backing layer containing a backing dye with the following composition was provided by coating. The gelatin layer was hardened using glyoxal and sodium 1-oxy-3,5-dichloro-S-triazine.

| | |
|---|---|
| Hydroquinone | 100 mg/m$^2$ |
| Phenidone | 30 mg/m$^2$ |
| Latex polymer: Butyl acrylate/styrene copolymer | 0.5 g/m$^2$ |
| Styrene/maleic acid copolymer | 100 mg/m$^2$ |
| Citric acid | 40 mg/m$^2$ |
| Benzotriazole | 100 mg/m$^2$ |
| Lithium nitrate | 30 mg/m$^2$ |
| Backing dye | (a) described in Example 1 |
| Ossein gelatin | 2.0 g/m$^2$ |
| Compound of this invention, having the sulfonic acid group (Compound (26)) | 0.5 g/m$^2$ |
| Calcium | 2,000 ppm in gelatin |
| Iron | 10 ppm in gelatin |

Development processing

These samples were subjected to stepwise exposure using a xenon light through a commercially available conventional contact screen (a gray negative with 150 lines), and thereafter development processing according to the following development solution formulation was carried out. The fixing solution used was a commercially available fixing solution used for rapid processing. The development processing was carried out under conditions of 40° C. and 20 seconds for developing, 35° C. and 20 seconds for fixing, and room temperature and 20 seconds for washing.

| (Formulation of developing solution) | |
|---|---|
| Disodium ethylenediaminetetraacetate | 1 g |
| Sodium sulfite | 75 g |
| Hydroquinone | 15 g |
| N-methyl-p-aminophenol (hemisulfate) | 5 g |
| Sodium bromide | 3.0 g |
| 5-Methylbenzotriazole | 0.9 g |
| 1-Phenyl-5-mercaptotetrazole | 0.1 g |
| Adjusted to pH 11.5 using KOH. | |

Measurement method

Halftone dot quality at a 10% halftone area, a 50% halftone area and a 95% halftone area each of the above processed samples was visually observed using a magnifier of 100 magnifications to make five-rank evaluation. Evaluation point "1" shows the lowest quality level, and, with relatively increasing quality levels, the rank "5" shows the highest level.

Measurement results

Results of measurement are shown in Table 9. As will be evident from Table 9, Samples Nos. 97 to 105 of this invention were found to obtain halftone dots with high quality and at the same time obtain a high sensitivity and good fog characteristics, when the compound represented by Formula (III) and the hydrazine compound are used in combination. On the other hand, the comparative Samples Nos. 94 to 96 were found to be able to obtain no halftone dots with high quality, and also poor in both the sensitivity and fog characteristics.

TABLE 9

| Sample No. | Compound of Formula (III) Type | Compound of Formula (III) Amount* | Hydrazine comp. | Halftone dot quality 10% | Halftone dot quality 50% | Halftone dot quality 90% | Relative sensitivity | Fog |
|---|---|---|---|---|---|---|---|---|
| 94 | (d) | $3 \times 10^{-3}$ | IV-74 | 2 | 3 | 2 | Standard | 0.06 |
| 95 | (e) | $3 \times 10^{-3}$ | IV-75 | 2 | 2 | 2 | −0.20 | 0.06 |
| 96 | (f) | $3 \times 10^{-3}$ | IV-76 | 2 | 2 | 2 | −0.25 | 0.07 |
| 97 | III-1 | $3 \times 10^{-4}$ | IV-77 | 5 | 5 | 5 | +0.20 | 0.04 |
| 98 | III-2 | $3 \times 10^{-4}$ | IV-76 | 5 | 5 | 5 | +0.20 | 0.04 |
| 99 | III-3 | $3 \times 10^{-4}$ | IV-79 | 5 | 5 | 5 | +0.20 | 0.04 |

TABLE 9-continued

| Sample No. | Compound of Formula (III) Type | Amount* | Hydrazine comp. | Halftone dot quality 10% | 50% | 90% | Relative sensitivity | Fog |
|---|---|---|---|---|---|---|---|---|
| 100 | III-4 | $3 \times 10^{-4}$ | IV-79 | 5 | 5 | 5 | +0.18 | 0.04 |
| 101 | III-5 | $3 \times 10^{-4}$ | IV-87 | 4 | 5 | 4 | +0.21 | 0.04 |
| 102 | III-7 | $3 \times 10^{-4}$ | IV-87 | 4 | 5 | 4 | +0.20 | 0.04 |
| 103 | III-8 | $3 \times 10^{-4}$ | IV-87 | 4 | 5 | 4 | +0.19 | 0.04 |
| 104 | III-13 | $3 \times 10^{-4}$ | IV-100 | 5 | 5 | 5 | +0.21 | 0.04 |
| 105 | III-14 | $3 \times 10^{-4}$ | IV-100 | 5 | 5 | 5 | +0.20 | 0.04 |

*mol per mol of Ag

Example 10

In order to confirm the effect by the stabilizer, Sample No. 106 was prepared in entirely the same manner as Sample No. 102 in Example 9 except that hydroquinone and resorcylaldoxime were not used. Samples Nos. 107 and 108 were also prepared using hydroquinone, or hydroquinone and resorcylaldoxime, in the amount per mol of silver as shown in Table 10, in the preparation of the emulsion.

Results of measurement are shown in Table 10. As will be seen from Table 10, Samples Nos. 107 and 108 in which hydroquinone, or hydroquinone and resorcyclaldoxime, is/are added were found to be more remarkably effective than Sample No. 106 in which any of these compounds are not added.

TABLE 10

| Sample No. | Compound of Formula (VIIIa) or (VIIIb) Name of compound | Amount | Halftone dot quality 10% | 50% | 90% | Relative sensitivity | Fog |
|---|---|---|---|---|---|---|---|
| 106 | — | — | 3 | 5 | 4 | +0.20 | 0.06 |
| 107 | Hydroquinone | 1* | 4 | 5 | 4 | +0.20 | 0.04 |
| 108 | Hydroquinone/ Resorcyl-aldoxime | 1* 0.5* | 4 | 5 | 4 | +0.20 | 0.04 |

*g per mol of Ag

As described above, according to this invention, the light-sensitive material containing the hydrazine compound can improve the sensitivity and contrast, and, in forming halftone dots, can obtain halftone dots with high quality without relying on the size of the halftone dot areas.

We claim:

1. A light sensitive silver halide photographic material comprising:
   - a transparent support having an upper surface and a lower surface and having
   - a silver halide emulsion layer on the upper surface, and having on the lower surface
   - a first subbing layer containing a latex polymer,
   - a second non-gelatin layer containing a conductive polymer, and
   - a third gelatin layer containing a conductive polymer and a backing dye, wherein said lower surface of the support is subjected to corona discharge treatment.

2. The light-sensitive silver halide photographic material according to claim 1, wherein the transparent support is made of polyethylene terephthalate or tricellulose acetate.

3. The light-sensitive silver halide photographic material according to claim 1, wherein the silver halide emulsion layer contains a hydrazine compound or a tetrazolium compound.

4. The light-sensitive silver halide photographic material according to claim 1, wherein the conductive polymer contained in the non-gelatin layer is a conductive copolymer having at least one of a sulfonic acid group and a sulfuric acid ester group, and further having at least one slected from the group consisting of a hydroxyl group, an amino group, an active methylene group and a sulfinic acid group.

5. The light-sensitive silver halide photographic material according to claim 1, wherein the gelatin in the photographic material contains 1 to 999 ppm of calcium.

6. The light-sensitive silver halide photographic material according to claim 5, wherein the gelatin in the photographic material contains 1 to 500 ppm of calcium.

7. The light-sensitive silver halide photographic material according to claim 1, wherein the gelatin in the photographic material contains 0.01 to 50 ppm of iron.

8. The light-sensitive silver halide photographic material according to claim 7, wherein the gelatin in the photographic material contains 0.1 to 10 ppm of iron.

9. The light-sensitive silver halide photographic material according to claim 1, wherein the backing dye contains a sulfonic acid group.

10. The light-sensitive silver halide photographic material according to claim 1, wherein an energy value applied in the corona discharge treatment is from 1 mw to 1 $kW/m^2 \cdot min$.

11. The light-sensitive silver halide photographic material according to claim 1, wherein the conductive polymer has a molecular weight of 5,000 to 1,000,000.

12. The light-sensitive silver halide photographic material according to claim 11, wherein the conductive polymer has a molecular weight of 10,000 to 500,000.

13. The light-sensitive silver halide photographic material according to claim 1, wherein the content of the latex polymer is 0.01 to 5 g per $m^2$ of the photographic material.

14. The light-sensitive silver halide photographic material according to claim 1, wherein the conductive polymer is contained in both of the gelatin layer and non-gelatin layer in an amount of 0.01 to 5 g per $m^2$ of the photograhic material.

15. The light-sensitive silver halide photographic material according to claim 1, wherein the transparent support transmit substantially 90% or more of visible light.

16. A light-sensitive silver halide photographic material according to claim 1, wherein;

said conductive polymer contained in the non-gelatin layer is a water-soluble polymer having a repeating unit represented by the following Formula (I); and said gelatin layer containing the conductive polymer and backing dye is further incorporated with a compound capable of bonding with at least one of a calcium ion and a magnesium ion.

Formula (I)

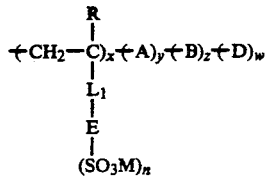

wherein R represents a hydrogen atom, a halogen atom, or an alkyl group; A, B and D each represent a monomer unit different from each other, copolymerized with copolymerizable ethylenically unsaturated monomers containing a carboxyl group or an ester derivative thereof or a halogen atom; x is 10 to 100 mol %, y is 0 to 90 mol % z is 0 to 20 mol %, and w is 0 to 10 mol %; E represents a mere bonding group, or a divalent bonding group constituted of at least one selected from the group consisting of a carbon atom, a nitrogen atom, a sulfur atom, an oxygen and a phosphorus atom; $L_1$ represents a benzene ring or a heterocyclic ring; M represents a hydrogen atom, an ammonium cation or an alkali metal ion; and n is 1 or 2.

17. The light-sensitive silver halide photographic material according to claim 16, wherein the compound represented by the Formula (I) is contained in an amount of 0.01 to 10 g per $m^2$ of the light-sensitive material.

18. A light-sensitive silver halide photographic material according to claim 1, wherein;

said light-sensitive silver halide emulsion layer contains a hydrazine compound or a tetrazolium compound;

the conductive polymer contained in said gelatin layer is the water-soluble polymer having a repeating unit represented by the above Formula (I); and at least one layer of the gelatin layer is hardened with a hardening agent represented by the following Formula (II), Formula (II)

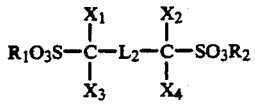

wherein $R_1$ and $R_2$ each represent an alkyl group having 1 to 4 carbon atom, and may different from each other; $X_1$, $X_2$, $X_3$ and $X_4$ each represent a hydrogen atom, an alkyl group having 1 to 3 carbon atoms, or a halogen atom, and may be different from each other; and $L_2$ represents a mere bonding group, or an alkylene group or alkyleneoxy group having 1 to 4 carbon atoms.

19. The light-sensitive silver halide photographic material according to claim 18, wherein the hydrazine compound is a compound represented by Formula (IV)

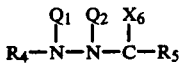

in the formula, $R_4$ represents a monovalent organic residual group; $R_5$ represents a hydrogen atom or a monovalent organic residual group; $Q_1$ and $Q_2$ each represent a hydrogen atom, an alkylsulfonyl group which may be substituted or an arylsulfonyl group which may be substituted; and $X_6$ represents an oxygen atom or a sulfur atom.

20. The light-sensitive silver halide photographic material according to claim 18, wherein the hydrazine compound is contained in at least one of the silver halide emulsion layer and a non-light-sensitive layer present on the side of which the silver halide emulsion layer is provided on the support in an amount of from $10^{-5}$ to $10^{-1}$ mol per mol of silver.

21. The light-sensitive silver halide photographic material according to claim 18, wherein the tetrazolium compound is Formula (Va)

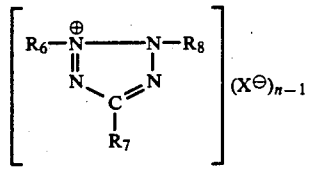

Formula (Vb)

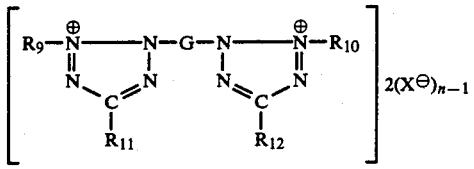

Formula (Vc)

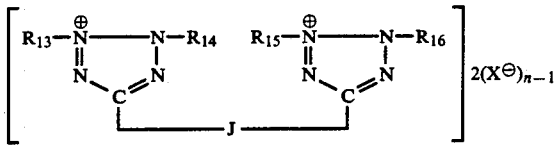

In the formulas, $R_6$, $R_8$, $R_9$, $R_{10}$, $R_{13}$, $R_{14}$, $R_{15}$ and $R_{16}$ each represent a group selected from an alkyl group, an alkenyl group, an aryl group and a heterocyclic group, or all are the groups that form a metal chelate or complex; $R_7$, $R_{11}$ and $R_{12}$ each represent a group selected from an allyl group, a phenyl group which may have a substituent, a napthyl group which may have a substituent, a heterocyclic group, an alkyl group, a hydroxyl group, a carboxyl group or a salt thereof, an alkoxycarbonyl group, an amino group, a mercapto group, a nitro group and a hydrogen atom; G represents a divalent aromatic group; J represents a group selected from an alkylene group, an allylene group and an aralkylene group; $X^-$ represents an anion; and n represents an integer of 1 to 2, provided that n is 1 when the compound forms an internal salt.

22. The light-sensitive silver halide photographic material according to claim 18, wherein the tetrazolium compound is contained in an amount of from $1\times10^{-6}$ to 10 mol per mol of silver halide.

23. The light-sensitive silver halide photographic material according to claim 18, wherein the compound represented by the Formula (III) is contained in an amount of $1\times10^{-3}$ to $10^2$ g per $m^2$ of the light-sensitive material.

24. The light-sensitive silver halide photographic material according to claim 1, wherein:

said light-sensitive silver halide emulsion layer contains a hydrazine compound or a tetrazolium compound;

the conductive polymer contained in the gelatin layer and non-gelatin layer is a conductive polymer having on a heterocyclic ring at least one sulfonic acid group or substituted alkylsulfonic acid group; and said non-gelatin layer contains a fluorine-containing surface active agent.

25. The light-sensitive silver halide photographic material according to claim 24, wherein the surface active agent containing fluorine is represented by the following Formula (VIa), (VIb), (VIc), (VId) or (VIe):

Formula (VIa)

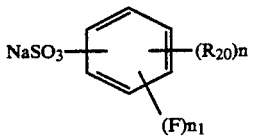

in the formula, $R_{20}$ represents an alkyl group having 1 to 32 carbon atoms which are substituted with at least one fluorine atom; n represents an integer of 1 to 3; and n represents an integer of 0 to 4, Formula (VIb)

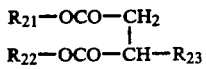

Formula (VIc)

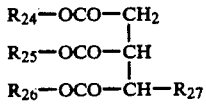

in the formulas, $R_{21}$, $R_{22}$, $R_{24}$, $R_{25}$ and $R_{26}$ each represent a straight-chain Or branCHed alkyl group having 1 to 22 carbon atoms, which may be an alkyl group that forms a ring, being substituted with at least one fluorine atom, or, $R_{21}$, $R_{22}$, $R_{24}$, $R_{25}$ and $R_{26}$ each represents an aryl group being substituted with at least one fluorine atom or a group substituted with at least one fluorine atom; $R_{23}$ and $R_{27}$ each represent an acid radical, Formula (VId)

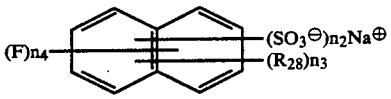

in the formula, $R_{28}$ represents a saturated or unsaturated straight-chain or branched alkyl group having 1 to 32 carbon atoms; $n_2$ and $n_3$ each represent an integer of 1 to 3 and $n_4$ represents an integer of 0 to 6, Formula (VIe)

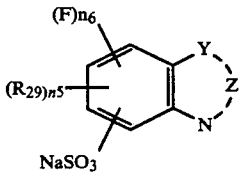

in the formula, Y represents a sulfur atom, a selenium atom, an oxygen atom, a nitrogen atom, or a group of $R_{30}$

—N—

(wherein $R_{30}$ represents a hydrogen atom, or an alkyl group having 1 to 3 carbon atoms); and $R_{29}$ represents a group having the same definition as the group represented by $R_{20}$ in the above Formula (VIa), or an aryl group substituted with at least one fluorine atom; Z represents a group of atoms necessary for completing a heterocyclic ring of 5 or 6 members.

26. The light-sensitive silver halide photographic material according to claim 1, wherein said light-sensitive silver halide emulsion layer contains a compound represented by the following Formula (III) and a hydrazine compound in combination, Formula (III)

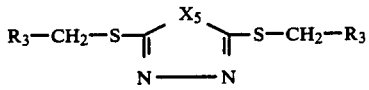

wherein $R_3$ represents a carboxylic acid group or sulfonic acid group which may be substituted, and $X_5$ represents a sulfur atom or an oxygen atom.

* * * * *

UNITED STATES PATENT AND TRADEMARK OFFICE

CERTIFICATE OF CORRECTION

PATENT NO. : 5,004,669

DATED : April 02, 1991

INVENTOR(S) : Taketoshi Yamada et al

It is certified that error appears in the above-identified patent and that said Letters Patent is hereby corrected as shown below:

Claim 1, Column 107, Line 48, change "light sensitive" to --light-sensitive--;

Claim 4, Column 108, Line 18, change "slected" to --selected--;

Claim 16, Column 109, Line 30, after " % " (first occurrence), insert -- , --;

Claim 18, Column 109, Line 63, change "atom" to --atoms--;

Claim 18, Column 109, Line 63, after "may" insert --be--;

Claim 21, Column 110, Line 57, change "napthyl" to --naphthyl--;

Claim 21, Column 110, Line 65, change "to" to --or--;

Claim 25, Column 111, Line 34, change "n" to (second occurrence) to --$n_1$--;

UNITED STATES PATENT AND TRADEMARK OFFICE

CERTIFICATE OF CORRECTION

PATENT NO. : 5,004,669

DATED : April 02, 1991

INVENTOR(S) : Taketoshi Yamada et al

It is certified that error appears in the above-identified patent and that said Letters Patent is hereby corrected as shown below:

Claim 25, Column 111, Line 47, change "Or branCh ed" to --or branched--;

Claim 25, Column 111, Line 48, "22" to --32--;

Claim 25, Column 112, Line 13, after "3" insert -- ; --;

Claim 25, Column 112, Line 25, delete "$R_{30}$"; and

Claim 25, Column 112, Line 27, change " -N- " to -- $-\overset{R_{30}}{\overset{|}{N}}-$ --.

Signed and Sealed this

Sixteenth Day of February, 1993

*Attest:*

STEPHEN G. KUNIN

*Attesting Officer*

*Acting Commissioner of Patents and Trademarks*